US008414000B2

(12) United States Patent
Chen et al.

(10) Patent No.: US 8,414,000 B2
(45) Date of Patent: Apr. 9, 2013

(54) ONE PIECE FLEXIBLE SKATEBOARD

(75) Inventors: Robert Chen, San Marino, CA (US); Robert A. Hadley, Yorba Linda, CA (US)

(73) Assignee: Razor USA, Inc., Cerritos, CA (US)

( * ) Notice: Subject to any disclaimer, the term of this patent is extended or adjusted under 35 U.S.C. 154(b) by 43 days.

(21) Appl. No.: 12/539,550

(22) Filed: Aug. 11, 2009

(65) Prior Publication Data

US 2011/0006497 A1 Jan. 13, 2011

Related U.S. Application Data

(63) Continuation-in-part of application No. 11/687,594, filed on Mar. 16, 2007, now Pat. No. 7,766,351, which is a continuation of application No. 11/462,027, filed on Aug. 2, 2006, now Pat. No. 7,338, 056.

(60) Provisional application No. 61/087,970, filed on Aug. 11, 2008, provisional application No. 61/118,345, filed on Nov. 26, 2008, provisional application No. 60/795,735, filed on Apr. 28, 2006.

(51) Int. Cl.
*A63C 5/03* (2006.01)

(52) U.S. Cl. ..... 280/87.042; 280/87.021

(58) Field of Classification Search ..... 280/87.042, 280/87.041, 87.05, 809, 842, 11.27, 87.021
See application file for complete search history.

(56) References Cited

U.S. PATENT DOCUMENTS

| | | | |
|---|---|---|---|
| 2,051,762 | A | 8/1936 | Vincent |
| 3,399,904 | A | 9/1968 | Schinke |
| 3,399,906 | A | 9/1968 | Portnoff |
| 3,982,766 | A | 9/1976 | Budge |
| 4,060,253 | A | 11/1977 | Oldendorf |
| 4,076,267 | A | 2/1978 | Lipscomb |
| 4,082,306 | A | 4/1978 | Sheldon |
| 4,092,033 | A | 5/1978 | Swain |

(Continued)

FOREIGN PATENT DOCUMENTS

| | | | |
|---|---|---|---|
| AU | 2007214338 | A1 | 3/2007 |
| CA | 2596570 | A1 | 10/2007 |

(Continued)

OTHER PUBLICATIONS

"About: Skateboarding; Other Boardsports", Document Retrieved on Mar. 8, 2007 from the website: http://skateboard.about.com/cs/fringeboarding/gr/?once-true&.

Cave, Steve, "About: Skateboarding; The Wave", Document Retrieved on Jan. 17, 2007 from the website: http://skateboard.about.com/cs/fringeboarding/gr/XBoard.htm.

(Continued)

*Primary Examiner* — Hau Phan
(74) *Attorney, Agent, or Firm* — Norman E. Brunell

(57) ABSTRACT

A flexible skateboard may include a pair of direction casters mounted for steering rotation on a twistable one piece skateboard with a multi-arm spring return assembly using pivoting stops associated with the wheel fork and non-pivoting stops mounted to the skateboard. Centering spring arrangements including range or rotation limitations such as hard stops are included. One or two dual wheel assemblies may be exchanged for the single wheel assemblies for ease or riding or learning how to ride. One piece skateboard bodies are formed by rigidly connecting together multiple pieces of the same or similar plastic molded parts to form a bridge like connecting member having increased structural strength for its weight.

8 Claims, 33 Drawing Sheets

U.S. PATENT DOCUMENTS

| | | | | |
|---|---|---|---|---|
| 4,093,252 | A | 6/1978 | Rue | |
| 4,140,326 | A | 2/1979 | Huber | |
| 4,245,848 | A | 1/1981 | Dudouyt | |
| 4,295,656 | A | 10/1981 | Moore | |
| 4,411,442 | A | 10/1983 | Rills | |
| 4,451,055 | A | 5/1984 | Lee | |
| 4,915,403 | A | 4/1990 | Wild et al. | |
| 4,921,513 | A | 5/1990 | Parten | |
| 4,930,794 | A | 6/1990 | Chan | |
| 4,955,626 | A | 9/1990 | Smith et al. | |
| 5,098,087 | A | 3/1992 | Matile et al. | |
| 5,160,155 | A | 11/1992 | Barachet | |
| 5,347,681 | A | 9/1994 | Wattron et al. | |
| 5,419,570 | A | 5/1995 | Bollotte | |
| 5,458,351 | A | 10/1995 | Yu | |
| 5,492,345 | A | 2/1996 | Kruczek | |
| 5,505,474 | A | 4/1996 | Yeh | |
| 5,540,455 | A | 7/1996 | Chambers | |
| 5,549,331 | A | 8/1996 | Yun et al. | |
| 5,566,956 | A | 10/1996 | Wang | |
| 5,601,299 | A | 2/1997 | Yun et al. | |
| 5,622,759 | A | 4/1997 | Fuster | |
| 5,707,068 | A | 1/1998 | Bradfield | |
| 5,826,895 | A | 10/1998 | Bradfield | |
| 5,853,182 | A | 12/1998 | Finkle | |
| 5,855,385 | A | 1/1999 | Hambsch | |
| 5,984,328 | A | 11/1999 | Tipton | |
| 6,053,303 | A | 4/2000 | Wang | |
| 6,059,303 | A | 5/2000 | Bradfield | |
| 6,102,415 | A | 8/2000 | Stewardson | |
| 6,193,249 | B1 | 2/2001 | Buscaglia | |
| 6,206,389 | B1 | 3/2001 | Yagi | |
| 6,254,113 | B1 | 7/2001 | Dornan | |
| 6,293,565 | B1 | 9/2001 | Bouchard et al. | |
| 6,315,304 | B1 | 11/2001 | Kirkland et al. | |
| 6,338,494 | B1 | 1/2002 | Killian | |
| 6,398,237 | B1 | 6/2002 | Attey | |
| 6,419,248 | B1 | 7/2002 | Kay | |
| 6,419,249 | B1 | 7/2002 | Chen | |
| 6,428,022 | B1 | 8/2002 | Namiki | |
| 6,481,724 | B1 | 11/2002 | Whipp | |
| 6,494,467 | B1 | 12/2002 | Menges | |
| 6,502,850 | B1 | 1/2003 | Schaller et al. | |
| 6,669,215 | B2 | 12/2003 | Laporte | |
| 6,910,698 | B2 | 6/2005 | Turner et al. | |
| 6,979,006 | B2 | 12/2005 | Pierron | |
| 7,044,486 | B2 | 5/2006 | Wright et al. | |
| 7,053,289 | B2 * | 5/2006 | Iwai et al. | 280/87.042 |
| 7,083,178 | B2 | 8/2006 | Potter | |
| 7,195,259 | B2 | 3/2007 | Gang | |
| 7,338,056 | B2 | 3/2008 | Chen et al. | |
| 7,367,572 | B2 | 5/2008 | Jiang | |
| 7,766,351 | B2 | 8/2010 | Chen et al. | |
| 7,891,680 | B2 | 2/2011 | Chen et al. | |
| 2002/0043774 | A1 | 4/2002 | Chou | |
| 2002/0067015 | A1 | 6/2002 | Tierney et al. | |
| 2002/0149166 | A1 | 10/2002 | Potter | |
| 2002/0195788 | A1 | 12/2002 | Tierney et al. | |
| 2003/0155733 | A1 | 8/2003 | Tan et al. | |
| 2004/0021281 | A1 | 2/2004 | Stephens, Jr. | |
| 2004/0262872 | A1 | 12/2004 | Kang | |
| 2006/0038361 | A1 | 2/2006 | Sano | |
| 2006/0055137 | A1 | 3/2006 | Jiang | |
| 2006/0163830 | A1 | 7/2006 | Kwak | |
| 2007/0001414 | A1 | 1/2007 | Kang | |
| 2007/0035102 | A1 | 2/2007 | McClain | |
| 2007/0252355 | A1 | 11/2007 | Chen et al. | |
| 2007/0273118 | A1 | 11/2007 | Conrad | |
| 2009/0295111 | A1 | 12/2009 | O'Rourke | |
| 2010/0253027 | A1 | 10/2010 | Chen et al. | |

FOREIGN PATENT DOCUMENTS

| | | | |
|---|---|---|---|
| CN | 101309730 | A | 11/2008 |
| CN | 201205442 | Y | 3/2009 |
| DE | 202008012754 | U1 | 1/2009 |
| DK | 176806 | B1 | 10/2009 |
| EP | 1511541 | A1 | 3/2005 |
| EP | 1679101 | A1 | 7/2006 |
| GB | 2318519 | A | 4/1998 |
| JP | 01-117385 | U | 8/1989 |
| JP | 2000-500369 | A | 1/2000 |
| JP | 2001-029663 | A | 2/2001 |
| JP | 2005-537820 | A | 12/2005 |
| KR | 1020010110239 | A | 12/2001 |
| KR | 1020050060368 | A | 6/2005 |
| KR | 200400315 | Y1 | 11/2005 |
| KR | 20-0410530 | Y1 | 3/2006 |
| KR | 10-0921839 | B1 | 10/2009 |
| SU | 1405865 | A1 | 6/1988 |
| TW | 247446 | | 5/1995 |
| TW | 266104 | | 12/1995 |
| WO | 93/01870 | A1 | 2/1993 |
| WO | 97/18865 | A1 | 5/1997 |
| WO | 02/40116 | A1 | 5/2002 |
| WO | 03/092831 | A1 | 11/2003 |
| WO | 2004/105901 | A1 | 12/2004 |
| WO | 2007/117092 | A1 | 10/2007 |
| WO | 2007/127554 | A2 | 11/2007 |
| WO | 2007/139356 | A1 | 12/2007 |
| WO | 2009/100722 | A1 | 8/2009 |
| WO | 2010/019627 | A1 | 2/2010 |

OTHER PUBLICATIONS

Extended European Search Report received for EP Patent Application No. 07784574.1, mailed on Apr. 27, 2011, 8 pages.

International Preliminary Report on Patentability received for PCT Patent Application No. PCT/US2007/64672, issued on Oct. 28, 2008, 6 pages.

International Preliminary Report on Patentability received for PCT Patent Application No. PCT/US2009/053489, issued on Feb. 15, 2011, 7 pages.

International Search Report and Written Opinion received for PCT Patent Application No. PCT/US2009/053489, mailed on Sep. 29, 2009, 7 pages.

International Search Report and Written Opinion received for U.S. Patent Application No. PCT/US2007/64672, mailed on Jun. 3, 2008, 6 pages.

Notice of Observations by a Third Party received for EP Patent Application No. 07784574.1, mailed on Jan. 25, 2011, 7 Pages.

"The Wave Streetsurfing Board Support", Document retrieved on Mar. 8, 2007 from the website: http://www.streetsurfing.com/wave/skating.html.

Non Final Office Action received for U.S. Appl. No. 11/462,027, mailed on Sep. 28, 2007, 8 pages.

Notice of Allowance received for U.S. Appl. No. 11/462,027, mailed on Dec. 20, 2007, 12 pages.

Non-Final OA received for U.S. Appl. No. 11/687,594, mailed on Mar. 11, 2009, 21 pages.

Non-Final OA received for U.S. Appl. No. 11/687,594, mailed on Sep. 8, 2009, 6 pages.

Notice of Allowance received for U.S. Appl. No. 11/687,594, mailed on Mar. 22, 2010, 4 pages.

Notice of Allowance received for U.S. Appl. No. 12/820,788, mailed on Oct. 14, 2010, 7 pages.

Office action received for Chinese Patent Application No. 200780000061.6, mailed on Jan. 8, 2010, 14 pages of English translation only.

Office action received for Chinese patent Application No. 200780000061.6, mailed on Nov. 10, 2011, 42 pages including 19 pages of English translation.

Office Action received for Chinese Patent Application No. 200780000061.6, mailed on Feb. 22, 2012, 18 pages including 12 pages of English translation.

Office Action received for Australian Patent Application No. 2008201185, mailed on Nov. 9, 2011, 4 pages.

Office Action received for Japanese Patent Application No. 2008-513847, mailed on Aug. 4, 2010, 6 pages including 3 pages of English translation.

Office Action received for Japanese Patent Application No. 2008-513849, mailed on Apr. 6, 2011, 5 pages including 2 pages of English translation.

Notice of Allowance received for Japanese Patent Application No. 2011-221795, mailed on May 30, 2012, 2 pages including 1 page of English translation.

* cited by examiner

ONE PIECE FLEXIBLE SKATEBOARD

RELATED APPLICATIONS

This application claims the priority of the filing date of U.S. Provisional application Ser. No. 60/087,970 filed Aug. 11, 2008 and Ser. No. 61/118,345 filed Nov. 26, 2008 and is a continuation in part of U.S. patent application Ser. No. 11/687,594 filed Mar. 6, 2007, which is a continuation in part of U.S. patent application Ser. No. 11/462,027 filed Aug. 2, 2006, now U.S. Pat. No. 7,338,056 which claims the priority of the filing date of U.S. Provisional application Ser. No. 60/795,735, filed Apr. 28, 2006.

BACKGROUND OF THE INVENTION

1. Field of the Invention

This invention is related to skateboards such as skateboards in which one end of the skateboard may be twisted or rotated, with respect to the other end, by the user and in particular to skateboards with wheel centering springs.

2. Description of the Prior Art

Various skateboard designs have been available for many years. Conventional designs typically require the user to lift one foot from the skateboard to push off on the ground in order to provide propulsion. Such conventional skateboards may be steered by tilting the skateboard to one side and may be considered to be non-flexible skateboards. Skateboards have been developed in which a front platform and a rear platform are spaced apart and interconnected with a torsion bar or other element which permits the front or rear platform to be twisted or rotated with respect to the other platform. Such platforms have limitations, including complexity, limited control or configurability of flexure and cost. What is needed is a new skateboard design without such limitations.

SUMMARY OF THE DISCLOSURE

A skateboard is disclosed including a one piece flexible skateboard platform having first and second foot support areas aligned along a longitudinal axis, a pair of wheel assemblies, each including a bearing having inner and outer bearing races, a wheel housing supporting at least one wheel for rotation about a rotational axis, the wheel housing secured to the outer bearing race for steering rotation therewith respect to the inner bearing race about a pivot axis at the acute angle, a pair of fixed stops securing the inner race of said at least one of the wheel housing to the platform at an acute angle, and at least one limit stop mounted for rotation with said at least one of the wheel housings for preventing steering rotation of that wheel housing beyond a present limit by interaction with one of the pair fixed stops.

Each of the pair of wheel assemblies may include a pair of fixed stops securing the inner race of the bearing in that wheel assembly to the platform at an acute angle. A bearing cap may be included on which the pair of fixed stops are mounted. The bearing cap may have a peripheral tool surface at least partway around an edge of the bearing cap for use in securing the bearing cap, wherein said pair of fixed stops are portions of said bearing cap edge. The fixed stops and the limit stop may include contact areas which are at a first radius from said pivot axis. A rod at least partially externally threaded rod at one end having a peripheral tool surface for use in securing the partially externally threaded end of the rod to the skateboard platform may be included and the rod may have an internal threaded opening at second end for mounting the wheel assembly thereto.

At least one or both of said wheel housings may include a common wheel axle aligned with said rotational axis and a pair of wheels mounted on said common axis for rotation. The one piece flexible skateboard may include a central area rigidly mounted to both the first and second foot support areas so that the skateboard flexes as a single unit. The central area may include a plurality of longitudinal elements generally aligned with the longitudinal axis mounted to both the first and second foot support areas so that the skateboard flexes as a single unit and/or plurality of structural elements rigidly mounted to each of the plurality of longitudinal elements to resist bowing of the skateboard from a user's weight.

The plurality of longitudinal structural elements may each rigidly fastened to each of the plurality of longitudinal elements. The longitudinal elements may have a surface generally common with surfaces of the first and second foot support areas. One of the longitudinal elements may bowed in a downward direction between the foot support areas to further resist bowing of the skateboard from the user's weight.

The central area may flex more than the first and second foot support areas when a user twists the foot support areas in opposition directions about the longitudinal axis. Twisting of the foot support areas in opposite directions by the user may cause rotation of the wheels in the same direction to move the skateboard in that direction and may move the skateboard from a standing start.

A flexible skateboard is disclosed having a one piece platform formed of a material twistable along a twist axis, the material formed to include a pair of foot support areas along the twist axis, generally at each end of the platform, to support a user's feet and a central section between the foot support areas and a pair of caster assemblies, each having a single caster wheel mounted for rolling rotation, each caster assembly mounted at a user foot support area for steering rotation about one of a pair of generally parallel pivot axes each forming a first acute angle with the twist axis. The central section of the platform material may be configured to be sufficiently narrower than the foot support areas to permit the user to add energy to the rolling rotation of the caster wheels by twisting the platform alternately in a first direction and then in a second direction while the foot support areas.

A multi-arm spring assembly is provided to cause each caster wheel to return to a neutral steering, straight ahead position when steering forces are removed, for example when the wheel becomes airborne. Each spring arm works against a stop which pivots with the wheel and a stop which does not pivot with the wheel.

DETAILED DISCLOSURE OF THE PREFERRED EMBODIMENT(S)

Figure 1:
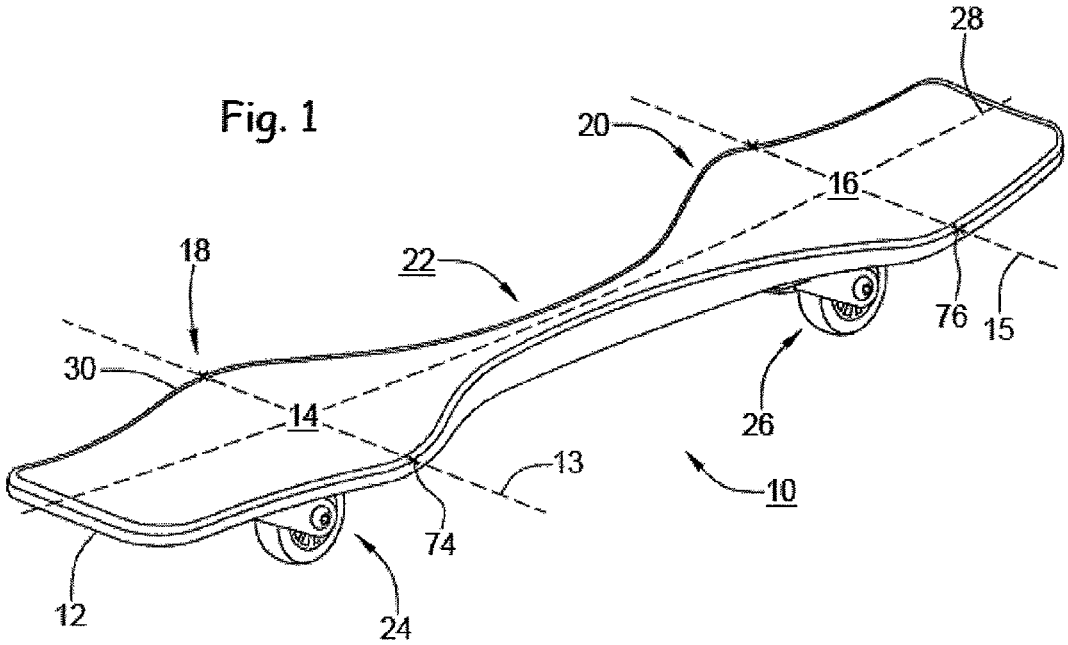
FIG. 1 is an isometric view of the top of one piece flexible skateboard 10.

Referring now to FIG. 1, flexible skateboard 10 is preferably fabricated from a one piece, molded plastic platform 12 which includes foot support areas 14 and 16 for supporting the user's feet about a pair of directional caster assemblies mounted for pivoting or steering rotation about generally parallel, trailing axes. Each caster assembly includes a single caster wheel mounted for rolling rotation about an axles positioned generally below the foot support areas. Skateboard 10 generally includes relatively wider front and rear areas 18 and 20, each including one of the foot support areas 14 and 16, and a relatively narrower central area 22. The ratio of the widths of wider areas 18 and 20 to narrow central area 22 may preferably be on the order of about 6 to 1. Wheel assemblies 24 and 26 are mounted below one piece platform 12 generally below foot support areas 14 and 16.

In operation, the skateboard rider or user places his feet generally on foot support areas 14 and 16 of one piece platform 12 and can ride or operate skateboard 10 in a conventional manner, that is as a conventional non-flexible skateboard, by lifting one foot from board 10 and pushing off against the ground. The user may rotate his body, shift his weight and/or foot positions to control the motion of the skateboard. For example, board 10 may be operated as a conventional, non-flexible skateboard and cause steering by tilting one side of the board toward the ground. In addition, in a preferred embodiment, board 10 may also be operated as a flexible skateboard in that the user may cause, maintain or increase locomotion of skateboard 10 by causing front and rear areas 18 and 20 to be twisted or rotated relative to each other generally about upper platform long or twist axis 28.

It is believed by applicants that the relative rotation of different portions of platform 12 about axis 28 changes the angle at which the weight of the rider is applied to each of the wheel assemblies 24 and 26 and therefore causes these wheel assemblies to tend to steer about their pivot axes. This tendency to steer may be used by the rider to add energy to the rolling motion of each caster wheel about its rolling axle and/or to steer.

As a simple example, if the user or rider maintained the position of his rearward foot (relative to the intended direction of motion of board 10) on foot support area 16, generally along axis 15 and parallel to the ground, while maintaining his front foot in contact with support area 14, generally along axis 13 while lowering, for example, the ball of his front foot and/or lifting the heal of that foot, front section 18 of board 10 would tend to twist clockwise relative to rear section 20 when viewed from the rear of board 10. This twist would result in the tilting right front side 30 of board 10 in one direction, causing the weight of the rider to be applied to wheel assembly 24 at an acute angle relative to the ground rather than to be applied orthogonal to the ground, and would therefore cause wheel assemblies 24 and 26 to begin to roll, maintain a previous rolling motion and/or increase the speed of motion of the board 10 e.g. by adding energy to the rolling motion of the wheels.

In practice, the rider can cause the desired twist of platform 12 of board 10 in several ways which may be used in combination, for example, by twisting or rotating his body, applying pressure with the toe of one foot while applying pressure with the heel of the other foot, by changing foot positions and/or by otherwise shifting his weight. To provide substantial locomotion, the rider can first cause a twist along axis 28 in a first direction and then reverse his operation and cause the platform to rotate back through a neutral position and then into a twist position in the opposite direction. Further, while moving forward, the rider can use the same types to motion, but at differing degrees, to control the twisting to steer the motion of board 10. The ride can, of course, apply forces equally with both feet to operate board 10 without substantial flexure.

Wider sections 18 and 20 have an inherently greater resistance to twisting about axis 28 than narrower section 22 because of the increased stiffness due to the greater surface area of the portions to be twisted. That is, narrower section 22 is narrower than wider sections 18 and 20. The resistance of the various sections of platform 12 to twisting can also be controlled in part by the choice of the materials, such as plastic, used to form platform 12, the widths and thicknesses of the various sections, the curvature if any of platform 12 along axis 28 or along any other axes and/or the structure and/or cross section shape of the various sections.

Figure 2:
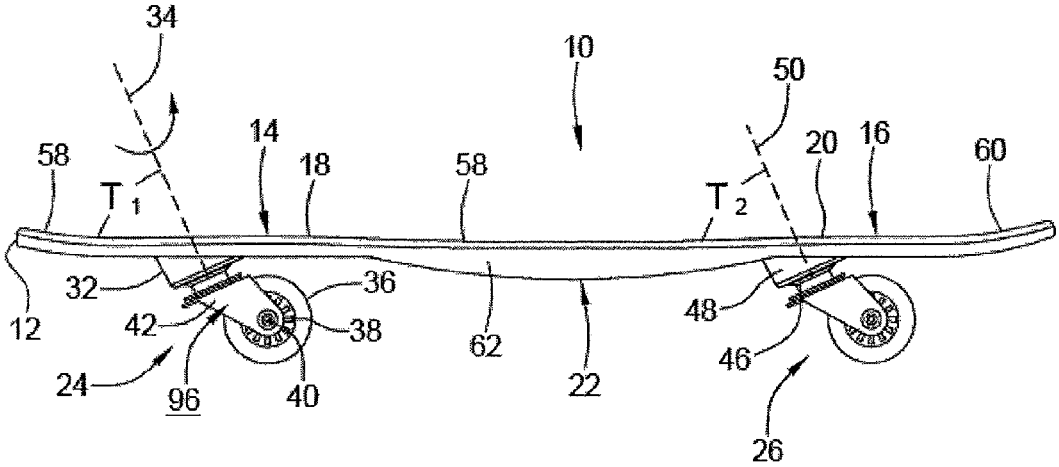
FIG. 2 is a side view of skate board 10.

Referring now to FIG. 2, skateboard 10 may include sidewalls 62 and/or other structures. Sidewalls 62 may be increased in height, e.g. orthogonal to the top surface 58 of platform 12, in the central portion of central area 22 to provide better vertical support if required. In a preferred embodiment, the height of sidewall 62 in central area 22 varies from relatively tall in the center of board 10 to relatively shorter beginning where areas 18 and 20 meet central area 22. The ratio of the sidewall height "H" in central section 22, to the side wall heights in wider areas 18 and 20 may preferably be on the order of about 2 to 1.

As shown in FIG. 2, wheel assemblies 24 and 26 may be substantially similar. Wheel assembly 24 may be mounted—for rotation about axis 34—to an inclined or wedge shape wheel assembly section 32 by securing pivot axle or shaft 41 (visible in FIG. 4) in a suitable opening in wedge 32. The rotation of wheel assembly 24 about axis 34 may preferably be limited, for example, within a range of about ±180°, and more preferably within a range of about ±160°, to improve the handling and control of board 10. Each direction caster may include a tension, compression or torsional spring to provide self-centering, that is, to maintain the alignment of wheels 36 along axis 28 (visible in FIG. 1) as shown and described for example with reference to FIG. 13 below.

A pair of wedges 32 and 48 may be formed in platform 12 and include a hole for wheel assembly axle 41 mounted along axis 34. Alternately, wedges 32 and 48 may be formed as separate pieces from platform 12 and be connected thereto during manufacture of board 10 by for example screws, clips or a snap in arrangement in which the upper surfaces of wedges 32 and 48 are captured by an appropriate receiving section molded into the lower face of platform 12. Wedge 32 may be used to incline axis 34, about which each caster may pivot or turn, with respect to the upper surface 58 of platform 12 at an acute angle θ1 which may preferably be an angle of about 24°.

Wheel assembly 24 may include wheel 36 mounted on hub 38 which is mounted to axle 40 for rotation, preferably in bearings. Axle 40 is mounted in fork 96 of caster frame 42. A bearing or bearing surface may preferably be inserted between caster frame 42 and wedge 32, or formed on caster frame 42 and/or wedge 32 and is shown as bearing 46 in wheel assembly 26 mounted transverse to axis 50 in wedge 48 in rearmost wider section 20. Wheel assemblies 24 and 26 are mounted along axes 34 and 50 each of which form an acute angle, θ1 and θ2 respectively, with the upper surface of platform 12. In a preferred embodiment, θ1 and θ2 may be substantially equal. The use of identical wheel assemblies for front and rear reduces manufacturing and related costs for board 10. The center of foot support 14 may conveniently be positioned directly above axis 40 in wheel assembly 24 and center of foot support 16 may be positioned similarly above the axis of rotation of the wheel in wheel assembly 26.

During operation, users may shift their feet from foot positions 14 and 16 toward central area 22 which as described above is a narrower and therefore more easily twisted portion of platform 12. In order to provide addition vertical strength to support the weight of one of the user's feet, taller sidewalls 62 may be used in central section 22 as shown. In a preferred embodiment, the height of sidewalls 62 may generally rise in a gently curved shape from wider support areas 18 and 20 to a maximum generally in the center of central section 22.

Platform 12 of board 10 is in a generally horizontal rest or neutral position, e.g. in neutral plane 17, when no twisting force is applied to platform 12 of board 10. This occurs, for example, when the rider is not standing on board 10 or is standing in a neutral position. When board 10 is in the neutral position, axes 34 and 50, angles θ1 and θ2 and board axis 28 (shown in FIG. 1) are all generally in the same plane orthogonal to neutral plane 17 of the top of platform 12, while axes 13 and 15 are in neutral plane 17. Upper surface 58 may not be flat and in a preferred embodiment, toe or leading end 60 and heel or trailing end 62 of surface 58 may have a slight upward bend or kick as shown. In a preferred embodiment, central section 22 flares out at each end to wider sections 18 and 20 while wider front section 18 may be slightly longer than rear section 20. When a twisting force is applied to board 10, one or more of axes 34 and 50 move out of the vertical plane as described below in greater detail with respect to FIG. 5.

Figure 3:
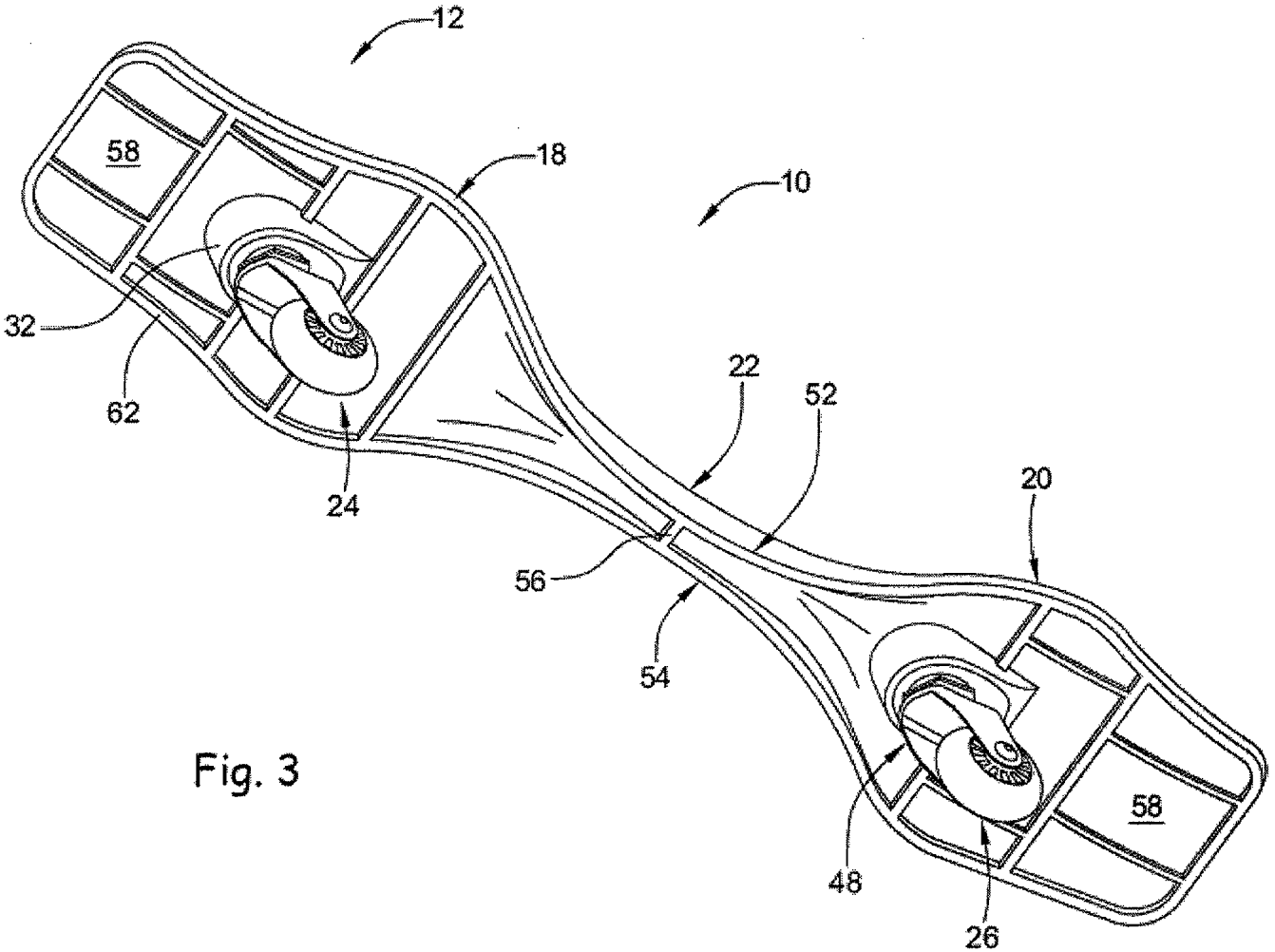
FIG. 3 is an isometric view of the bottom of one piece flexible skateboard 10.

Referring now to FIG. 3, an isometric view of the bottom of skate board 10 is shown including platform 12, wider sections 18 and 20 and narrower or midsection 22. Wheel assemblies 24 and 26 are mounted to inclined wedges 32 and 48 which are shown as molded-in portions of platform 12. Platform 12 may include a generally flat upper surface 58, (also shown in FIG. 2) as well as a wall portion 62 formed generally at a right angle to layer 58. Peripheral sidewall 62 may have a constant cross sectional width, "w", but in a preferred embodiment the height "H" of wall 62 (also shown in FIG. 2) may vary for example to increase generally in midsection 22 in order to provide additional vertical support for the user when and if the user place some of his weight on midsection 22. The sections of sidewall 62 with increased height in midsection 22 are shown as starboard wall section 54 and port wall section 52. Wall sections 52 and 54 may also have transverse wall members, such as full or partial cross brace or rib 56, which serve to both provide additional vertical support if needed and to increase the resistance to twisting of various portions of board 10 about axis 28.

Figure 4:
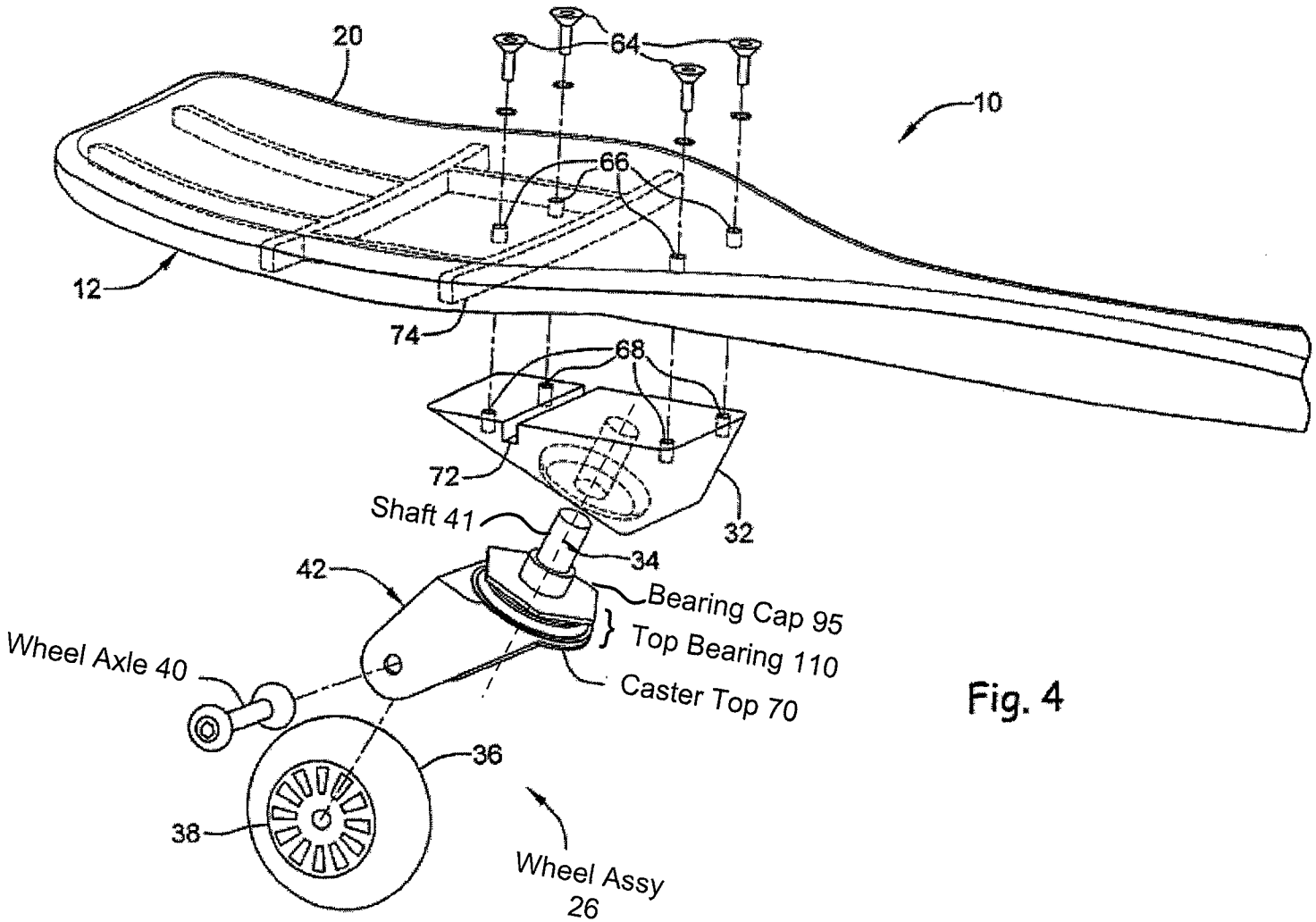
FIG. 4 is an isometric view of a portion of the bottom of board illustrating a removably mounted wedge 32.

Referring now to FIG. 4, an exploded isometric view of rear section 20 of an alternate embodiment of board 10 is shown in which each inclined wedge 32 is formed as a separate piece from platform 12 and mounted thereto by any convenient means such as screws 64 which may be inserted through holes 66 in appropriate locations in platform 12 to mate with holes 68 in inclined wedge 32. Screws 64 may be self threading or otherwise secured to wedge 32. Frame 42 of wheel assembly 26 includes caster top 70 and bearing cap 95 forming top bearing 110, shown below in greater detail in FIG. 13, and pivot axle 41—a top portion of which is received by and mounted in a suitable opening in wedge 32—to support the rotation of wheel assembly 26 about axis 34. Axle 40 is mounted in fork 96 of frame 42. Wheel 36 is mounted on hub 38 which is mounted for rotation about axle 40.

Wedge 32 may also be further secured to platform 12 by the action of slot 72 which captures a feature of the bottom surface of platform 12 such as transverse rib 74. As shown, wedge 32 may be conveniently mounted to and dismounted from platform 12 permitting replacement of wedge 32 by other wedges with potentially different configurations including different angles of alignment for axis 34 and/or other characteristics.

Figure 5:
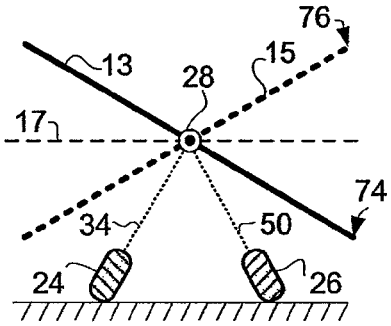
FIG. 5 is a graphical illustration of a skateboard twisting in a first direction.

Referring now to FIG. 5, a graphical depiction of the motions of portions of platform 12 are shown. Neutral plane 17 is shown in the horizontal position indicating top surface 58 of platform 12 when no twisting forces are applied to skate board 10. Axis 28, along the centerline of top surface 58 of platform 12, is shown orthogonal to the drawing, coplanar with and centered in neutral plane 17. Axis 13 is shown as a solid line and represents the location of a cross section of the top surface of platform 12 at front foot position 14 in wide forward section 18 when the port side of wide section 18 is depressed below the horizontal or neutral plane 17 for example by the user pressing down on the port side and/or lifting up of the starboard side of foot position 14. Axis 15 is shown as a dotted line, to distinguish it from axis 13 for convenience, and represents the location of a cross section of the top surface of platform 12 at rear foot position 16 in wide aft section 20 of platform 12 when the starboard side of wide section 20 is depressed below the horizontal or neutral plane 17 for example by the user pressing down on the starboard side and/or lifting up of the port side of rear foot position 16. Thus FIG. 5 represents the relative angles of wider front and rear sections 18 and 20 of platform 12 when the user has completed a maneuver in which he has twisted wider front and rear sections 18 and 20 in opposite directions to a maximum rotation.

Wheel assembly 24 is shown mounted for rotation about axis 34. Axis 34 of front wheel assembly 24 remains orthogonal to axis 13 of foot position 14. Similarly, wheel assembly 26 is shown mounted along axis 50. Axis 50 of rear wheel assembly 26 remains orthogonal to axis 15 of foot position 16. For ease of illustration, wheel assemblies 24 and 26 are depicted in cross section without rotation of the wheel assemblies about axes 34 and 50.

In the position shown in FIG. 5, wheel assemblies 24 and 26 have presumably been rotated from vertical positions to the opposite outward positions by action of the user in twisting board 10. It must be noted that front and rear wheel assemblies 24 and 26 are able to rotate or pivot about their respective axes 34 and 50. During the twisting of board 10, wheel assemblies 24 and 26 rotate about the central axes of the wheels as long as such rotation takes less force than would be required to skid the wheel assemblies into the positions as shown. The direction of this rotation is not random, but rather controlled by angles θ1 and θ2 between axes 34 and 50 and platform 12.

The view shown in FIG. 5 is looking at the front of board 10 so that axes 34 and 50 are at right angles to one of the portions of platform 12. A side view of the board 10, as shown for example in FIG. 2, illustrates that each wheel assembly is mounted for pivotal rotation about an axis at an acute trailing angle to platform 12. The rotation of the wheels about each wheel axis of the wheel assemblies, combined with a slight rotation of each wheel assembly about its axis 34 or 50 when the ends of board 10 are twisted in opposite directions, causes, maintains or increases forward motion or locomotion of board 10 because axes 34 and 50 are inclined so that each wheel assembly is in a trailing configuration, aft of the point at which each axis penetrates board 12 from below. That is, axes 34 and 50 about which each wheel assembly turns are both inclined in the same direction, preferably at a trailing angle with respect to the direction of travel and are preferably parallel or nearly so.

Figure 6:
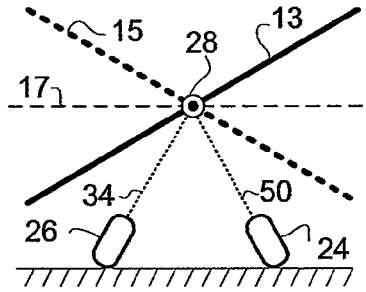
FIG. 6 is a graphical illustration of a skateboard twisting in a second direction.

Referring now to FIG. 6, axes 13 and 15 are shown in the opposite positions than shown in FIG. 5, which would result from the user reversing his foot rotation, i.e. by twisting the front and rear sections of board 10 by pushing down and/or lifting up opposite of the way done to cause the twisting shown in FIG. 5. However, the combination of the rotation of the wheels and the rotation of the wheel assemblies adds to the forward locomotion because axes 34 and 50 are in a trailing position relative to the forward motion of board 10.

Figure 7:
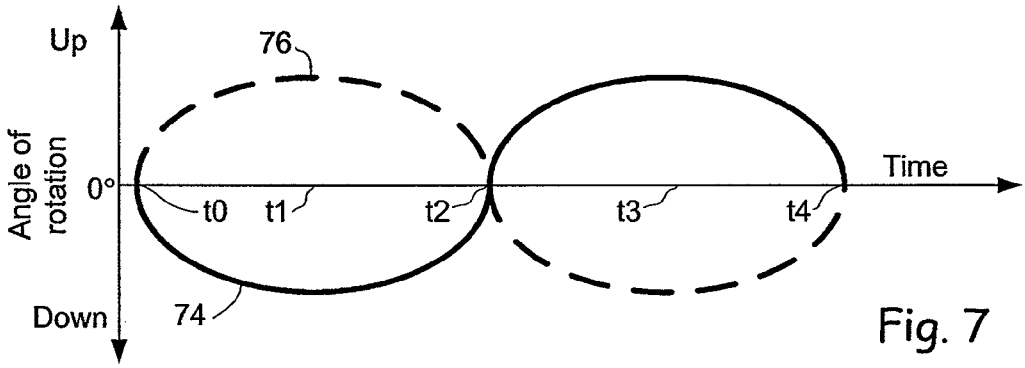
FIG. 7 is a graphical illustration of the twisting of board 10 having a first configuration.

Referring now to FIG. 7, the solid line is a graphical representation of the twisting rotation as a function of time of point 74 (shown in FIGS. 1 and 5) at a forward port side edge of wide section 18 during the twisting motions occurring to board 10 as depicted in FIGS. 5 and 6. Point 74 may be considered to be the point at which axis 13 intersects the port side edge of platform 12. At some instant of time, such as t0, point 74 is at zero rotation. As the port side of forward wide section 18 is rotated downward by force applied by the user, point 74 rotates downward until the maximum force is applied by the user and point 74 reaches a maximum downward rotation at some particular time such as time t1. Thereafter, as the downward force applied by the user to the portside of forward section 18 decreases, the downward angle of rotation of point 74 decreases until at some time t2, point 74 returns to a neutral rotational position at a rotational angle of 0.

Thereafter, downward pressure can be applied by the user to the starboard edge of section 18, e.g. in foot position 14, to cause point 74 on the port side to twist or rotate upwards, reaching a maximum force and therefore maximum rotation at time t3 after which the force may be continuously reduced until neutral or zero rotation is reached at time t4. Similarly, as shown by the solid line in FIG. 7, the user can apply forces in the opposite direction to rearward wide section 20 so that point 76, at the rearward port side of foot position 16, rotates from the neutral position at time t0, to a maximum upward rotation at time t1, through neutral at time t2, to a maximum downward rotation at time t3 and back to neutral at time t4.

Figure 8:
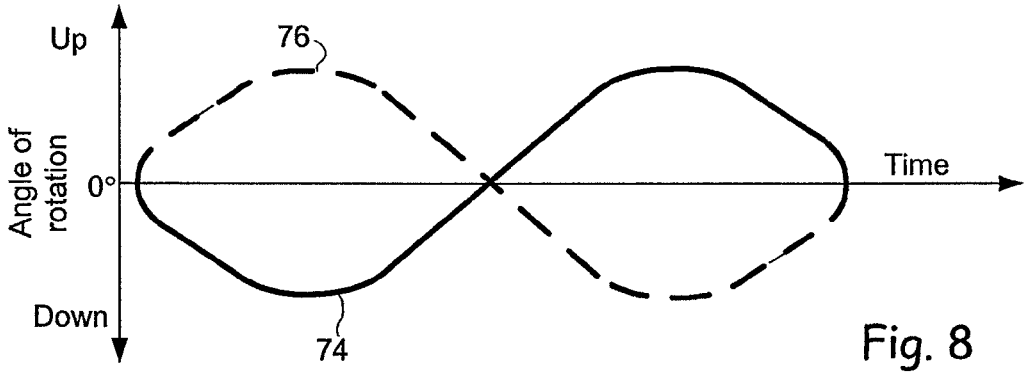
FIG. 8 is a graphical representation of the twisting of board 10 having a second configuration to provide a different flexing function in response to applied twisting forces.

Referring now to FIG. 8, the amount of force that must be applied by the user to cause a particular degree of twist may correlate to the amount of control the user has with board 10.

It may be desirable for the relationship between force and rotation to be varied as a function of rotation or force. For example, in order to achieve a "stiff" board while permitting a large range of total twist without requiring undo force, the shape of platform 12 may be configured so that the amount of force required to twist the board from the neutral plane seems relatively high to the user (at least high enough to be felt as feedback) even if the additional force required to continue rotating each section of the board past a certain degree of rotation seems relatively easier to the user. Further, as an added safety and control measure, the additional force required to achieve maximum rotation may then appear to the user to increase greatly. As shown in FIG. 8, the shape of the graphs of the rotation of points 74 and 76, for the same forces applied as function of time used to create the graph in FIG. 7, may be different providing a different feel to the user.

Figure 9:
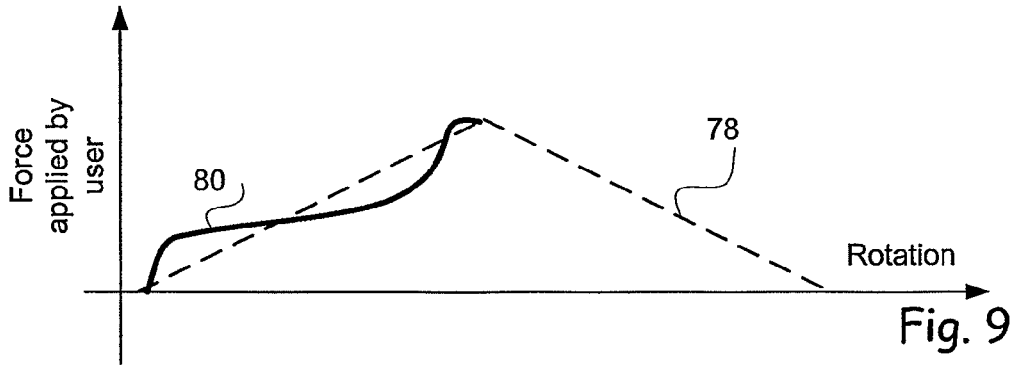
FIG. 9 is a graphic representation of the force applied to a one piece flexible skateboard as a function or twist or rotation of the board.

Referring now to FIG. 9, the concept just discussed above may be viewed in terms of a graph of force applied by the user as a function of desired rotation. The control feel desired for a skate board is not necessarily an easily described mathematical function of force to rotation. For some particular configuration of platform 12, with specific shapes and relationships between the front and rear wide areas and the central narrow area, and specific shapes and sizes of sidewalls, ribs, surface curves and other factors, there will be a particular way in which the board feels to the user to behave. That is, the feel of the board and especially the user's apparent control of the board, in preferred embodiments, is dependent on the shape and other board configuration parameters. For simplicity of this description, one particular board configuration may be said to have a "linear" feel, that is, the user's interaction with the board may seem to the user to result in a linear relationship between force applied and rotation or twist achieved. In practice, this feel is very subjective but none the less real although the actual mathematical relationship may not be linear. As a relative example, line 78 may represent a linear or other type of board having a first configuration of platform 12.

The shape and configuration of platform 12 may be adjusted, for example, by reducing the length of narrow section 22 along axis 28 (shown and described for example with reference to FIG. 1) and/or changing the taper of the transitions areas between narrow section 22 and front and rear wide sections 18 and 20. For a particular configuration of platform 12, lengthening the relative length of narrow section 22 may result in a perceived sloppiness of control by the user while shortening the relative length of narrow section 22 may result in a greater difficulty in achieving any rotation at all. A similar effect may be obtained by adjusting the width of central section 22 relative to wider sections 18 and 20. Line 80 represents a desired control relationship between force required and angle achieved by a particular configuration of platform 12. A more detailed example of twist as a function of force applied is shown below in FIGS. 14A and 14B and described for example with respect to FIGS. 14-19.

It is important to note that one advantage of the use of one piece platform 12 made of a plastic, twistable material formed in a molding process, is that the desired feel or control of the board can be achieved by reconfiguration of the mold for the one piece platform. Although it may be difficult to predict (with mathematical precision), the shape and configuration of platform 12 needed to achieve a desired feel, it is possible to iteratively change the shape and configuration of platform 12 by modifying the mold in order to develop a desirable configuration with an appropriate feel. In particular, the relationship between force applied and twist or rotation achieved by flexible skate board 10 is function of the relative widths, shapes and other configuration details of platform 12.

Platform 12 may be molded or otherwise fabricated from flexible PU-type elastomer materials, nylon or other rigid plastics and can be reinforced with fiber to further control flexibility and feel.

Figure 10:
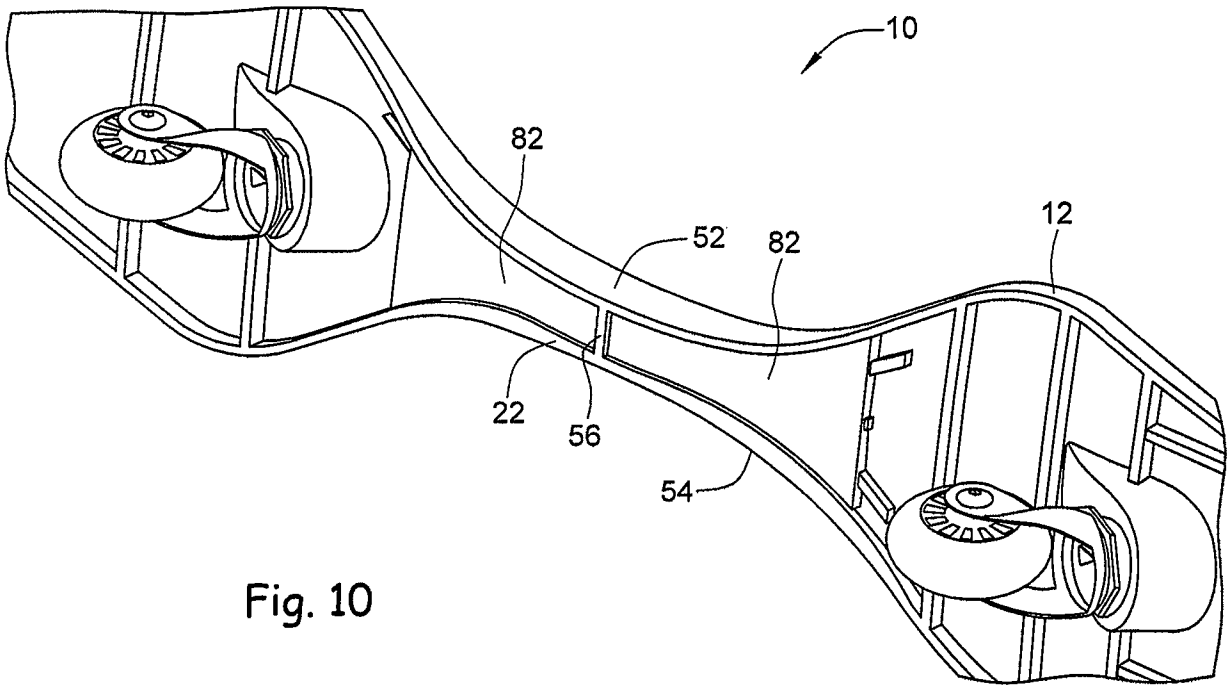
FIG. 10 is an isometric view of a portion of the underside of board 10 including removably installed elastomeric wedges 82 used to adjust the board flexing function.

Referring now to FIG. 10, an isometric view of a portion of the underside of one piece platform 12 is shown in which one or more wedges 82 are positioned within and between sidewalls 52 and 54 and transverse rib 56. Wedges 82 may preferably be made of an elastomeric material and serve to reduce the twisting flexibility narrow section 22 of platform 12 by, for example, resisting twisting motion of side walls 52 and 54. In a preferred embodiment, wedges 82 may be removably secured to the bottom side of one piece platform 12 by tightly fitting between the sidewalls or by use of screws or clips. The addition or removal of wedges 82 changes the flexure characteristics of platform 12 and therefore the feel or controllability of board 10. For example, wedges 82 may be added for use by a beginning user and later removed for greater control of board 10.

Figure 11:
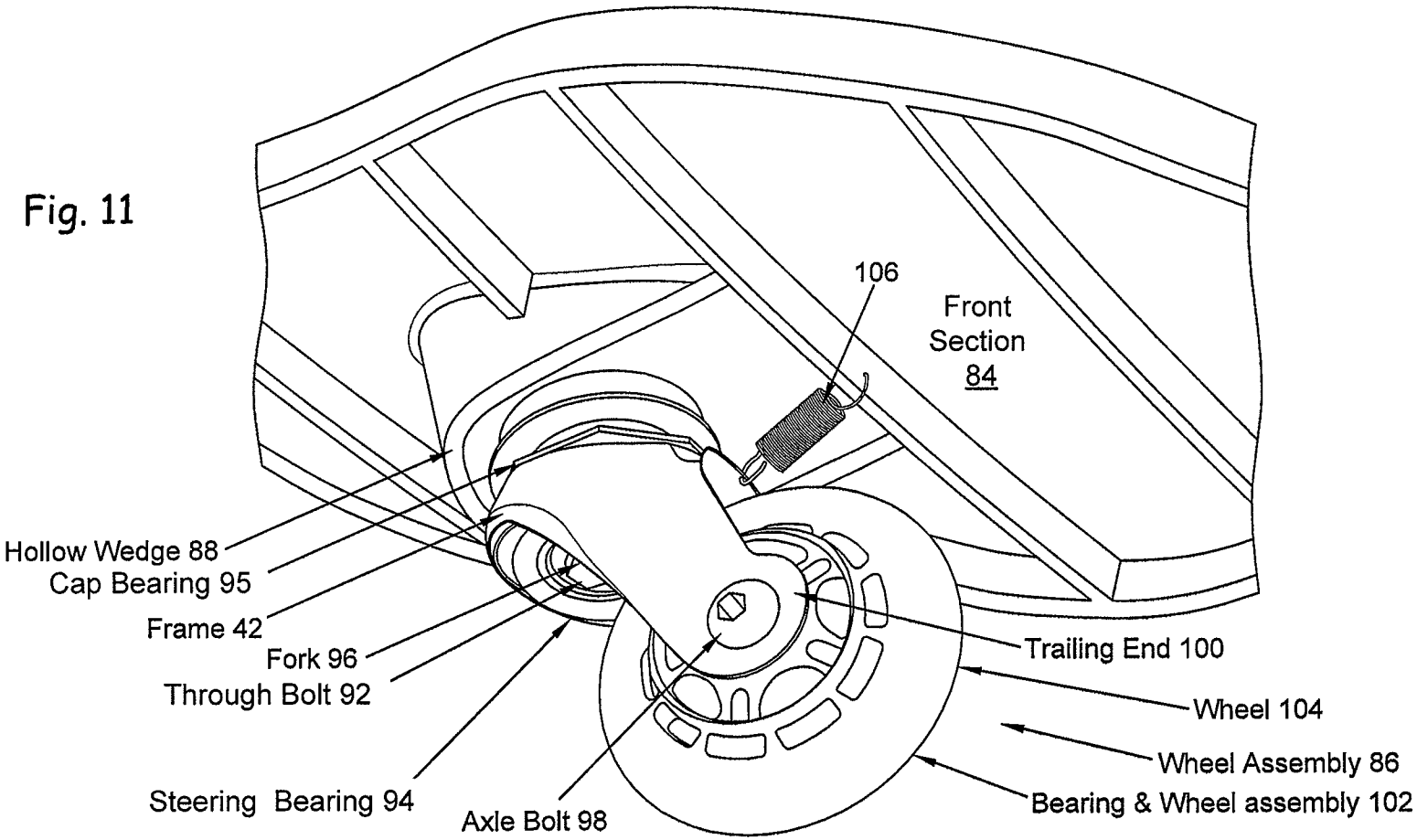
FIG. 11 is a partial view of a self centering front section 84 of board 10.

Referring now to FIG. 11, a partial view of self centering front section 84, of one piece flexible board 10, in which caster wheel assembly 86 is mounted to hollow wedge 88 formed underneath front foot support 90 of board 10. Through bolt 92, only the head of which is visible in this figure, may be positioned through the inner race of wheel assembly steering bearing 94, top or cap bearing 95 and the lower surface of wedge 88 and captured with a nut, not visible here, accessible from the top of platform 12 of board 10 in the hollow volume of wedge 88. The outer race of bearing 94 is affixed to fork 96 of caster wheel assembly 86, which is mounted by bearing 94 for rotation with respect to top bearing 95, so that wheel assembly 86 can swivel or turn about the central axis (shown as turning axis 34 in FIG. 2) of through bolt 92 which serves as pivot axis 34 with respect to the fixed portions of board 10. Axle bolt 98 is mounted through trailing end 100 of fork 96 to support bearing and wheel assembly 102 for rotation of wheel 104.

In a preferred embodiment, a spring action device may be mounted between caster wheel assembly and some fixed portion of platform 12 (or of a portion of a caster assembly fixed thereto) to control the turning of fork 96 and therefore caster wheel assembly 86 about turning axis 34 to add resistance to pivoting or turning as a function of the angle of turn and/or preferably make caster wheel assembly self centering. The self centering aspects of caster wheel assembly 86 tends to align wheel 104 with long axis 28 (visible in FIG. 1) when the weight is removed from board 10, for example, during a stunt such as a wheelie. Without the self-centering function of the spring action device, caster wheel assembly 86 may tend to spin about axis 34 through bolt 92 during a wheelie so that caster wheel assembly may not be aligned with the direction of travel of board 10 at the end of the wheelie when wheel 104 makes contact with the ground. The self centering function of caster wheel assembly 86 improves the feel and handling of board 10, especially during maneuvers and stunts, by tending to align wheel 104 with the direction of travel when wheel 104 is not in contact with the ground. The spring action device may be configured to ad or not add appreciable resistance to maneuvers such as locomotion or turning when wheel 104 is in contact with the ground, depending on the desired relationship between forces applied and the resultant twist of platform 12.

As shown in FIG. 11, caster wheel assembly 86 may be made self-centering by adding coil spring 104 between fork 96 (or any other portion of caster wheel assembly 86 which rotates about the axis of bolt 92) and front section 84 of platform 12 (or any other fixed portion of platform 12).

Figure 12:
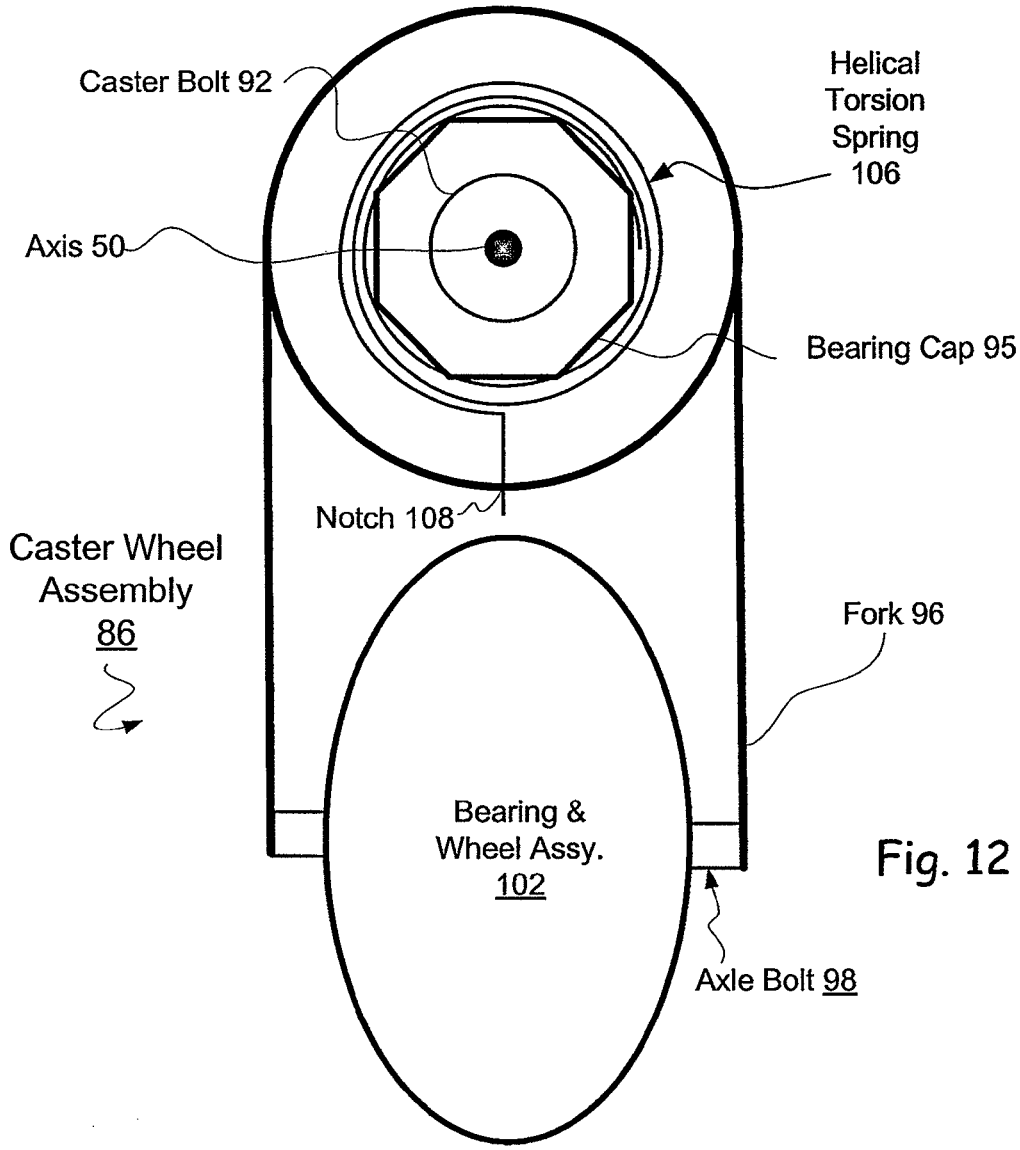
FIG. 12 is a top view of a caster wheel assembly with an external self centering torsion spring.

Referring now to FIG. 12, a partial top view of caster wheel assembly 86 is shown including bearing cap 95 (which is fixedly mounted by bolt 92 to platform 12) and fork 96 (which mounted for rotation about axis 50 through the center of bolt 92). In another preferred embodiment, self-centering of caster assembly 86 may be provided by a torsion spring arrangement, such as helical torsion spring 106. A fixed end of helical torsion spring 106 may be fastened to a fixed part of board 10 such as bearing cap 95 or platform 12, while a movable end of helical torsion spring 106 may be mounted to a portion of caster wheel assembly 86 mounted for rotation about axis 50 by for example fitting in a slot, such as notch 108 in fork 96.

Figure 13:
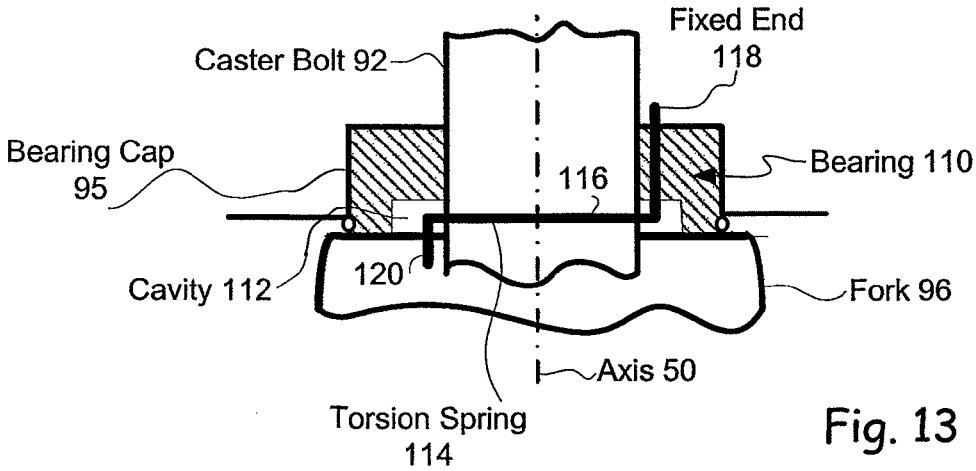
FIG. 13 is a partial side view of a caster wheel assembly with an internal self centering torsion spring.

Referring now to FIG. 13, a partial cross section view of the mounting for rotation about axis 50 through caster bolt 92 of caster fork 96 is shown in which low friction bearing 110 is positioned between bearing cap 95 and the upper surface of fork 96. Low friction bearing 110 may be a solid, such as Teflon, or a liquid, such as a grease for bearing 94, or a combination of both. Further, low friction bearing 110 may merely be an open space or cavity between bearing cap 95 and the top of fork 96 which permits fork 96 to be supported solely by the outer race of bearing 94 (visible in FIG. 11) without contact with bearing cap 95. In any event, an open area such as cavity 112, surrounding bolt 92 and positioned between the top of fork 96 and bearing cap 95, may be provided in which torsion spring 114 may be mounted for causing self-steering of caster wheel assembly 86. In particular, torsion spring 114 may include center section 116, such as a helical coil, a fixed end 118 which may be fixed with regard to rotation about axis 50 by being mounted through cavity 112 for penetration through bearing 110, if present, into bearing cap 95, or into bolt 92. The other end 120 of spring 114 is affixed to a portion of caster wheel assembly 86 which rotates about axis 50 such as fork 96.

Figure 14A:
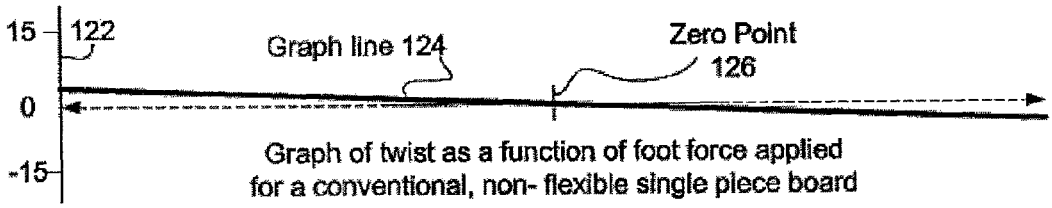
FIGS. 14A and 14B are graphical representations of board twist as a function of differential force or pressure applied by a user.
Figure 14B:
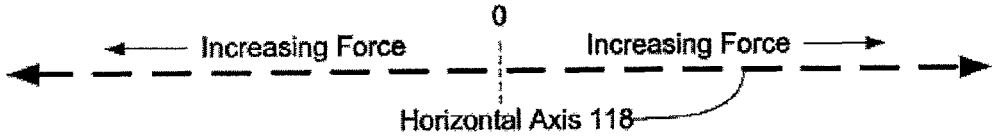
Figure 14B:
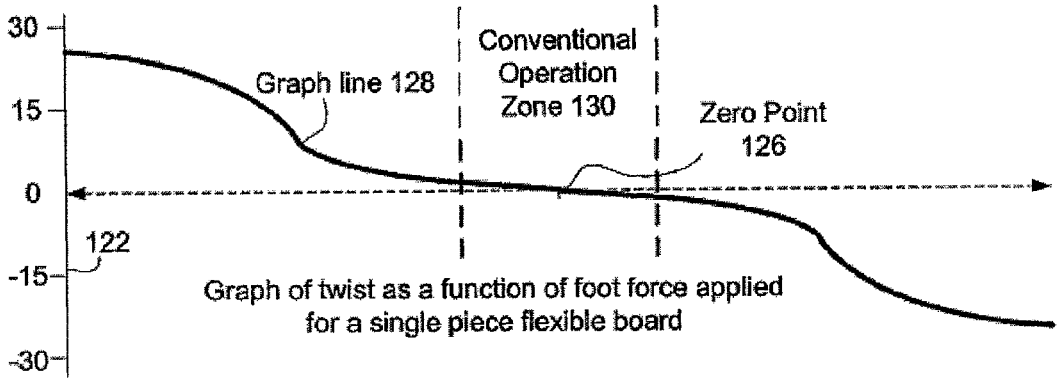
Figure 14C:
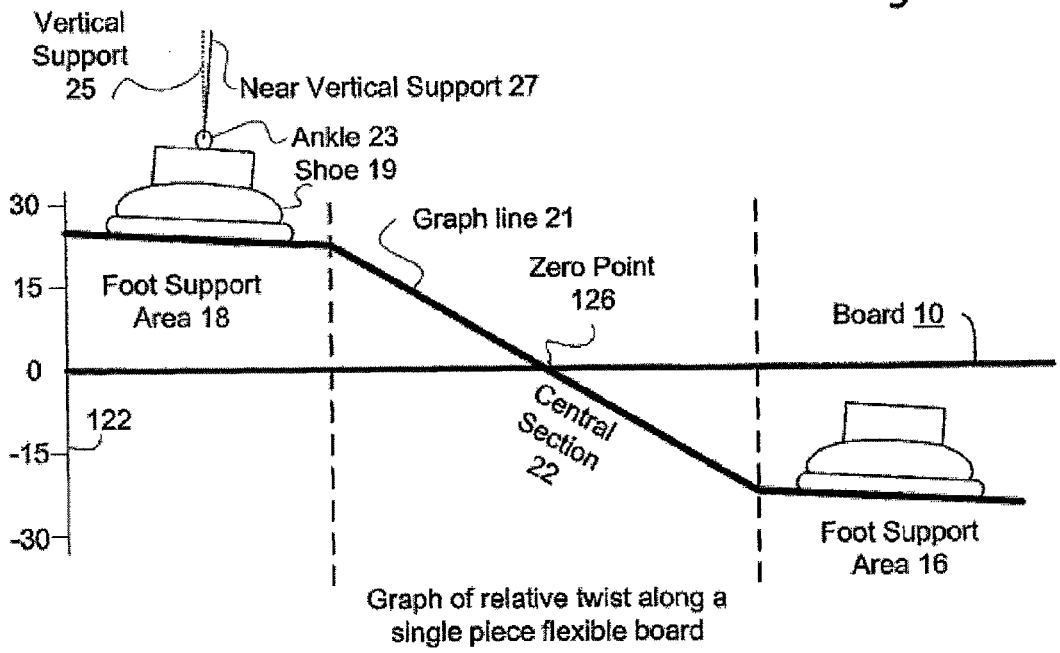
FIG. 14C is a graphical representation of relative twist along the foot support and central areas of the board.

Referring now to FIGS. 14A-C, it is important to note that board 10 with a single piece twistable platform 12 and a self centering spring may also operate differently than board 10 without a self-centering spring. In particular, the self-centering spring may also provide a pivotal rotation dampening or limiting function which improves the feel of the ride. FIGS. 14A and 14B are a pair of graphs illustrating board twisting angle as a function of the force applied by a user to twist platform 12. Horizontal axis 118, shown between FIGS. 14A and 14B, shows increasing force which may be the force that can be applied by a user, in opposite directions, to wider sections 18 and 20 to twist platform 12. Centerline 120 of horizontal axis 118 represents zero force while the outer ends of horizontal axis 118 represent the maximum forces that a user would apply to wider sections 18 and 20 in opposite directions to twist platform 12. Each of the vertical axes 122 of the graphs represent the degrees of twist of platform 12 at the ends of board 10.

Referring now to FIG. 14A, graph line 124 is used to represent the angle of twist of the ends of board 10 as a function of the force applied by the user to a conventional, non-flexible single piece skateboard. At zero point 126, there is no rotational twist even if there is substantial differential force applied by the user's feet because in the center such differential force would be balanced and therefore there would be not twist. With such conventional boards, the user may apply significant differential pressure and there will be no, or very limited, end-to-end twist. The limited flexing of such conventional boards, if any, is shown for example as an end-to-end twist on the order of perhaps about 5° or less. The limited flexure or twisting available with such conventional skateboards may be useful to absorb road bumps and vibrations in order to reduce stress and shock applied to the user's feet. This limited level of twist is not enough to provide substantial locomotion or other advantages of a flexible one piece skateboard as described herein. That is, even if the user were to complete several cycles of applying differential force or pressure in a first sense (e.g. clockwise) and then in the opposite sense (e.g. counterclockwise), the limited end-to-end twisting of the conventional board, if any, would not be enough to rotate the direction casters (if used) about their pivot angles to provide any substantial tendency to locomotion of the skateboard.

Graph line 124 is shown for convenience as a straight line, and in some boards may represent a linear variation of end-to-end twist as a function of differential force applied. However, in other boards, the function may not be linear and may for example better represented by a curve, such as a smooth curve.

Referring now to FIG. 14B, graph line 128 represents the angle of twist as a function of the differential pressure or force applied by the user to a flexible single piece board. Differential pressure or force may be the force applied to twist platform 12, for example, by applying unequal forces on opposite sides of long or twisting axis 20. As noted above, the graph line may represent either a linear or non-linear function of twist in response to differential applied force for one embodiment of a single piece flexible board. Conventional operation zone 130 represents a portion of the graph line, centered around zero point 126, in which differential pressure applied by the user will not produce sufficient end-to-end twist to cause any substantial tendency toward locomotion. The width of the conventional zone of operation zone represents the magnitude of the difference force or pressure which may be applied, for example with one foot twisting the board in a clockwise direction while the other foot twists the board in a counterclockwise direction, that can be applied to board 10 without causing the board to operate as a flexible skateboard.

If this maximum differential or twisting force, that may be applied without causing board 10 to operate as a flexible skateboard, to permit the user to feel feedback or resistance from the board, the user can more easily maintain a flat board, that is, to operate the board as a conventional board without causing board 10 to steer. Said another way, if the flexible board flexes easily about zero point 126 so that the user can't easily distinguish by feel when the board is twisting substantially or not, the user may have to make continuous adjustments to the differential pressure applied to the board in order to have the board run straight and true in a conventional manner. This range of low levels of differential pressure, if allowed to produce substantial end-to-end twist before the magnitude of the differential pressure is easily noticed and/or controlled by the user, may be considered a "dead zone" and produce substantial user fatigue merely trying to keep the board running straight. If however, as shown in graph line 128, the range of differential pressures (within which the end-to-end twist is not enough to cause the skateboard to turn or otherwise operate non-conventionally) is high enough so that the user can feel the resistance or feedback from the board, the board can easily be operated to run straight without substantial user fatigue.

In other words, it may desirable for the board to provide sufficient resistance to initial twisting so that the user can feel the resistance with his feet even when the differential pressure is low in order to reduce the fatigue and stress of operating a flexible board while going straight or steering only by tilted, as performed in a conventional, non-flexible or flat board manner. By applying more differential or twisting forces, rolling energy can be applied to the wheels and locomotion may still be accomplished by applying cycles of differential pressures providing sufficient end-to-end twist beyond the convention operation zone 130 to cause locomotion and/or aid in steering the board.

Referring now to FIG. 14C, another important aspect of the twisting of board 10 may be that the amount of twisting of the material of board 10 within each foot support area be minimized to reduce stress and fatigue for the user. For example, if the twist within a foot support area is high enough, the twist may effect the vertical angle at which the user's ankle is supported. During twisting of the material of board 10, the heel and toe motion of user's feet causes twist. If the twist in each foot support area is high enough, the angle of support of the ankles to the legs of the user be altered by the twist. For example, if it may be assumed for the purposes of discussion that all the twist in board 10 is performed within narrow section 22, each foot support area may be considered to support the user's leg in a generally vertical plane even though, of course, the ankle may be rotated fore and aft and the knee is bent. If however, significant twisting also occurs within the foot support area, for example if the user's leg is twisted further out of the vertical than would result if no twisting occurred within the foot support area, operation of the board during twisting would likely cause the user greater stress and fatigue than would otherwise occur.

A small amount of twisting of within each foot support area may however be acceptable. For convenience of illustration, user's shoe 19 is shown on foot position 18 of graph line 21 of board 10. The relative angle of twist is shown along graph line 21 from central zero point 126. That is, board 10 is assumed to have a point within central section 22 which hasn't rotated when the material of board 10 has been twisted to a maximum amount of twist, such as 50° of end-to-end-twist. The degrees of rotation about twist axis 28 increase from zero point 126 to a maximum number of degrees, such as 22.5°, at the end of central section adjacent foot support area 18. In order to reduce user's stress and fatigue, the change from the vertical support (shown as dotted line 25), as a result of twist of the material of platform 12 occurring within foot support area 18, of the user's leg above ankle 23, is limited to a small number of degrees as illustrated by near vertical support line 27.

Referring again to FIG. 2, sidewall 62 may be used to reduce the fatigue or stress of the user resulting from a bending or bowing of surface 58 of board 10. If the material of board 10 was too flexible, or not sufficiently support for example by sidewall 62 or the like to prevent bowing, the user would experience stress on his ankles if his stood too far outside of the area of support of wheel assemblies 24 and 26 because the outside of his feet would each tilt downward. Similarly, if the user stood too far inside of the support of wheel assemblies 24 and 26, his ankles would be stressed because the inside of his feet would tend to tilt downward. The tilting of the user's feet from bowing of the material of board 10 can be said to occur generally in a plane across the width of the user's body. A similarly stress may occur if too much twisting occurs within foot support areas 18 and 20. These stresses would occur as a result of a shift in the support of the user's legs too far from the vertical towards a direction part way between the plane across the width of the user's body towards a plane through each of the user's bent legs. The relative wider areas of foot support 18 and 20, compared to central section, may therefore also serve to reduce user's fatigue or stress in a similar manner as the increased height of sidewall 62 but as a result of preventing or reducing a different stress factor. For purpose of explanation, the stress on the user's foot resulting from excess twisting within a foot support area may be thought of as a twisting of the user's foot in which a forward part of the outside or inside of the foot is twisted up or down more than a rearward part of that foot.

Figure 15:
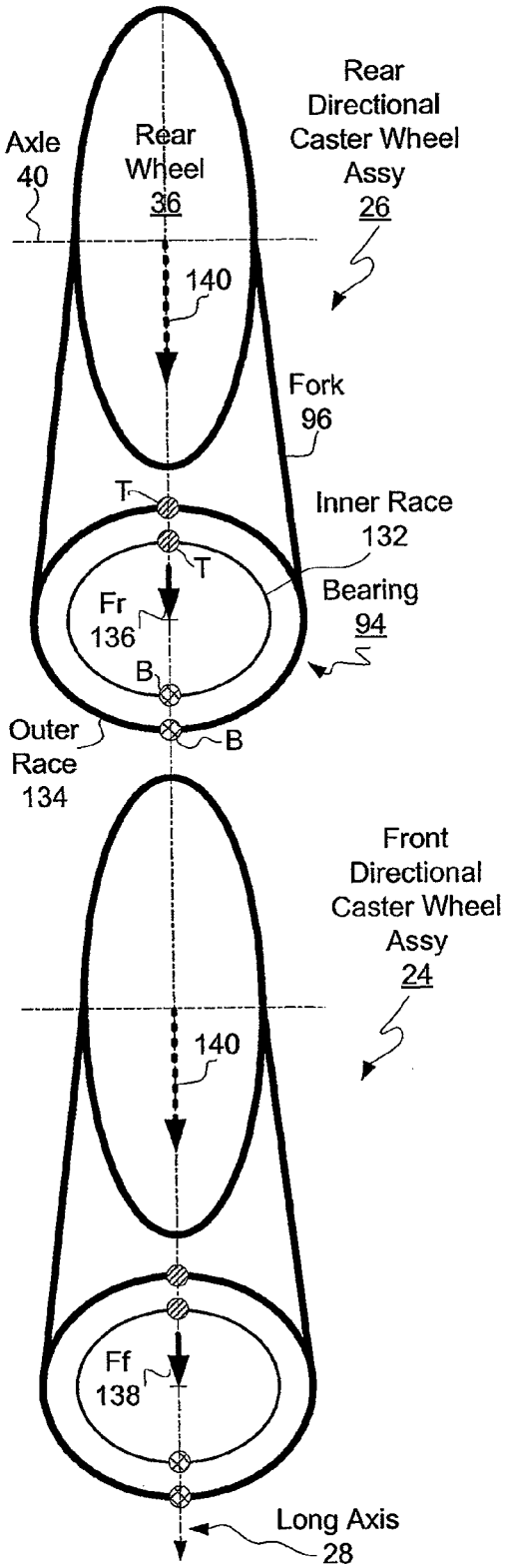
FIG. 15 is a graphical representation of caster wheel assemblies 24 and 26 with non-differential pressure or forces applied by a user along the twist axis 28.

Referring now to FIG. 15 (as well as FIGS. 1, 2 and 11) top views of front and rear directional caster wheel assemblies 24 and 26 are shown in FIG. 15 aligned along twisting or long axis 28 of the top surface 12 of board 10, shown in FIG. 1. In particular, in rear caster assembly 26, inner race 132 of bearing 94 is mounted to a fixed portion of the skateboard such as platform 12 while outer race 134 supports fork 96 in which rear wheel 36 is mounted for rotation about axle 40. The direction of rolling motion of caster 26 is perpendicular to axle 40 and is indicated as direction vector 140.

Bearing 94 is typically circular, but is shown in the figure in an oval shape because this figure is a top view and outer race 134 is mounted for pivoting rotation about axis 50 which is not orthogonal to top surface 58 of platform 12 but rather at an acute trailing angle θ2 to it as shown for example in FIG. 2. The plane of bearing 94 is orthogonal to axis 50 and therefore appears oval in this figure. Top points "T" and bottom points "B" of inner and outer races 132 and 134 are shown for ease of discussion of the orientation of caster wheel assembly 26. In particular, wedge 48, which may be hollow, is mounted with its thicker portion forward so that top point T of inner race 132 is closer to top surface 58 and bottom point B of inner race 132 is further away from top surface 58 because of the acute trailing angle θ2 of axis 50.

The range of pivotal rotation of outer race 134 about axis 50 may be limited, for example, by self centering spring 106 (shown for example in FIG. 11) if present. Bearing 94, mounted in a plane at an angle to top surface 58 as a result of wedge 48, tends to permit rotation so that top points T and bottom points B of the inner and outer races 132 are aligned.

In FIG. 15, the user is applying generally Ff 138 and Fr 136 (at front and rear foot positions 14 and 16) generally along centerline or long axis 28 as a result of which there is no differential force applied so that there is no substantial end-to-end twist applied to top platform 12 of board 10. In practice, if the level of resistance to twist of platform 12 is relatively low, e.g. so low that it is difficult for the user to feel enough feedback from the resistance to twisting of platform 12 to conveniently sense when no differential pressure is being applied, the user must work the board by applying varying amounts of differential pressure in response to non-straight motions of the board. The constant working of the board is undesirable because it causes fatigue and stress, so at least a minimum level of resistance to twisting may be desirable in a single piece, flexible skateboard.

Figure 16:
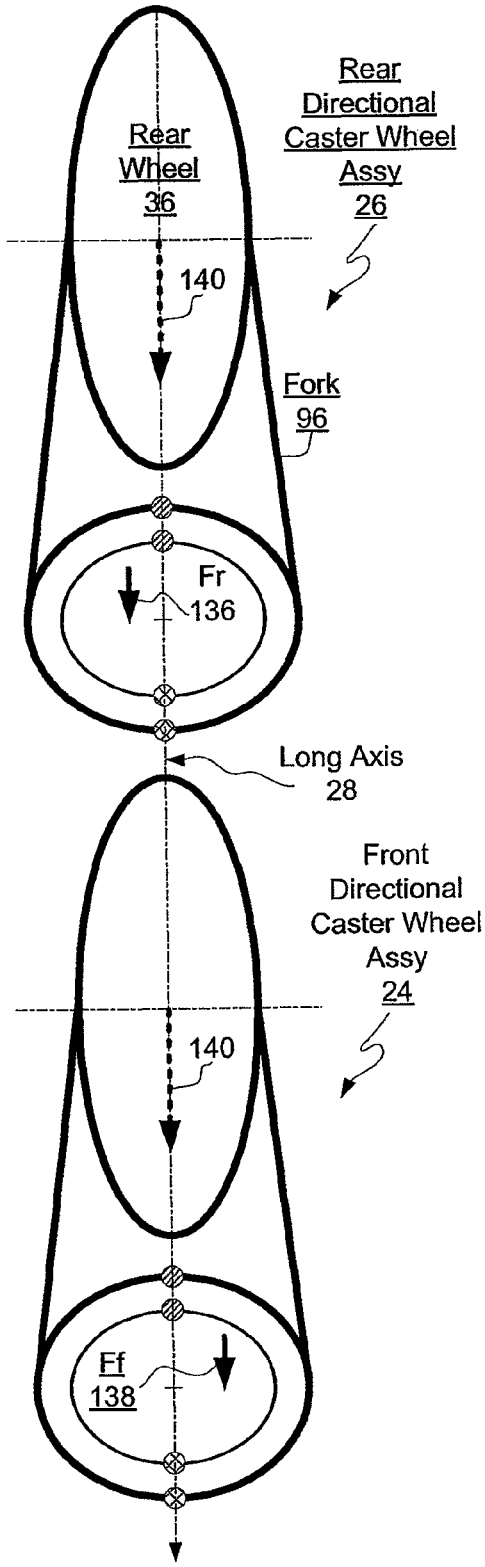
FIG. 16 is a graphical representation of caster wheel assemblies 24 and 26 with differential pressures or forces applied by a user on either side of twist axis 28.

Referring now to FIG. 16, caster wheel assemblies 24 and 26 are shown generally in the same way as shown in FIG. 15 except that front and rear foot forces or pressures Ff 138 and Fr 136 are shown applied displaced in opposite directions from twisting axis 28. In one preferred embodiment, the resistance to twisting of platform 12 may be sufficiently high that the user can easily apply at least some differential pressure to platform 12 without causing casters 24 and 26 to turn from a straight forward alignment, that is, front and rear wheels 36 may generally maintain track with long axis 28 so that board 10 operates as a conventional non-flexible board even though sufficient differential pressure may be applied by the user to get force feedback from the board's resistance to twist. As shown by motion vector 140, which is aligned with long axis 28, board 10 may run straight, i.e. operate in a convention non-flexible board manner even with some applied differential foot forces as shown. This higher level of resistance to twisting may be desirable to reduce user fatigue and/or stress.

Figure 17:
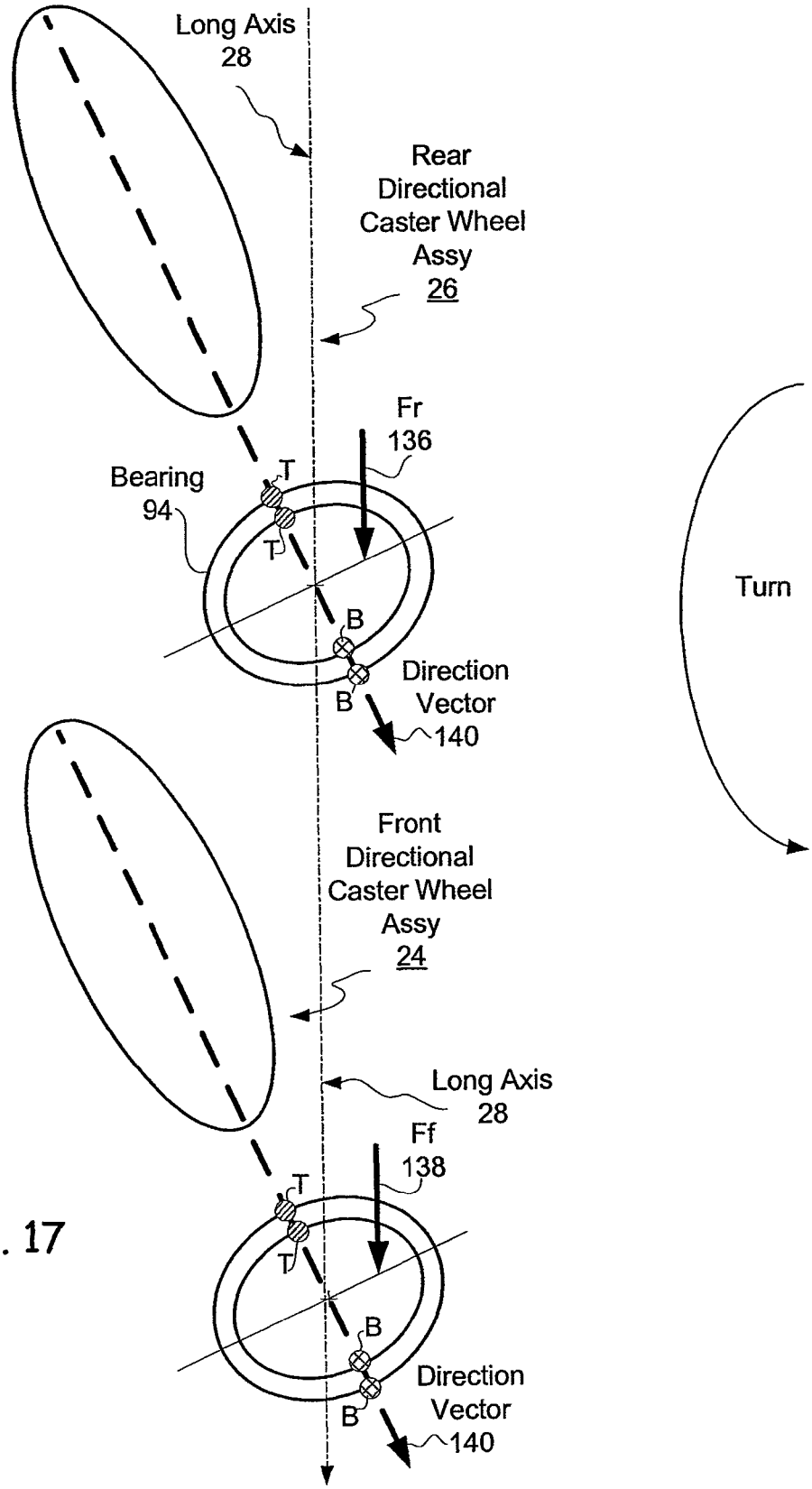
FIG. 17 is a graphical illustration of the steering of wheel assemblies 24 and 26 with non-differential pressures or forces applied by a user on one side of twist axis 28.

Referring now to FIG. 17, the user is applying substantial non-differential pressure as indicated by Fr 136 and Ff 138 which causes platform 12 to tilt. As a result, top point T and bottom point B of the inner races of bearings 94 of caster assemblies 26 and 24 are shifted by the tilt in the opposite direction from the side of long axis 28 on which forces 136 and 138. In response, the applied forces cause the pivotable portions of the caster assemblies to pivot about their axes in order for top points T and bottom points B of the outer races to become aligned with the top points T and bottom points B of the inner races, as shown. Direction vectors 140, that is the paths that the wheels would tend to roll along, are no longer parallel with long axis 28 so that board 10 tends to change direction from the direction of axis 20 towards the direction of vectors 140. The actual turn resulting from non-differential forces 136 and 138 may depend on many factors, including the shape of wheels 36 as well as wobble and similar factors, but may be used at least in part for steering.

This above described operation of board 10 where steering of board 10 results from a tilting of platform 12 may be considered to be within the zone of conventional operation of a non-flexible skateboard, that is, board 10 may feel to the user to be similar to the feel of a conventional board. It should be noted however, that, non-flexible, conventional skateboards using wedges and/or directional casters, may typically be configured with the wedges facing in opposite directions so that the rear wheel is forward of the rear wheel pivot point and the front wheel is aft of the front wheel pivot point.

Figure 18:
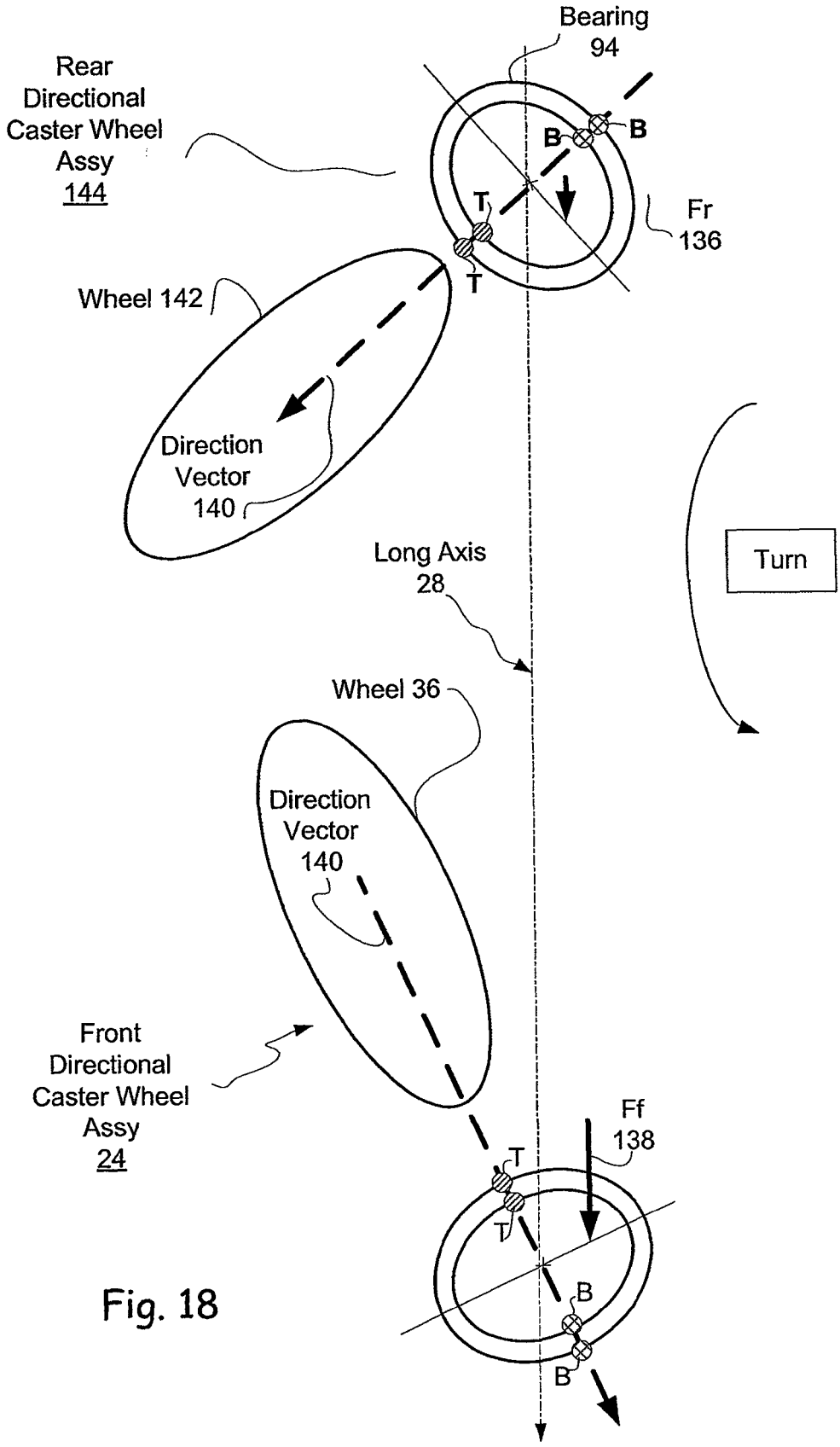
FIG. 18 is a graphical illustration of the steering of wheel assemblies 24 and 144 having non-parallel pivot axes with non-differential pressures or forces applied by a user on one side of twist axis 28.

Referring now to FIG. 18, caster wheel displacement for such a design is shown for comparison. In such a configuration in which the pivot axes of the front wheels are not generally aligned with each other, e.g. the pivot axes are not both at a similar acute angle to top surface 12, non-differential foot pressure to the same side of long axis 28 may cause wheel 36 of front caster assembly 24 to rotate in a first sense (e.g. counterclockwise) as shown while causing wheel 124 of rear directional caster assembly 144 to rotate in the opposite sense (e.g. clockwise) as shown. The resultant turn as shown would be counterclockwise, following the front wheel.

Figure 19:
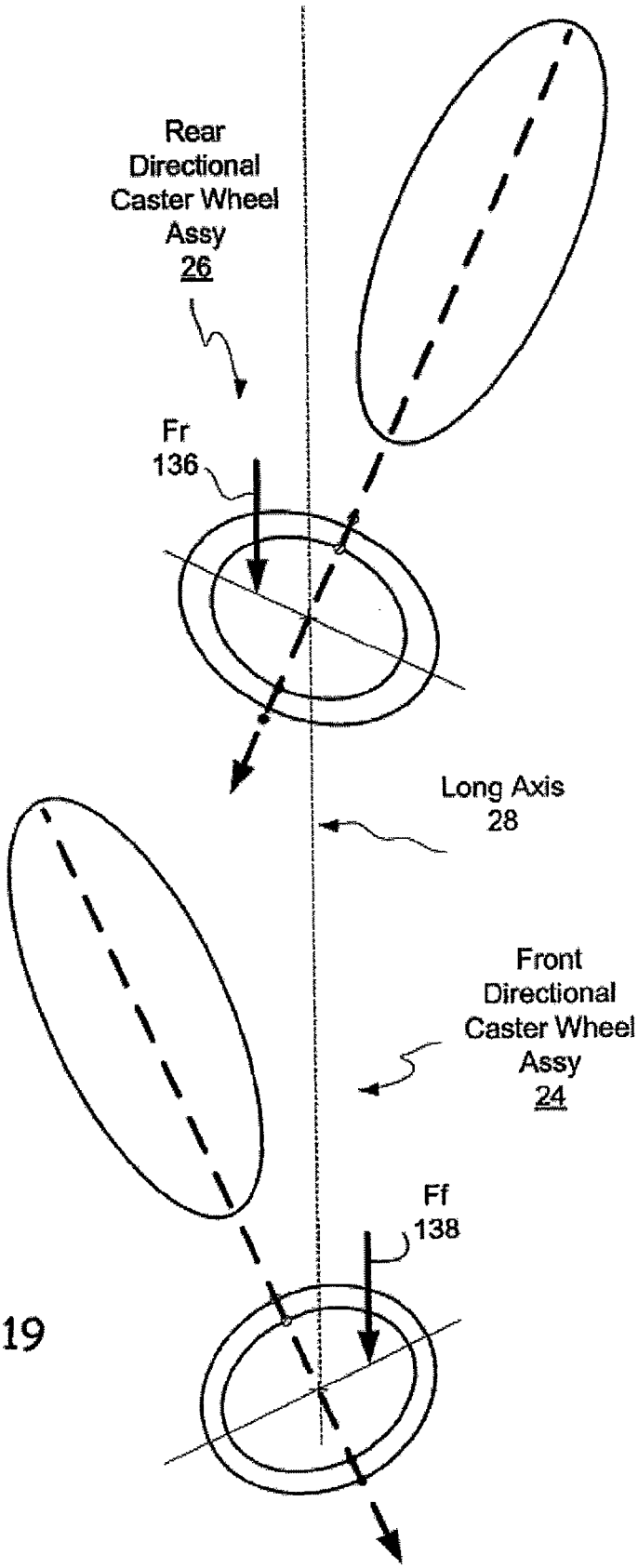
FIG. 19 is a graphical illustration of the steering of wheel assemblies 24 and 26 having parallel pivot axes with differential pressures or forces applied by a user on both side of twist axis 28.

Referring now to FIG. 19, a flexible single board skateboard using directional casters pivoted along generally aligned trailing axes may be steered by applying differential pressure, for example, forces Fr 136 and Ff 138 to opposite sides of long axis 28 which causes the directional casters to rotate in opposite directions to steer and/or locomote skateboard 10. It should be noted that in practice, board 10 may well be steered using a combination of differential pressure or twisting forces, as well as some level of tilt.

Referring now to FIGS. 14 through 19, in a preferred embodiment, the resistance to twisting of platform 12 may be sufficient to conveniently operate the skateboard in a straight line manner as shown in FIGS. 15 and 16 with forces applied along long axis 28 or in a non-differential manner with roughly equal forces applied on opposite sides of long axis 28. Similarly, board 10 may be steered by tilting platform 12 in response to applying forces from both feet to the same side of axis 28. These three operations may be considered as operations in conventional zone 130 of FIG. 14, that is, operations which are the same or similar to operations of a non-flexible. The operation shown in FIG. 19 may be considered an operation outside conventional zone 130 in that twisting platform 12 causes the wheel assembly to pivot in different directions. Platform 12 may also be tilted when twisted.

Single piece platform 12 may be configured from multiple pieces of plastic material which are fastened together, for example by nuts and bolts, so that platform 12 twists as if it were molded from a single piece of plastic material.

Figure 20:
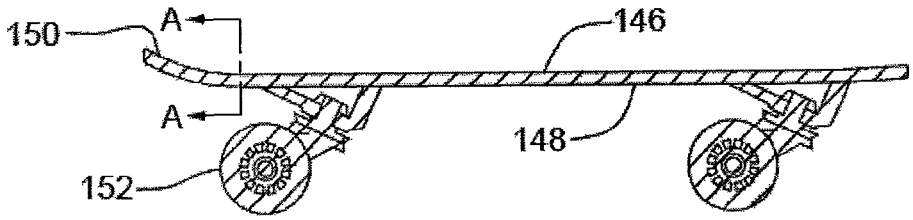
FIG. 20 is a side view of an alternate embodiment in which one piece flexible skateboard 146 is formed by molded wooden deck 148 provided with integral kick tail 150.

Referring now to FIG. 20, flexible skateboard 146 may be configured with a single piece, molded wooden platform such as platform 148 with molded in kick tail 150. Kick tail 150 is a portion of wooden platform 148 extending well beyond rear wheel 152 so that a rider can apply pressure with one foot to kick tail 150 to alter the performance of skateboard 146 by for example kicking the tail of skateboard 146 down to contact the ground to stop or alter the direction of travel. Wooden platform can conveniently be made by molding plywood by vacuum, steam or other conventional processes. In addition to molding kick tail 150, it may be convenient to mold in a symmetrical side to side shape as shown in FIG. 21.

Figure 21:
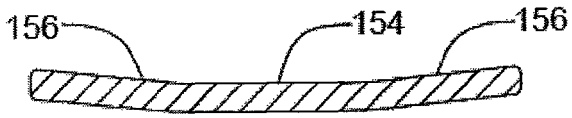
FIG. 21 is a front view of a cross section of skateboard 146, taken along line AA as shown in FIG. 20.

Referring now FIG. 21, a front view of a cross section of skateboard 146, taken along line AA as shown in FIG. 20, illustrates one side to side shape which may be molded into wooden platform 148 of skateboard 146 for example at kick tail 150 or along the length of platform 148. The illustrated cross sectional shape includes a center flat section 154

Figure 22:
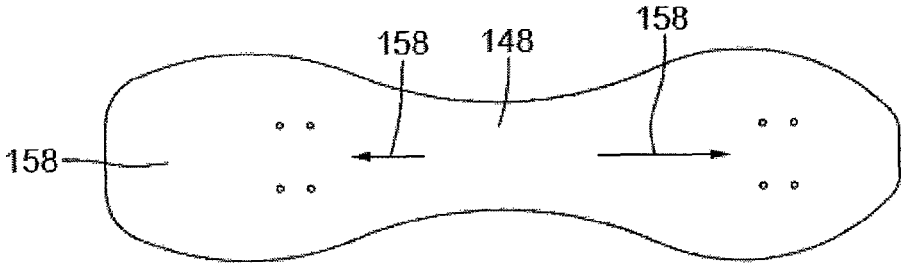
FIG. 22 is a top view of wooden platform 148 illustrating overall shape including a top view of kick tail 150.

Referring now to FIG. 22, a top view of wooden platform 148 is shown illustrating the overall shape including the top view of kick tail 150. A preferred longitudinal grain direction for the wood or plywood from which platform 148 is molded is illustrated by grain direction arrows 158. A longitudinal grain direction will allow wooden platform 148 to better resist damage, for example by splintering, when twisted during operation of skateboard 146. The use of a longitudinal grain direction in the majority of the layers of a plywood board, for example the top and bottom layers of a 3 layer plywood board, used for making wooden platform 148 may be particularly advantageous.

Figure 23:
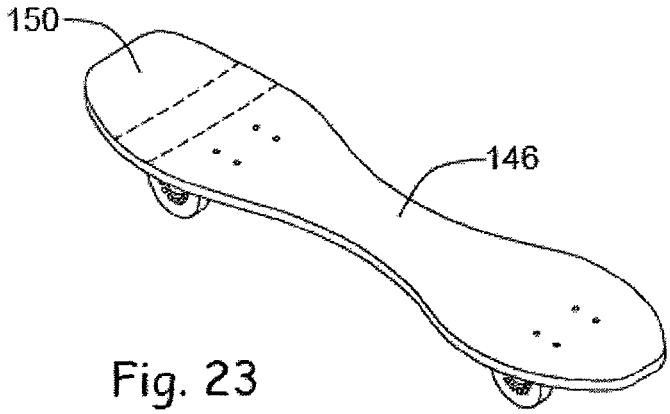
FIG. 23 is an isometric view of skateboard 146 including kick tail 150.

Referring now to FIG. 23, an isometric view of skateboard 146 including kick tail 150 is provided for clarity.

Figure 24:
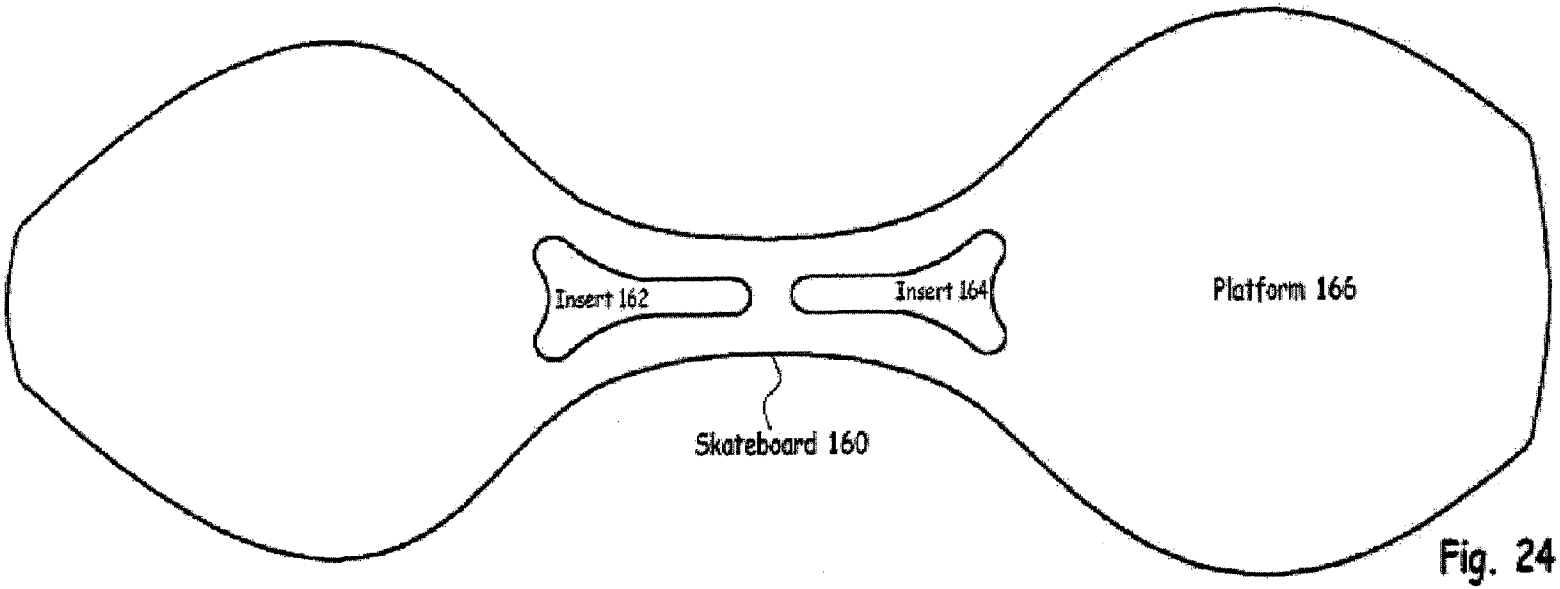
FIG. 24 is a top view of an alternate embodiment in which skateboard 160 may include a pair of center section inserts 162 and 164 in platform 166 for controlling the flexure of platform 166.

Referring now to FIG. 24, a top view of an alternate embodiment is shown in which skateboard 160 may include a pair of center section inserts 162 and 164 in a pair of through holes in platform 166 for controlling the flexure of platform 166. The inserts are shown in FIG. 24 positioned in the pair of through holes which are positioned generally along the elongate axis of platform 166 and are shown bisected at the center of skateboard 160. The pair of holes may be used, with or without inserts 162 and 164, to alter the flexibility of skateboard 160 to twisting. Inserts 162 and 164 may be inserted in the holes to control the flexibility of platform 166. If the material from which the inserts are made is more flexible than the material from which platform 166 is made, skateboard 160 would have more flexibility than if the inserts were removed, but less flexibility than if the holes were not present.

Similarly, if the material from which inserts 162 and 164 are made are less flexible than the material of platform 166, the presence of the inserts would tend to reduce the flexibility of skateboard 160 to twisting forces applied, for example, by a skateboard rider pumping skateboard 160 to cause locomotion. The resilience of inserts 162 and 164 may also be used to control or affect the operation of board 160. For example, if the inserts are made of a material which crushes temporarily when forces are applied, board 160 would flex differently than if the inserts were not present. In particular, board 160 would flex when twisting forces were applied more slowly than it would return to its original shape when the twisting forces were removed because the original twist would be resisted by the crushing of the foam, but the return would likely not be resisted by the foam because it would stay crushed at least for a short time.

Alternately, if inserts 162 and 164 were made of a springy rubber, the twisting of board 160 would be affected by the response of the rubber, for example, springing back more quickly than if the inserts were not present. Further, under some circumstances it may be desirable to use only one of the inserts. For example, if insert 162 were present without insert 164, the flexibility of on end, such as the front, of skateboard 160 can be controlled to be different than the flexibility of the rear of the board. That is, the flexibility of the board with respect to twisting forces applied by the leading foot of the skateboard rider could be adjusted at least somewhat with respect to the flexibility of the board with respect to twisting applied by the other foot of the rider. The wheels, not shown in the figure, under the front and rear of platform 166 allow forces applied to the front and rear sections of the board to be at least to some degree somewhat isolated from each other and thereby affected by the material of insert 162 and 164 if present. In a further embodiment, a different material may be used for inserts 162 and 164 for more precise control of the relative flexibility of the front and rear of the skateboard 160.

The rounded, somewhat dog-bone shape of the inserts and the holes through the platform in which they may be mounted reduces the likelihood of stress fractures and weaknesses in platform 166 from flexure.

Figure 25:
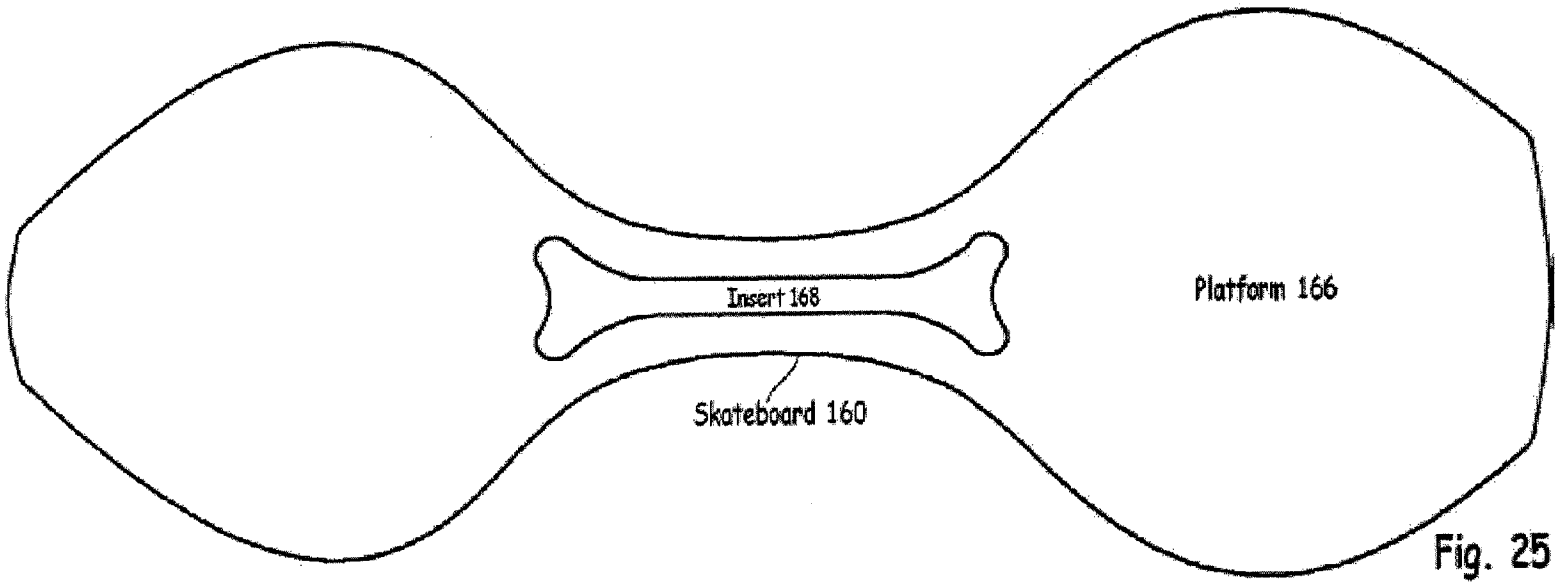
FIG. 25 is a top view of an alternate configuration of skateboard 160 shown in FIG. 24 in which a single center section insert may be employed.

Referring now to FIG. 25, a single insert 168 may be positioned in a single hole through the platform in lieu of the pair of inserts shown in FIG. 24 or the hole may be used without insert 168.

Referring now to FIGS. 26 through 29, a further embodiment is shown in which skateboard 170 includes platform 172 which may have a partial peripheral well along the outboard edges of the front and rear foot positions. A grip bar, such as rubber, may be positioned in the peripheral wells for better gripping by the rider's feet. The partial peripheral well may include an inner downward wall, a trough bottom, and an upward outer wall. The inner and outer peripheral well walls may be used to increase the resistance to flexing of the foot position portions of platform 172. A pair of downward wall along the central section of platform 172 may be used to reducing the flexing of the central section. An insert may be positioned between the downward walls surrounding the central section of platform 172 to further control the flexing of the central section in response to twisting forces applied, for example, by the rider.

Figure 26:
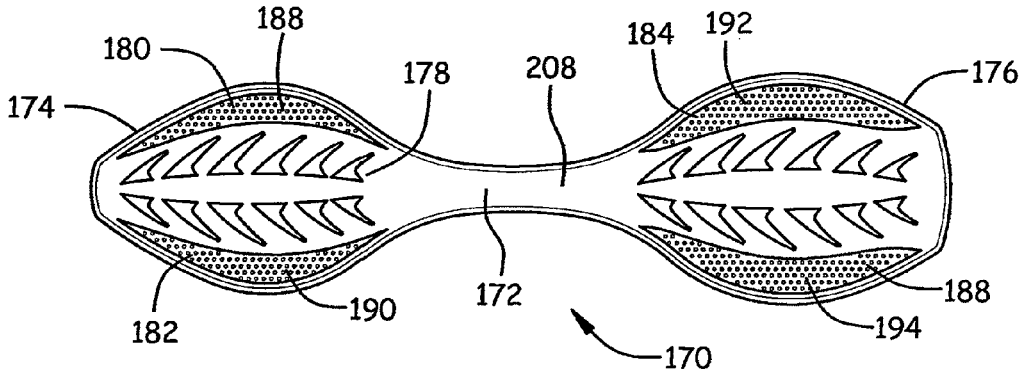
FIG. 26 is a top view of an alternate configuration of skateboard 170 including a textured surface and a series of partial peripheral wells in which inserts, such as rubber gripper bar inserts 188, 190, 192 and 194 may be positioned.

Referring now more specifically to FIG. 26, platform 172 includes front section 174 and rear section 176 forming front and rear foot positions. A central area of the front and rear sections have a textured surface 178 which may conveniently be formed in the material of platform 172 when it is molded or otherwise formed. Platform 172 may preferably be formed of a molded plastic or wood, such as plywood, and therefore not have as strong a gripping surface as may be desired at times for a skateboard. Partial peripheral wells 180 and 182 may be formed along the outer edges along front section 174 while partial peripheral wells 184 and 186 may be formed along the outer edges of rear section 176. The peripheral wells may be filled with a material providing a good gripping surface, such as rubber, for contact by the foot and/or heel of the rider's feet. The material may be in the form of an insert which could be replaceable by the rider such as front and rear inserts 188, 190, 192 and 194 respectively. The inserts may be made from rubber, plastic, metal alloys or similar materials.

In use, the shape and width of the rubber inserts may be configured so that during normal riding, e.g. when skateboard 170 is being controlled in a straight and unbanked manner, or even while turning in a relatively gentle banked turn, the bulk of the user's weight may be applied to central areas 178 so that the user's feet may be quickly and easily moved to change position of the rider's feet to change the forces being applied to the skateboard for control. In this way, the rider may also easily change and adjust foot positions without a substantial gripping contact with the rubber inserts.

During a maneuver, however, for example when the rider is applying downward pressure with the ball of one foot and the heel of the other, the additional pressure of the ball and heel applying the downward pressure may preferably cause those portions of the rider's feet to make contact with the rubber inserts, as well as the textured central areas, increasing the gripping force between the active portion of the foot and the board. The contact, for example, between the ball of one of the rider's feet with a gripping surface while that foot is applying downward pressure may provide useful additional control for the rider. In an optimal configuration, the rider may be able to control the gripping force by foot placement and pressure between the lower gripping force when the rider's foot only contacts the textured surface of the molded platform and the greater gripping force when at least one portion of the rider's foot is also contacting the rubber insert.

Figure 27:
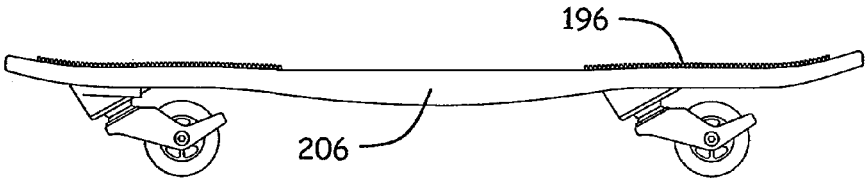
FIG. 27 is a side view of skateboard 170 shown in FIG. 26.

Referring now also to FIG. 27 in greater detail, the upper surface of rubber inserts 188, 190, 192 and 194 may be specifically textured, for example, to increase the gripping force between the insert and the rider's foot. Gripping projections 196 may be formed in the upper surface of the rubber inserts to increase gripping forces. The material from which the gripping projections, and/or the fill or insert material, may be selected to control the gripping force in light of the typical or expected materials to be used on the soles of the rider's shoes.

Figure 28:
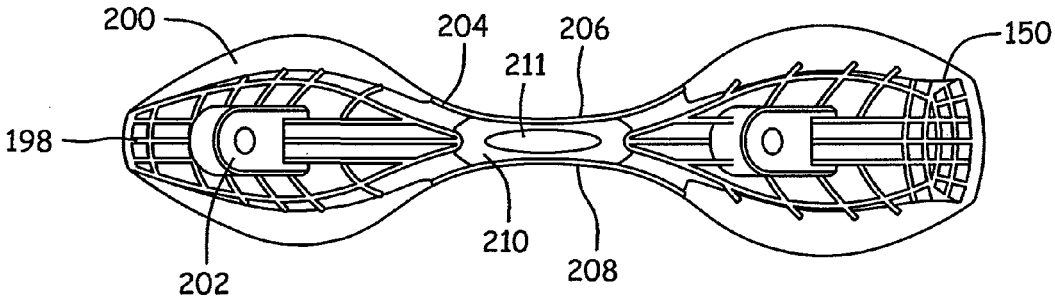
FIG. 28 is a bottom view of skateboard 170 shown in FIG. 26.

Referring now also to FIG. 28 in greater detail, the underside of platform 172 is shown which may include ribbed central section 198, extending between troughs 200 of wells 180 and 182 of front section 174, for added strength. A similar configuration may be provided on the underside of rear section 176 as shown. Ribbed section 198 is generally underneath central area 178 of front section 174 which may have surface texturing related to the ribbing and/or formed by the molding process. Wheel mounting structure 202 may be surrounded by and/or supported by the ribbing in section 198.

The upward wall sections of well 180, for example, join together at wall transition point 204 and join a downward wall, such as sidewall or rib 206 along the edge of skateboard central section 208. A pair of downward walls 206 form a portion of one or more chambers underneath skateboard central section 208 of platform 172 which may be filled by one or more inserts, such as central insert 210. As discussed above in greater detail with respect to FIG. 10 and wedges 82, central insert 210 may be used to at least partially control the flexing of the skateboard and may be inserted and/or removed by the rider based, for example, on the rider's skill and/or difficulty of a particular maneuver.

Figure 29:
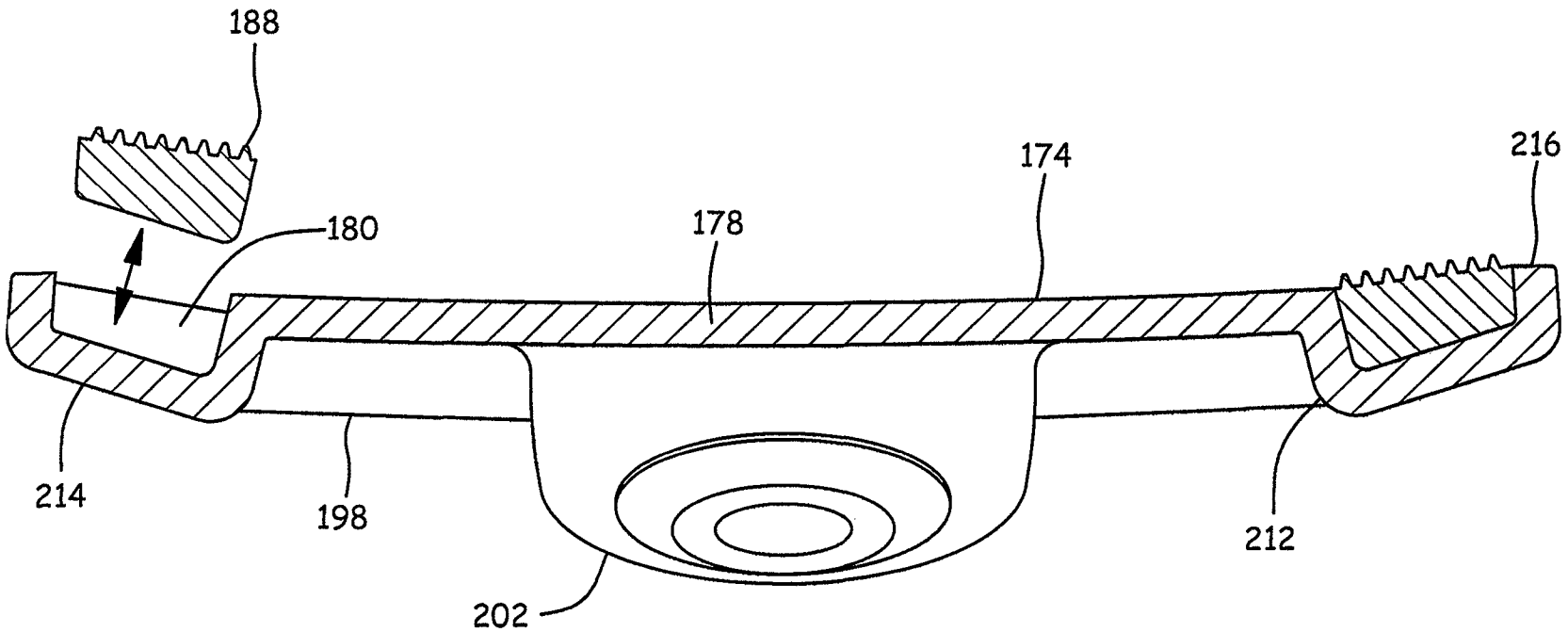
FIG. 29 is a cross sectional view along line AA in FIG. 27.

Referring now in greater to FIG. 29, a cross section of front section 174 is shown, taken along lines AA in FIG. 27. As shown the textured central area 178 of front section 174 is generally flat but preferably has a slightly concave upwards shape for strength. Wheel mounting structure 202 is positioned below central section 178 and may be at least partially supported by ribs 198. Along the periphery of front section 174, partial peripheral well 180 is formed by inner downward sidewall 212 along central section 178, trough bottom 214 and upward outer sidewall 216. Rubber grip bar 188 may be positioned in well 180. The use of a pair of upward and downward sidewalls 212 and 216 may provide substantially greater strength, and/or resistance to twisting, for the front and rear sections of platform 172 than is easily achievable using the same materials and a single sidewall as shown above in the earlier figures. The use of the shape, material and fit of insert grip bar 188 may also be used to control the resistance to twisting of the front and rear sections.

It should be noted that the use of upwardly open wells, such as partial peripheral well 180, joined at wall transition points, such as point 204, to downwardly opening chambers such as central insert chamber 211, permits greater control of the resistance to twisting forces of the front, central and rear sections 174, 208 and 176 respectively than the use of a single wall as shown in earlier figures. In addition, the relative resistance to twisting between these sections of platform 172 can also easily be controlled so that the twisting may, for example, be generally confined to the central sections and/or the front and/or rear sections of the skateboard. The use of inserts further enhances the control of resistance to twisting forces of platform 172 and/or the relative resistance to twisting forces of the front, central and rear sections of platform 172 and provides the rider the ability to alter the relative and total resistance to twisting after purchase of skateboard 170. Similarly, the transitions from a central downward facing sidewall to the pair of downward and upward facing sidewalls in which the outer sidewalls transition directions, between upward and downward facing, twice on each side of skateboard 170, also greatly enhance the strength and rigidity of the skateboard for a particularly size and material used for platform 174.

Figure 30:
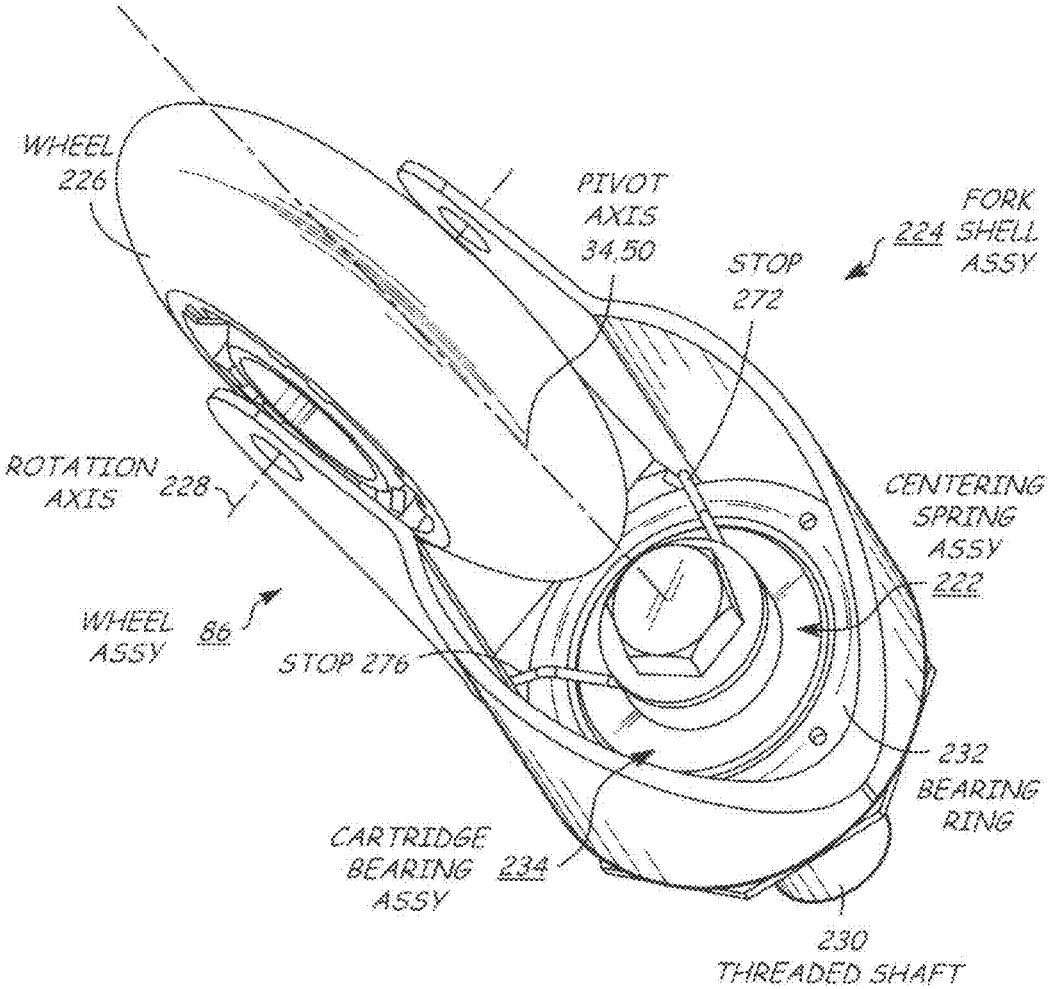
FIG. 30 is an isometric view of a further embodiment of wheel assembly 86 of FIG. 1 with an alternate centering spring arrangement.
Figure 31:
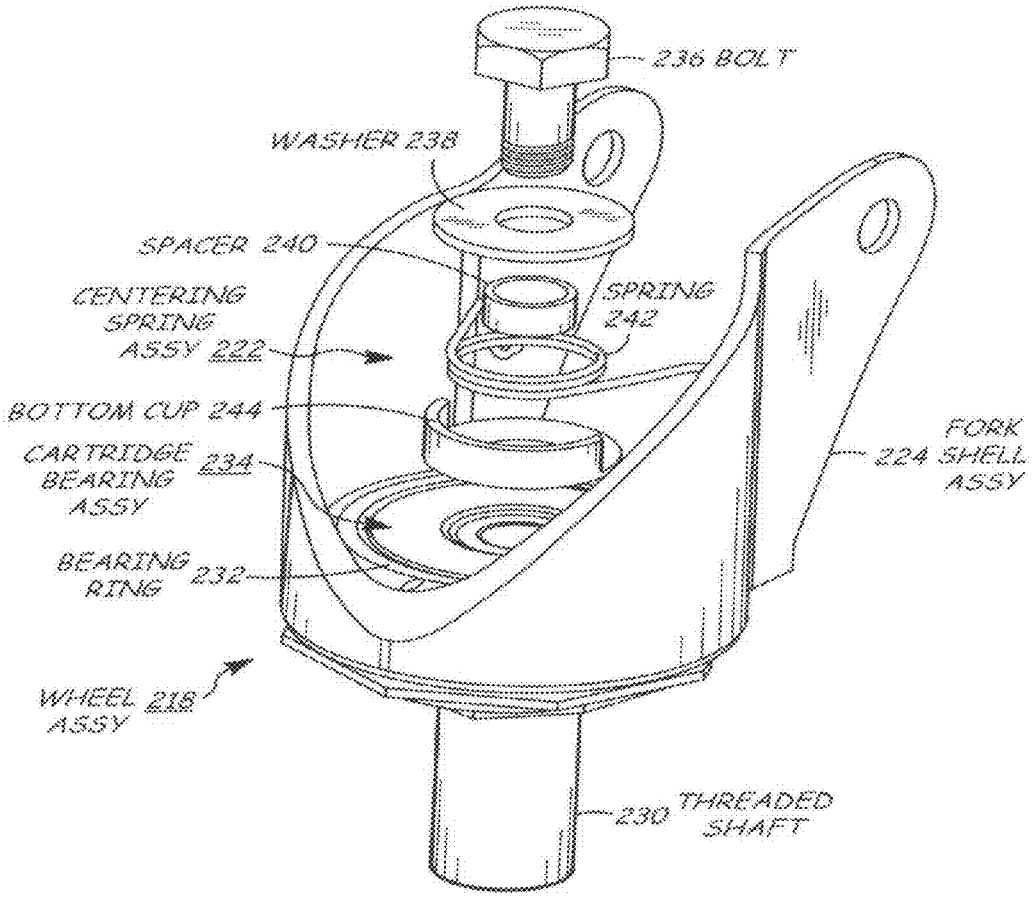
FIG. 31 is an exploded view of wheel assembly 218 of FIG. 30.

Referring now to FIGS. 30 and 31, an isometric view of one embodiment of wheel assembly 86 is shown including centering spring assembly 222 mounted within fork shell assembly 224. Wheel 226 is mounted to fork shell 224 for rotation about wheel rotation axis 228. Conventional bearings and other hardware are not shown in this figure for clarity. Wheel assembly 218 may be bolted to skateboard 10, at an angled surface such as wedge 32 to permit pivoting of wheel 226 about pivot axis 34 or 50, as shown in FIG. 2, via internally threaded shaft 230. Fork shell 224 may include bearing ring 232, the outer periphery of which may be fastened fork shell 224 by for example spot welding.

Cartridge bearing assembly 234 may include an inner race mounted via centering spring assembly 222 to prevent rotation against skateboard 10 and an outer race mounted in a friction fit opening in bearing ring 232. As a result, fork shell 224 is mounted to the outer race of bearing 234 for rotation about axis 34, 50 (which as described above are at an acute angle to the plane of skateboard 10) while centering spring assembly mounted on the inner race of bearing 234 remains secured to—and does not rotate with respect to—skateboard 10.

Centering spring assembly 222 may include a threaded rod such as bolt 236 which may be threaded into threaded shaft 230 through washer 238. Spacer 240 fits beneath washer 238 and around the shaft of bolt 236. Spring 242 has a preferably coiled central section which fits around spacer 240 coaxially with pivot axis 34 and within bottom cup 244. When bolt 236 is secured in threaded shaft 230, washer 238 may press against the top of spacer 240—and also against the partial outer rim of bottom cup 244—pushing bottom cup 244 against the inner race of cartridge bearing assembly 234 to maintain alignment and not rotate with respect to skateboard 10. Fork shell assembly 224 may rotate with the outer race of cartridge bearing assembly 234 under the control of centering spring assembly 222.

Figure 32:
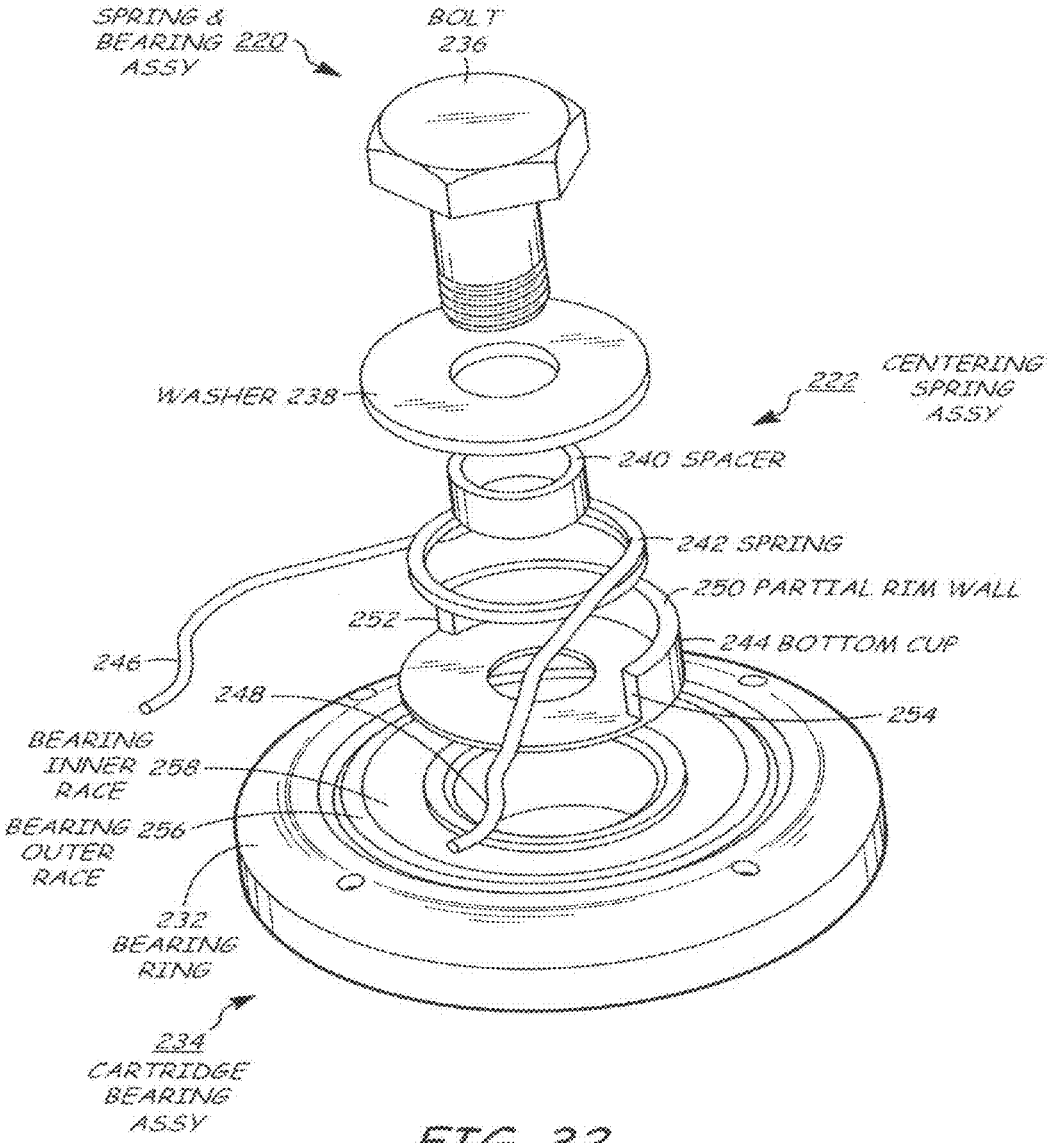
FIG. 32 is an exploded view of spring and bearing assembly 220 of FIG. 31.

Referring now to FIG. 32, spring and bearing assembly 220 includes centering spring assembly 222 assembly and sealed type cartridge bearing assembly 234. Spring assembly 222 includes bolt 236, washer 238, spacer 240, spring 242 having spring arms 246 and 248, as well as bottom cup 244 having partial rim wall 250 with stops or edges 252 and 254. Edges 252 and 254 may be on the order of 180° apart along partial rim wall 250 and serve as stops 252, 254 for spring arms 246 and 248, respectively, when one of the spring arms attempts to move in the direction of the closest stop. Further rotation of spring arms 246 and 248 is limited in the other direction by fork assembly 224 and bearing ring 232 at stops 272 and 276 as shown above in FIG. 30.

Cartridge bearing assembly 234 includes outer or bearing ring 232 which may be welded to fork shell assembly 224. Bearing outer race 256 may be press fit in an opening in bearing ring 232 thereby supporting wheel 226 in fork shell 224 for rotation about pivot axis 34, 50. Bearing inner race 258 supports outer race 256, and therefore wheel assembly 86, for pivotal rotation. Bearing inner race 258 is compressed between washer 238 and skateboard 10 by bolt 236 when assembled.

Figure 33:
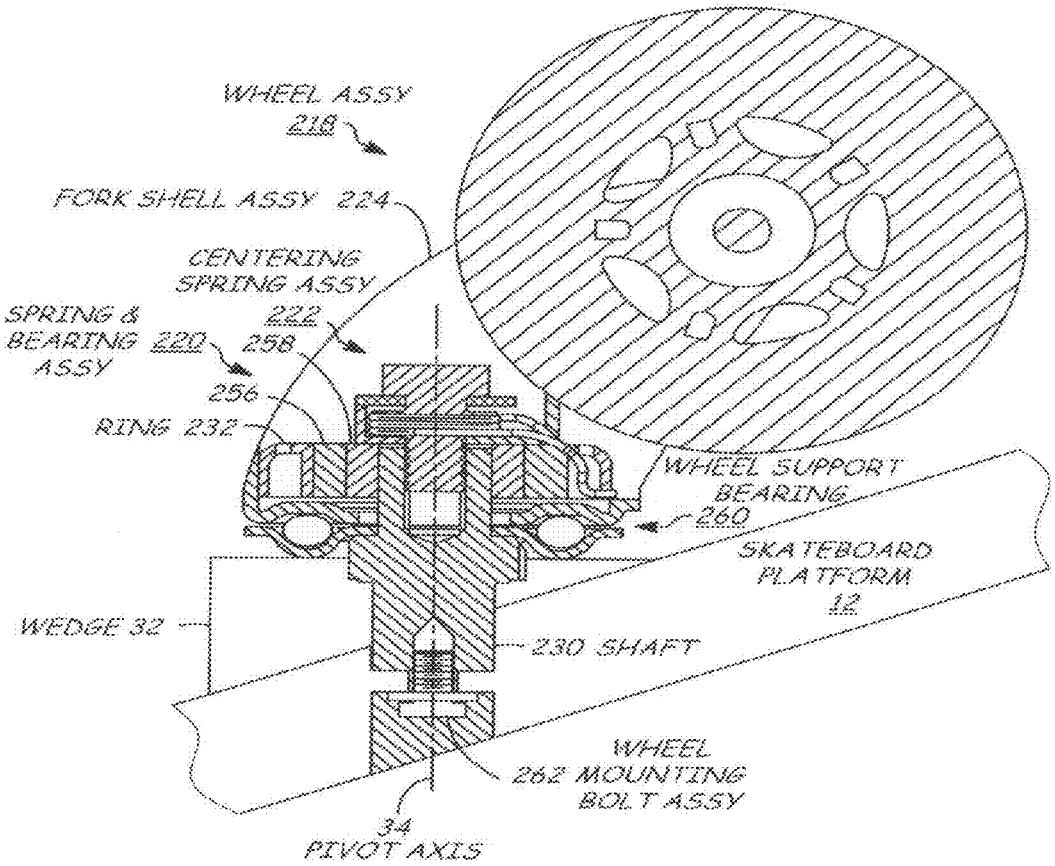
FIG. 33 is a cutaway view of wheel assembly 218 of FIGS. 30 and 3

Referring now to FIG. 33, wheel assembly 218, supported by wheel bearing support 260 such as a ball bearing assembly, is mounted via wedge 32 to skateboard platform 12 by wheel mounting bolt assembly 262 for pivotal rotation of fork shell assembly 224 about pivot axis 34, 50. Shaft 230 and inner race 258 of cartridge bearing assembly 232 are held rigidly to skateboard platform 12 and do not rotate while outer race 256, bearing ring 232 and fork shell assembly 224 rotate about pivot axis 34, 50 when forces are applied by actions of the rider which overcome the resistance of centering spring assembly 222.

Figure 34:
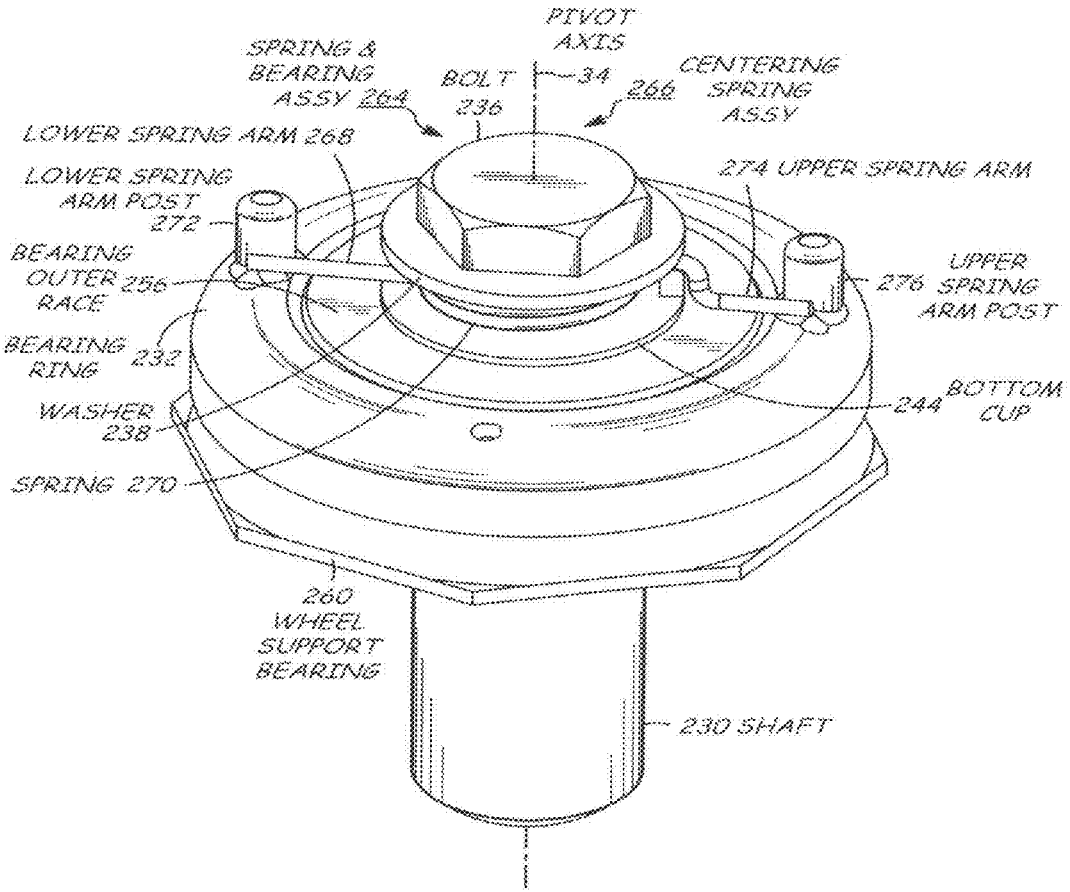
FIG. 34 is a perspective view of an alternate multi-arm spring return assembly.

Referring now to FIG. 34, spring and bearing assembly 264 illustrates another preferred embodiment of spring assembly 266 in which lower spring arm 268 of coiled spring 270 extends generally at a right angle from spring assembly 266 to contact lower spring arm post 272 mounted on bearing ring 232. Bearing outer race 256 may be press fit in bearing ring 232 which may support fork shell assembly 224—shown for example in FIGS. 30 and 31 above—for pivotal rotation about pivot axis 34, 50. Similarly, upper spring arm 274 of coiled spring 270 extends generally at a right angle from centering spring assembly 266 to contact lower spring arm post 276, which may also be mounted to bearing ring 256.

Coiled spring 270 is supported in centering spring assembly 266 around bolt 236 within bottom cup 244 which is pressed against bearing inner race 256 (not visible under bottom cup 244 in this figure) by washer 238 and spacer 240 (not visible behind spring 270) in this figure). Bolt 236 is secured in threads not shown in threaded shaft 230 which may itself be secured to skateboard platform 12 as shown in FIG. 33. Wheel support bearing 260 helps support bearing ring 232 for rotation about pivot axis 34, 50.

Figure 35:
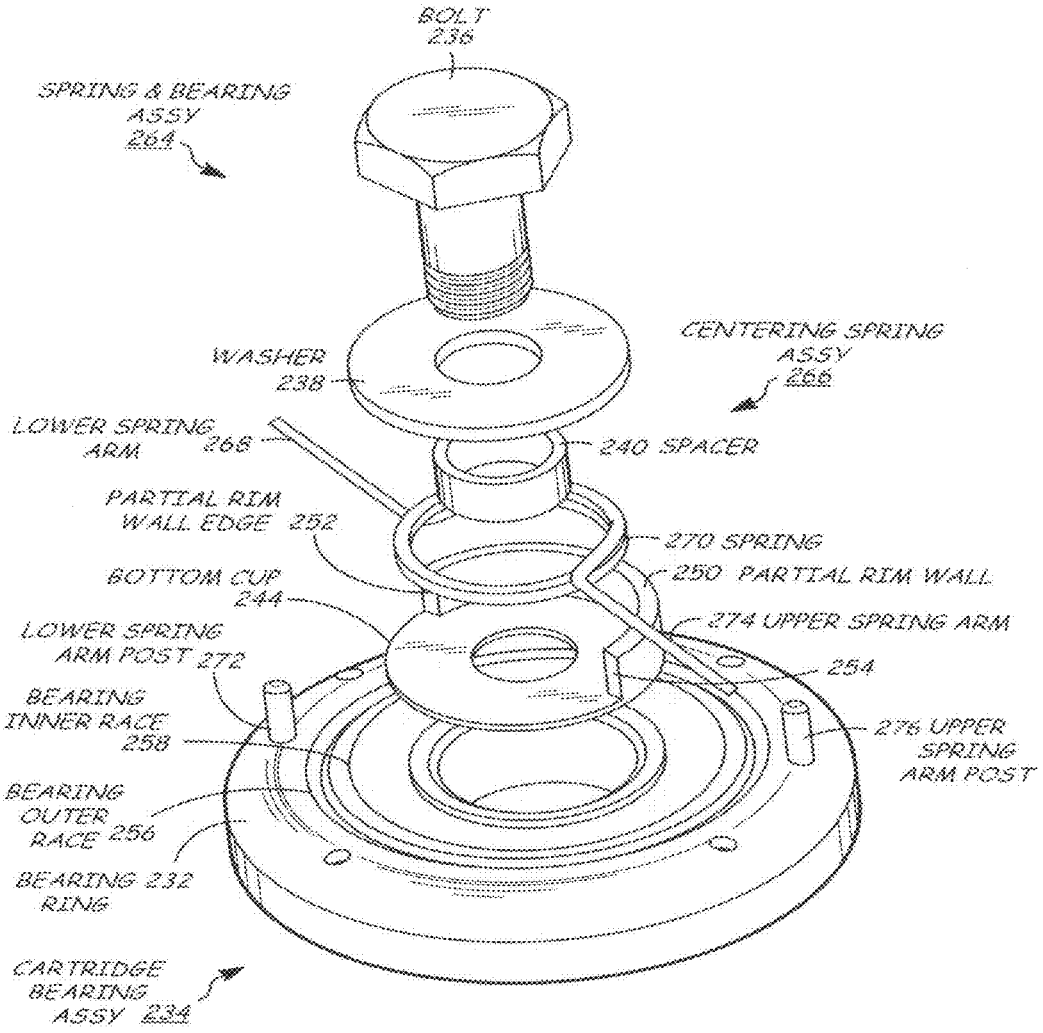
FIG. 35 is an exploded view of the multi-arm spring assembly of FIG. 34.

Referring now to FIG. 35, an exploded view of spring and bearing assembly 264 mounted in bearing ring 232, bolt 236 is supported by washer 232 which is supported by both space 240 and the partial rim of cup 244. Spring 270 fits within cup 244 and includes a coil which fits around spacer 240. Cup 244 hand an opening formed by partial rim wall edges 252 and 254. Lower spring arm 268 and upper spring arm 247 exit the opening in cup 244 and in the travel straight ahead orientation or forward direction. Lower spring arm 268 contacts non-pivoting edge stop 252 and pivoting post or stop 272 while upper spring arm 274 contacts non-pivoting edge stop 254 and pivoting post or stop 276. Sealed cartridge bearing assembly 234 includes inner race bearing 258 in mounted for rotation within outer raced bearing 258. When assembled, bottom cup 244 is pressed against inner race bearing 258 which is pressed against skateboard 10 and/or wedge 32 and does not rotate with respect to skateboard 10 while outer race bearing 256 may be press fit within and therefore mounted for rotation with bearing ring 232.

Figure 36:
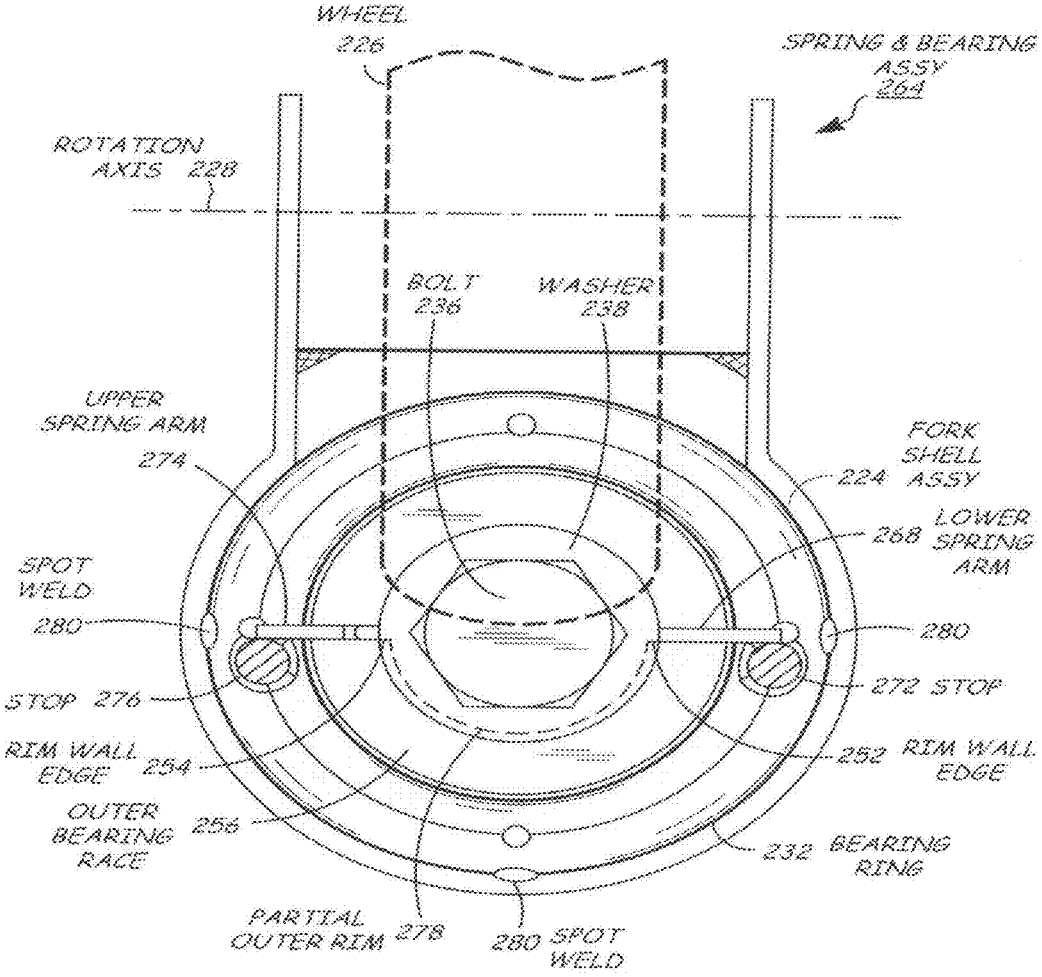
FIG. 36 is a partially cutaway view of the multi-arm return spring assembly in the neutral or straight ahead orientation.

Referring now to FIG. 36, a top view of spring and bearing assembly 264 is shown together with a portion of fork shell assembly 224 including a dashed line portion of wheel 226 mounted for rotation about wheel rotation axis 228. Also shown in dashed lines is the upper portion of partial outer rim 278 of bottom cup 244 including rim wall edges or non-pivoting stops 252 and 254. Inner bearing race 258 is not visible in this figure beneath washer 238. Outer cartridge bearing race 256 is shown press fit within bearing rim 232 to which fork shell assembly 224 may be affixed for pivotal rotation, by for example, spot welds 280. Upper and lower spring arm posts or stops 272 and 276 may also be fastened by spot weld or other procedure to the top surface of bearing ring 232 and/or fork shell assembly 224.

Spring 270, partially hidden in this figure under washer 238 but shown in more detail for example in FIG. 35, is captive within centering spring assembly 266 around bolt 236 and/or spacer 240. Spring arms 268 and 274 emerge from bottom cup 244 via the opening between rim wall edges or stops 254 and 252, and are therefore visible in this figure. Spring and bearing assembly 264 is shown in the neutral or straight ahead position in which the path of wheel 226 is along long or twist axis 28 (shown for example in FIG. 1) of skateboard 10, that is, skateboard 10 is—or is oriented to—move in a straight line or forward direction.

In this position, upper and lower spring arms 274 and 268 may extend at about right angles to pivot axis 34, 50—that is in an apparently straight line perpendicular to axis 34, 50- and are held from expanding to an angle greater than about 180° by rim wall edges 254 and 252 respectively. During assembly of centering spring assembly 266, it may be necessary to bring spring arms 268 and 274 together slightly to fit within the opening of bottom cup 244 between rim wall edges 252 and 254 and then allow spring arms 268 and 274 to move apart again against rim wall edges 252 and 254 which operate as non-pivoting stops. As shown above, bottom cup 244 is forced against inner bearing race 258 and does not rotate with respect to skateboard 10. Rim wall edges or stops 252 and 254 therefore do not rotate with respect to skateboard 10.

Lower and upper spring arms 268 and 274, in the straight ahead position shown in this figure, are also stopped up against lower and upper spring arm posts or pivoting stops 272 and 276, respectively. Posts 272 and 276 are secured to bearing ring 232 as shown or are in some other way caused to rotate with outer bearing race 256—and bearing ring 232 into which the periphery of outer bearing race 256 may be press fit—and fork shell assembly 224 which may be spot welded to bearing ring 232. In the straight ahead position shown in this figure, lower spring arm 268 is stopped by both non-pivoting rim wall edge 254 and pivoting stop 272 from expanding further away from upper spring arm 274 which is similar stopped by both non-pivoting both rim wall edge 254 and pivoting post or stop 276.

Figure 37:
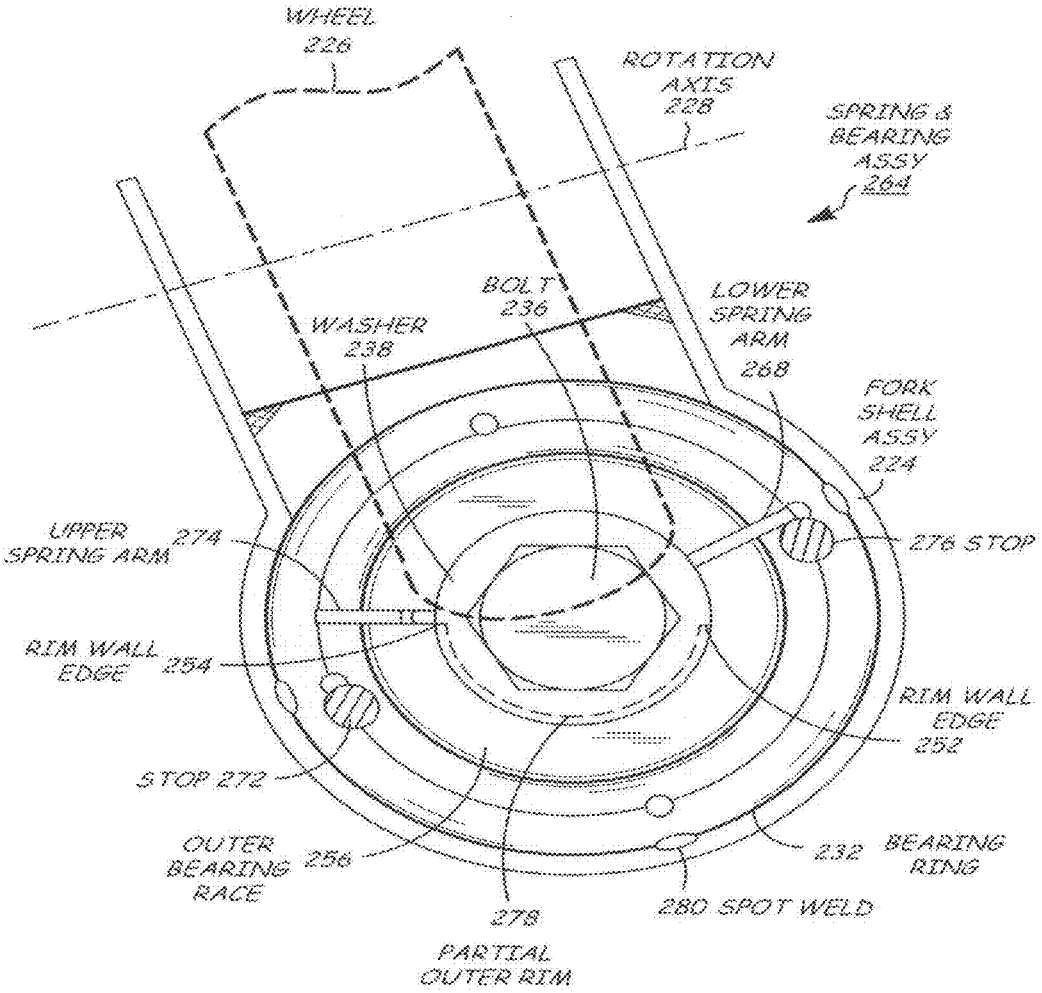
FIG. 37 is a view of the spring assembly of FIG. 36 in a steered orientation.

Referring now to FIG. 37, during operation of skateboard 10, for example during steering toward the right (i.e. lower left edge of figure as shown), trailing caster wheel 226 will tend to pivot toward the left. Edges or stops 252 and 254 do not rotate with respect to skateboard 226, but posts or stops 272 and 276 are mounted for pivotal rotation with wheel 226 and will rotate for steering, for example in a counter clockwise fashion as shown in the view in the figure. Rim wall edge 254 limits the rotation of upper spring arm 274, while stop 276 forces lower spring arm 276 to rotate toward upper spring arm 274. As a result, the spring tension of spring 266 resists the pivot rotation of wheel 226 about pivot axis 34, 50 so that when the forces causing caster wheel 226 to pivot are removed, for example when skateboard 10 become airborne during a maneuver after causing wheel 226 to pivot, the spring tension of spring 266 presses upper spring 274 against rim wall edge or stop 254 and rotates lower spring arm 268 against stop 276 until spring arm 268 is stopped from further rotation by contact with rim wall edge 252 when wheel 266 is again in the straight ahead or forward direction.

A similar resistance will be provided by spring 266 when forces are applied causing wheel 226 to rotate about pivot axis in the other or clockwise direction so that whenever forces causing pivotal rotation of either front or rear caster wheels on skateboard 10 are removed, for example when skateboard 10 becomes airborne, the caster wheels will be returned to the straight ahead position as skateboard 10 returns to the ground, greatly improving the rider's ability to make an acceptable landing after an airborne maneuver.

Referring now again to the embodiment shown in FIGS. 30-33, as shown for example in FIG. 30, spring arms 246 and 248 are pressed against the intersections of bearing ring 232 and fork shell assembly 224, acting as stops 272 and 276, and therefore operate in the same manner to resist pivoting of wheel 226 so that the wheel returns to the straight ahead riding direction aligned with long axis 28 before landing after an airborne maneuver. In fact, if either or both wheels become airborne, whether or not intentionally, they will return to the straight ahead direction upon landing if they were pivoted about pivot axes 34 or 50 before becoming airborne.

Figure 38:
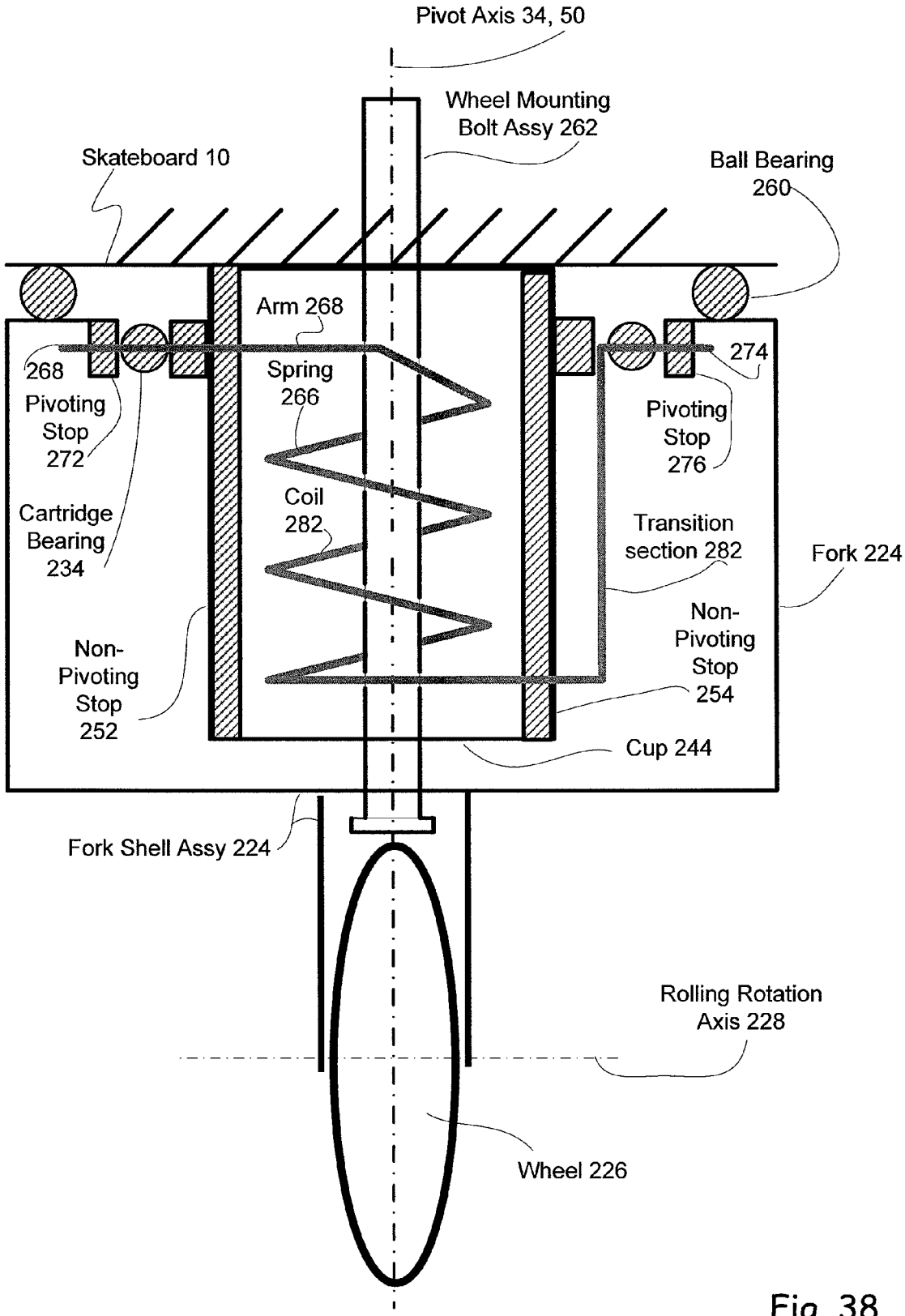
FIG. 38 is a schematic view of the multi-arm spring assembly.

Referring now to FIG. 38, in operation, wheel mounting bolt assembly 262 holds spring mounting cup 244 rigidly to skateboard 10 at a trailing acute angle along pivot axis 34, 50. Fork shell assembly 224 is supported for rotation about pivot axis 34, 50 by the outer race of cartridge bearing 234 which supports fork 224 for rotation about the inner race of the cartridge bearing on which cup 244 is mounted and ball bearing 260 which supports fork 224 for rotation about the bottom of skateboard 10 which is preferably the angled portion of wedge 32. Wheel 226 is supported by fork 224 for rolling rotation about axis 228 and pivotal rotation about pivot axis 34,50.

When wheel 226 is oriented for straight ahead or forward movement of skateboard 10, spring 266 maintains wheel 226 in this orientation by pressure of lower spring arm 268 against non-pivoting stop 252, which may be an edge of non rotating cup 244, and pivoting stop 272 which rotates about pivot axis 34, 50 with fork 224. Spring 266 may preferably be a multi-turn coiled torsion spring mounted in cup 244 coaxial with axis 34, 50 including first spring arm 268, coil 282 and second spring arm 274. Lower spring arm 268 may extend out from one end of coil 282 through an opening in cup 244, at a right angle from axis 34, 50 to contact stops 252 and 272 in the straight ahead position. Upper spring arm 274 may extend out from another end of coil 282 through the opening in the side or rim wall of cup 244, for example at the end of coil 282 through the opening in cup 244, for example at the end of spring coil 282 away from skateboard 10, also at a right angle to axis 34, 50.

It should be noted that in this configuration spring arm 268 could be against non-pivoting stop 252 at a different position along axis 34, 50 than arm 274 would be against non-pivoting stop 254. In a preferred embodiment, transition section 282 is used to position a terminal end of arm 274 against pivoting stop 276 at generally the same position along axis 34, 50 at which arm 268 is against pivoting stop 272. As a result, the portion of arm 274 against pivoting stop 276 is in the same plane, transverse to pivot axis 34, 50, as the portion of arm 268 which is against pivoting stop 272.

When forces are applied to skateboard 10 to steer wheel 226 away from the straight ahead position as shown, for example to move the front of wheel 226 toward the left of the drawing, spring 266 will resist pivot this pivotal rotation because arm 268 is prevented from moving by stop 252 and arm 274 resists movement of pivoting stop 276 mounted for motion with fork 224 and wheel 226. When the forces applied to steer wheel 226 to the left exceed the spring force applied by arm 274 against stop 276, fork 224 and wheel 226 may then rotate about axis 34, 50. In particular, when the forces applied by pivoting stop 276 exceed the spring forces applied by arm 274 and the right hand side of fork shell assembly 224, as shown in the figure, will move out of the plane of the figure toward the viewer.

This rotation of fork 224 will cause arm 274 to move away from contact with non-pivoting stop 254 which may be an edge of a rim wall of cup 244. Similarly, this rotation of fork 224 will cause pivoting stop 272 to move away from the viewer into the figure. Arm 268 will remain against non-pivoting stop 252 and will not move to follow pivoting stop 272. As arm 274 is rotated about pivot axis 34, 50 in this manner, it will rotate toward arm 268 in the same plane as arm 268. At a predetermined maximum angle of pivotal rotation, for example 180°, arm 274 will contact arm 268 forcing it against non-pivoting stop 252. Further pivotal rotation of wheel 226 would be prevented. If the ends of arms 268 and 274 are not in the same plane during pivotal rotation, they could become tangled or otherwise not provide a clean maximum angle of pivotal rotation and release from maximum pivotal rotation.

During operation when wheel 226 is caused to pivot about pivotal axis 34, 50 by forces applied to or by skateboard 10, and wheel 226 becomes airborne, spring 266 and in particular coil 282, will cause wheel 226 to return to the straight ahead position. In the example described above, when wheel 226 becomes airborne or otherwise loses full or partial contact with the ground, the forces applied to wheel 226 to pivot about axis 34, 50 are reduced or removed. When the spring force applied by arm 274 against pivoting stop 276 exceeds any remaining forces applied to wheel 226 for pivotal rotation, spring 266 causes fork 224 to rotate back toward the plane of the paper until arm 274 contacts non-pivoting stop 254. Pivoting stop 272 would rotate out from behind the figure toward the plane of the figure until pivoting stop 272 was again against arm 268. In this orientation, with arm 268 again against both pivoting stop 272 and non pivoting stop 252, and arm 274 against both pivoting stop 276 and non-pivoting stop 254, fork 224 and wheel 226 would again be oriented in the straight ahead position making contact between wheel 226 and the ground much easier at the end of the maneuver.

One advantage of arms 274 and 268 being in the same plane occurs when maximum pivotal rotation occurs and skateboard 10 becomes airborne. A smooth release of the maximum allowed pivoting rotation, e.g. arms 268 and 274, not becoming entangled when released from contact with each other, allows wheel 226 to more quickly and without hesitation return to the straight ahead or neutral orientation when skateboard 10 becomes airborne.

Forces applied to steer or pivot wheel 226 in the opposite direction are opposed by spring forces applied by arm 268 to pivoting stop 274 and cause wheel 226 to return to the neutral position when the forces are removed, for example when wheel 226 becomes airborne, or reduced below the spring forces, for example when at least some of the weight applied by the rider to wheel 226 is shifted therefrom to the other wheel of skateboard 10. This return spring assembly is preferably used with both caster wheels on skateboard 10 but may advantageously be used only with one such wheel under certain circumstances, for example, when the return to neutral position action is better applied to only one wheel.

Figure 39:
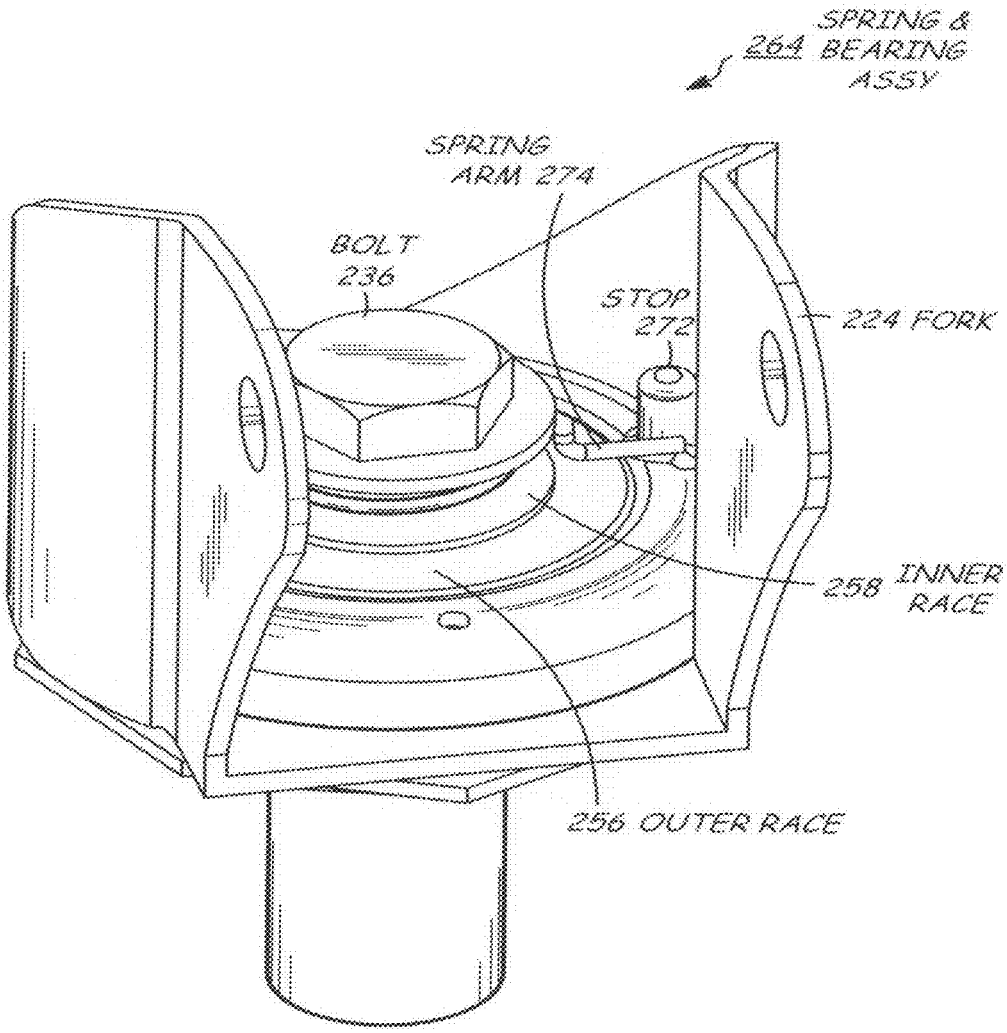
FIGS. 39 and 40 are illustrations of spring and bearing assembly 264 in a partially cutaway portions of fork 224.
Figure 40:
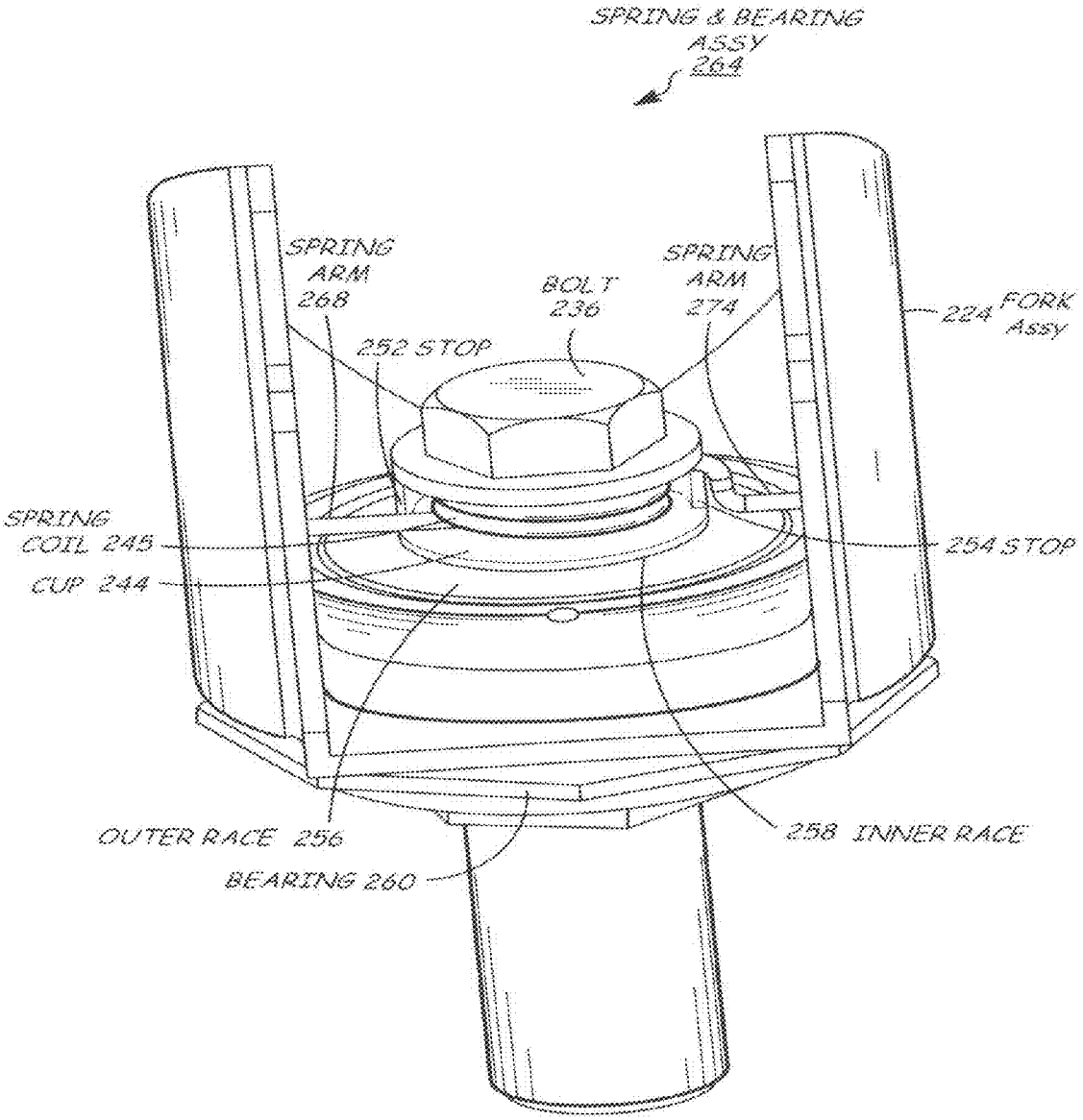

Referring now to FIGS. 39 and 40, additional views of spring and bearing assembly 264 with partially cutaway portion of fork 224 are shown including spring arm 274, stop 276, stop 254, bearing ring 232, outer race 256, inner race 258, cup 244, washer 238, bolt 236, stop 252, stop 272 and arm 268 are illustrated within a partially cutaway view of fork assembly 224 and wheel 226 to provide a perspective of the relative sizes, dimensions and relationship of the spring, bearing, fork and wheel components of one embodiment of the spring return caster described herein.

Figure 41A:
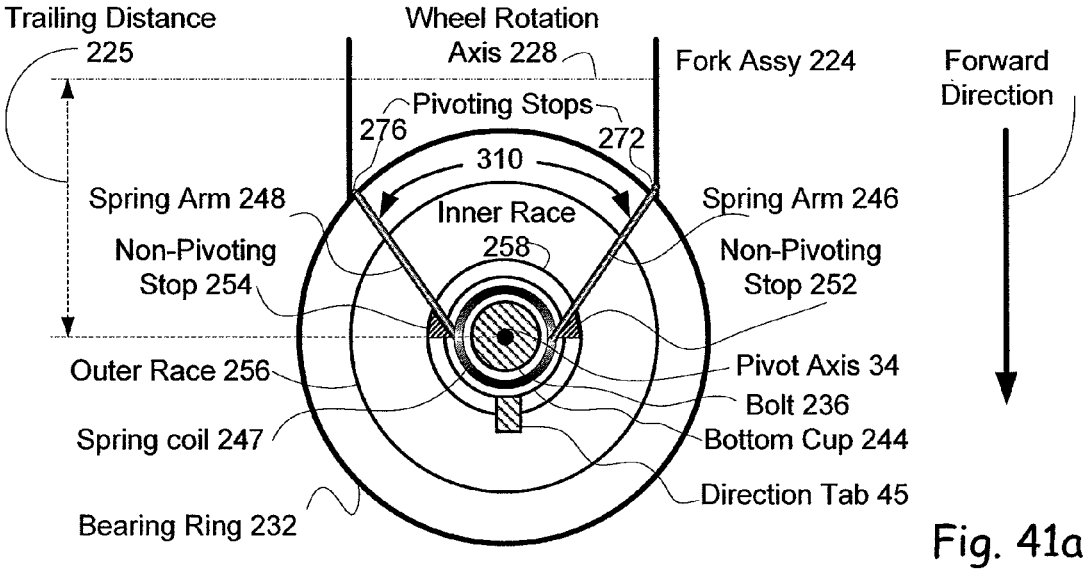
FIGS. 41*a*-41*c* are illustrations of a top view of the operation of one embodiment of a multi-arm coil centering spring wheel housing assembly.
Figure 41B:
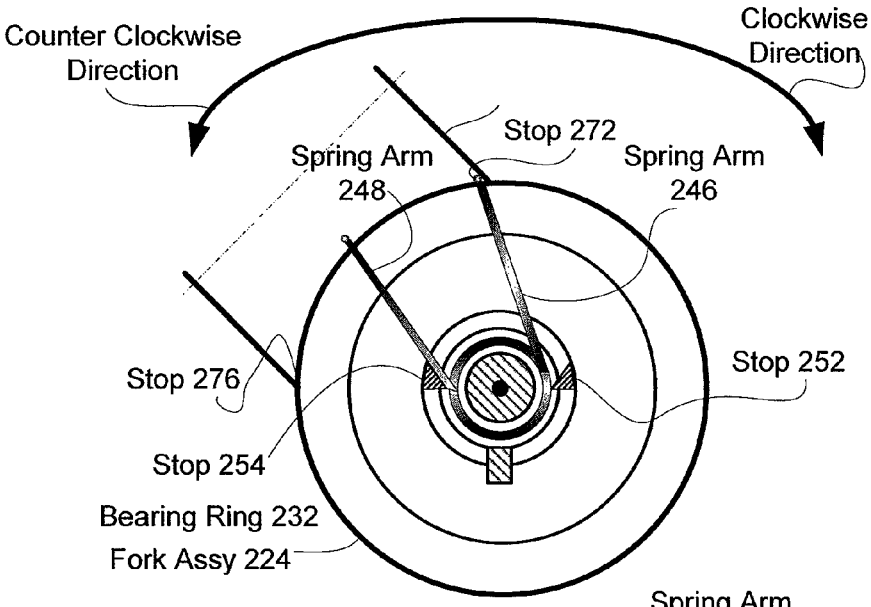
Figure 41C:
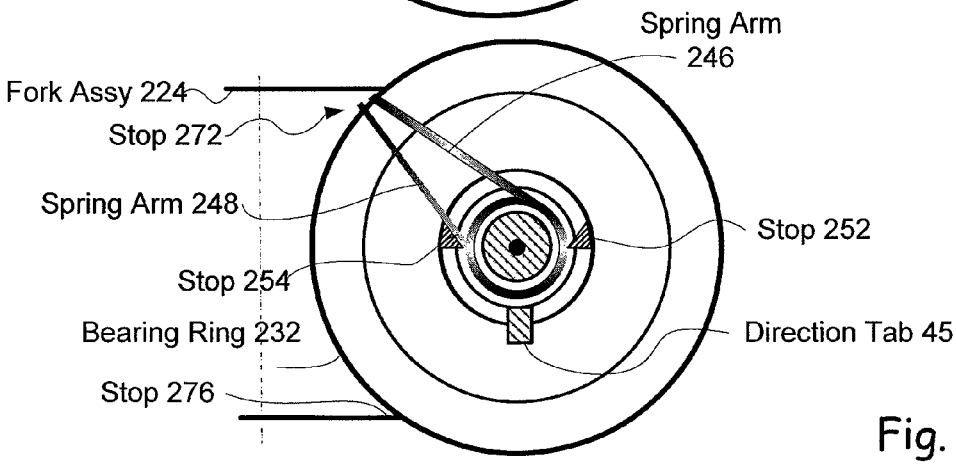

Referring now to FIGS. 41*a-c*, and also to the embodiments disclosed in FIGS. 31-40, operation of centering spring assembly 222 is illustrated with skateboard 10 aligned in a forward direction in FIG. 41*a*, with fork assembly 224 turned to an intermediate angle in the counterclockwise direction in FIG. 41*b* and to a predetermined maximum angle in the counterclockwise direction in FIG. 41*c*.

As shown in FIG. 41*a*, when skateboard platform 12 is moving in the forward direction, fork assembly 224 of wheel assembly 86 is oriented directly aft or behind the pivot axis—such as axis 34—by spring arms 248, 246 which are against non-pivoting stops 252, 254 respectively which are secured, for example to inner race 258 so the stops remain aligned with skateboard platform 12 and do not rotate during a steering maneuver. Direction tab 245, preferably on bottom cup 244, indicates the forward direction of skateboard 10 when caster wheel assembly 86 is properly assembled and mounted on skateboard 10 and may be used in an alignment fixture during assembly Maximum rotation of fork assembly 224 on bearing ring 232 and outer race 256 is shown as angle 310 and may preferably also be limited by contact between spring arms 248, 246 and pivoting stops 272, 276 as well as thrust cap fixed stops 300, 302 shown below in FIGS. 42*a-c*.

As shown in FIG. 41*b*, when for example skateboard 10 is being steered by the user toward the user's right (shown as the left side of the figure), fork assembly 224 may be caused to rotate counterclockwise against the resisting force of spring arm 246 which is against rotating or pivoting stop 272 which may conveniently be at one of the intersections between fork 224 and bearing ring 232. Spring arms 246, 248 are preferably part of integral coiled spring 242 including spring coil 247. As fork assembly 224 is caused to rotate in a counterclockwise direction, non-pivoting stop 254 prevents rotation of spring arm 248 which allows outer race 256, bearing ring 232 and other pivoting portions of fork assembly 224 to rotate. That is, spring arm 246 resists counterclockwise rotation of fork assembly 224 at intermediate angles by resisting counterclockwise rotation of stop 272, but spring arm 248 is against non-pivoting stop 254 allows stop 276 (at the intersection of a portion of fork shell 224 and bearing ring 232) to rotate away from arm 248.

As shown in FIG. 41*c*, counterclockwise steering rotation of fork assembly 224 may effectively be limited at a predetermined angle, such as maximum steering angle 310 when pivoting stop 272 of fork assembly 224, and spring arm 246, are rotated against spring arm 248 which is prevented from further rotation in the counterclockwise direction by non-rotating stop 254.

Similarly, steering rotation in a clockwise direction is resisted by spring arm 248 and pivoting stop 276 via spring coil 247 and non-pivoting stop 252 limiting clockwise steering rotation of spring arm 246 until rotating stop 276 and spring arm 248 contact spring arm 246 and/or non-pivoting stop 252.

If skateboard 10 becomes airborne during an intentional or unintentional maneuver while one or more fork assemblies 224 are pivoted in any direction except the forward direction, each centering spring assembly 222 causes each wheel 226, as shown for example in FIG. 30, to be aligned with long axis 28 to improve handling of skateboard 10 upon landing.

Figure 42A:
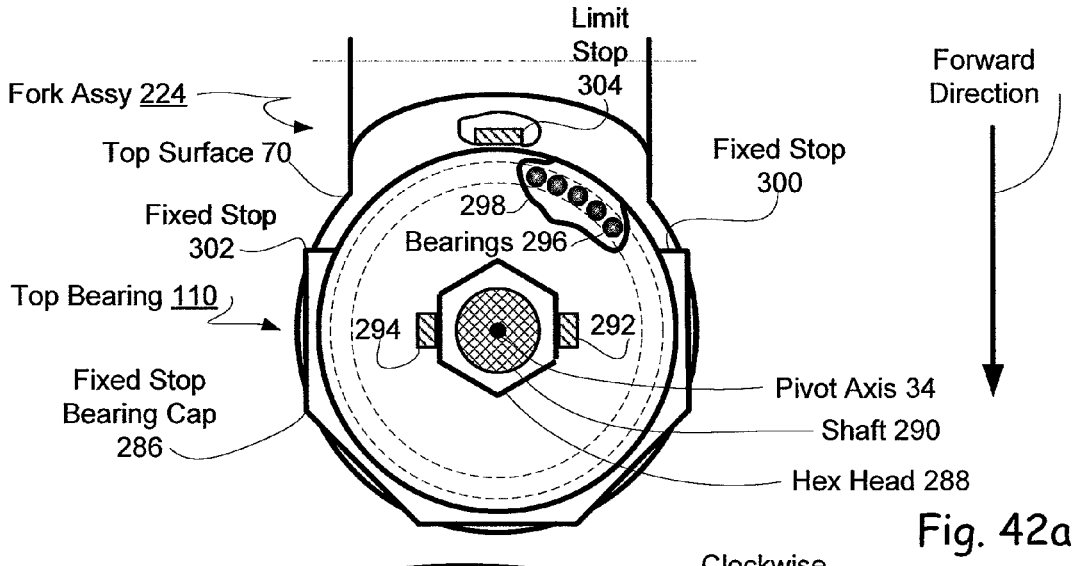
FIGS. 42*a-c* are illustrations of a top view of the operation of one embodiment of a bearing cap and limit stop to control the maximum steering angle of the wheel housing assembly.
Figure 42B:
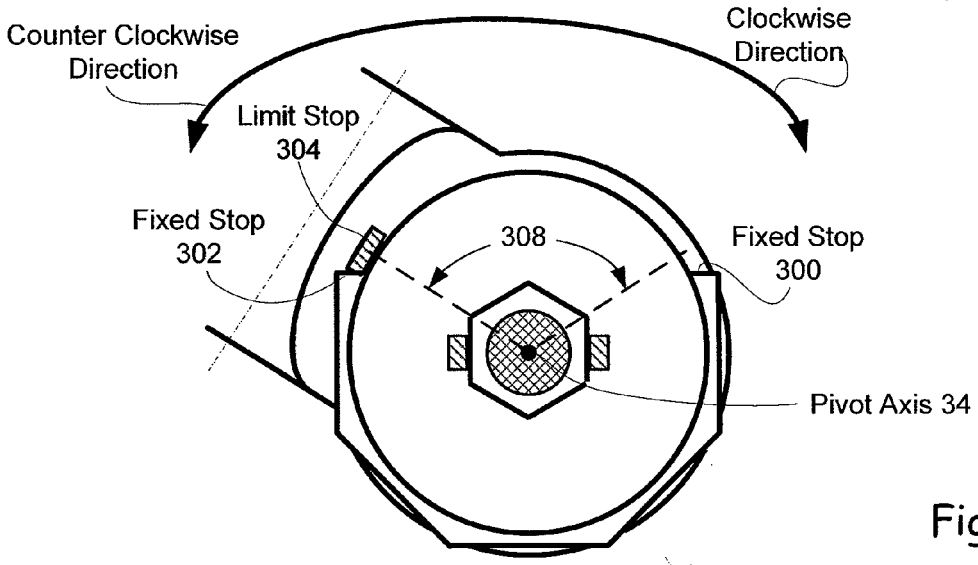
Figure 42C:
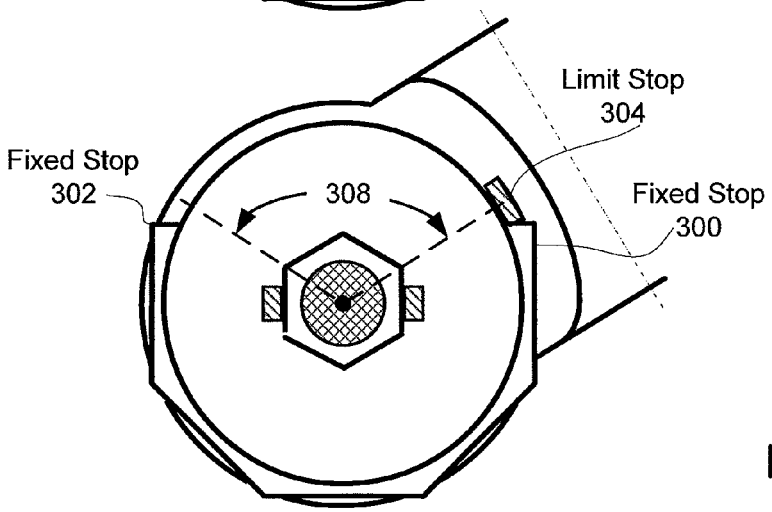

Referring now also to FIGS. 42*a-c*, a further set of positive stops associated with thrust bearing or bearing cap 95 at predetermined maximum steering rotation angles can be used together with and/or in lieu of the positive stop arrangement shown in FIGS. 41*a-c*. As shown for example in FIGS. 4, 11 and 13, top or thrust bearing 110 is formed between thrust bearing cap 95 and rotating top surface 70 of fork 42, 96.

Referring now to FIG. 42*a*, top bearing 110 is formed between top surface 70 of fork 96 of fork assembly 224 and bearing cap 286. The outer edge of a conventional thrust bearing cap has a series of flat edges, typically eight edges formed in an octagonal shape, so that bearing cap 95 may easily be held or secured by a wrench, fixture or other tool for alignment. Hex head 288 of non-rotating threaded axle or shaft 290, shown below in greater detail in FIG. 43, secures fixed stop thrust bearing cap 286 against top surface 70 of fork assembly 224 to capture a series of ball bearings—or other forms of bearing surfaces—and/or a flexible seal not shown in this figure, to form top or thrust bearing 110.

Fixed stop bearing cap 286 has an outer edge with multiple surfaces for a tool, not shown, for use in orienting, securing and/or tightening bearing cap 286 against top surface 70, with bearings 296 shown in cutout opening 298 through bearing cap 286. Movable stops 300 and 302 may be formed in a hexagonally shaped bearing cap 286 by removing material along the periphery and/or originally stamping cap 286 in this shape. Sufficient material of the periphery of cape 286 is missing or has been removed so that rotating limit stop 304 may be positioned on an upper portion of fork assembly 224, such as top surface 70, without interfering with steering rotation of fork assembly 224 until limit stop 304 rotates into contact with fixed stop 300 or fixed stop 302. Limit stop 304 may conveniently be formed by punching out an "H" shaped opening 306 in top surface 70 and bending up rotating limit stop 304 as a tab.

As shown in FIG. 42*b*, fork assembly 224 may be rotated in a counterclockwise direction by steering rotation about pivot axis 34 until limit stop 304 attached thereto contacts fixed stop 302.

As shown in FIG. 42*c*, fork assembly 224 may also be rotated in a clockwise direction by steering rotation about pivot axis 34 until limit stop 304 attached thereto contacts fixed stop 300. The total angular or steering rotation of fork assembly 224 permitted by the interaction between limit stop 304 and fixed stops 300, 302 is angle 308. As show in FIGS. 41*a-c*, the total angular steering rotation of fork assembly 224 is angle 310 as a result of the interactions of spring arms 246 and 248 with non-pivoting stop 252 or 254. In a preferred embodiment, steering angle 310 will be at least a slightly larger angle than steering angle 308 so that limit and fixed stops 304, 300 and 302 will provide a predetermined steering angle limit before contact between spring arms 246 and 248 limits further steering rotation.

Figure 43:
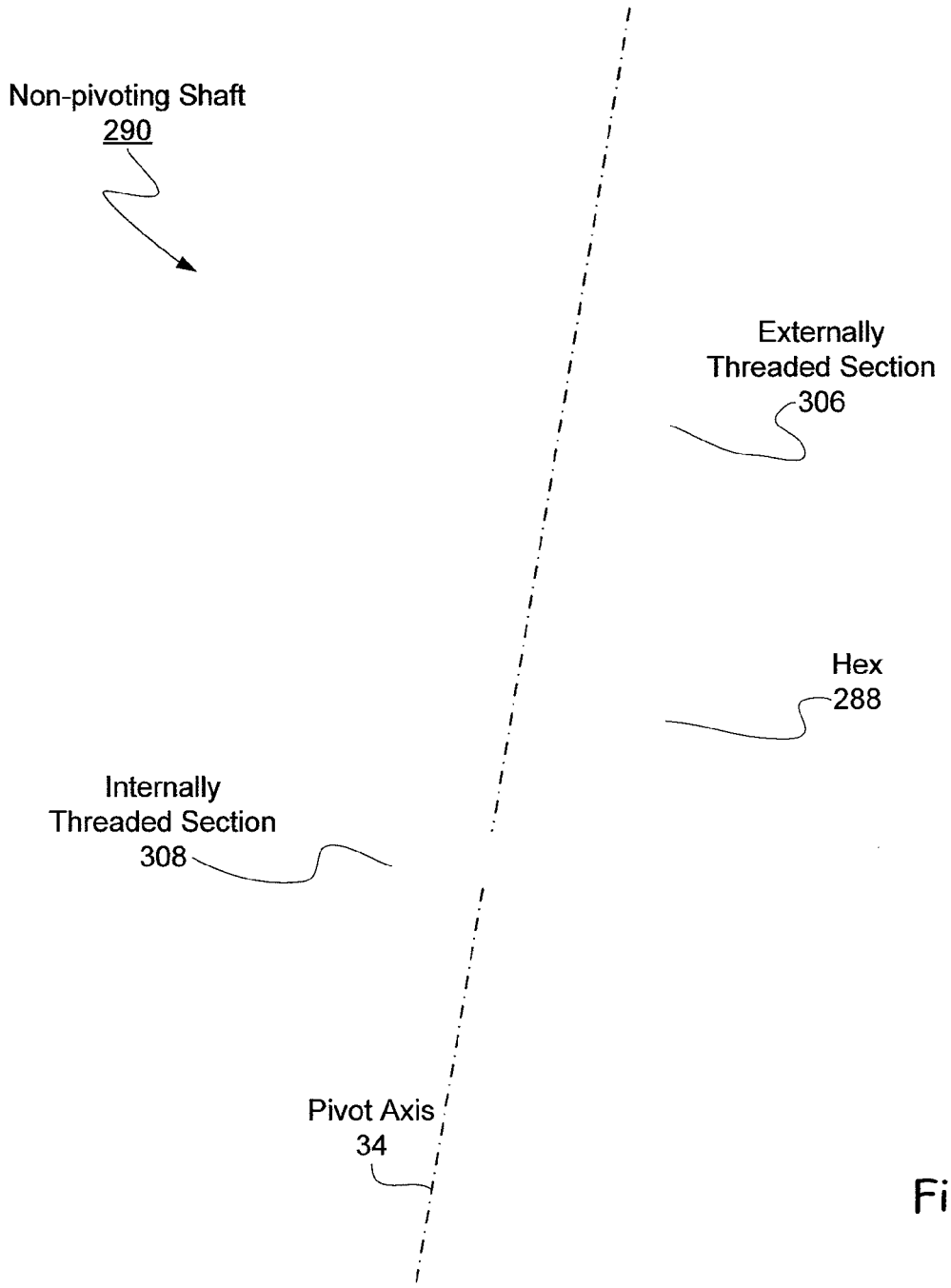
FIG. 43 is an illustration of non-rotating shaft 290.

Referring now to FIG. 43, non-pivoting axle or shaft 290 may conveniently be a partially threaded rod including external threaded section 306 which may be secured to skateboard platform 12, for example within hollow wedge 32 shown in FIG. 4. Fixed stop bearing cap 286 is secured to fork assembly 224 by hex 288 which may be integral on shaft 290. As shown in FIGS. 42*a-c*, dimples or welds on thrust bearing cap 286 prevent cap 286 from rotating with respect to shaft 290 and therefore with respect to skateboard platform 12. Shaft 290 may preferably be coaxial with pivot axis 34 and include internally threaded section 208. Fork assembly 224 and centering spring assembly 222 may be mounted for rotation to non-rotating shaft 290 by insertion of internally threaded section 308 tightly within a center aperture in inner race 258 of radial or cartridge bearing 234 secured by bolt 236, as shown for example in FIGS. 30 and 31.

Figure 44:
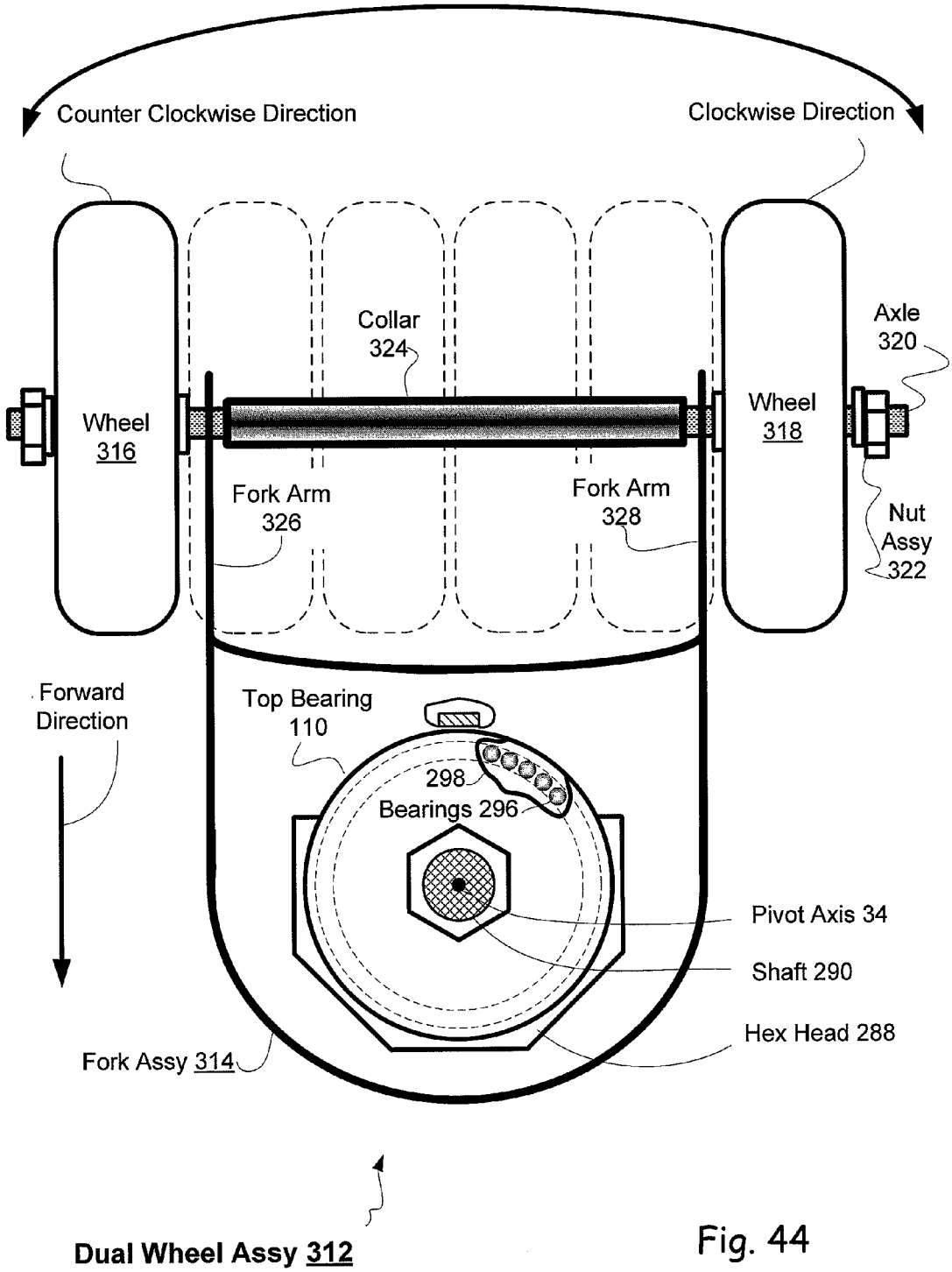
FIG. 44 is a top view of a dual wheel assembly used in one alternate embodiment.

Referring now to FIG. 44, a top view of dual wheel assembly 312 is illustrated that may be used in an alternate embodiment in replacement of one or both single wheel assemblies discussed above. Dual wheel fork assembly 314 is mounted for rotation about pivot axis 34 on shaft 290 which may be fastened to an appropriate wedge—integral with, or mounted to—the skateboard to provide the desired acute angle of axis 34.

It may be advantageous to use the same mounting arrangements, as shown herein above or in variations thereof, so that one or two dual wheel assemblies may be interchanged with single wheel assemblies. The wider stance, or ground contact, of a dual wheel truck such as dual wheel assembly 312, makes the skateboard less lively and easier to control. This may be desirable in certain circumstances, such as during training on a skateboard or for particular stunts or procedures. Similarly, some users may prefer to use a flexible skateboard with one or both wheel assemblies for other reasons, not requiring that the wheels be interchangeable.

Wheels 316 and 318 are each affixed to wheel axle 320—mounted through appropriate holes in fork arms 326 and 328 of fork assembly 314—by any suitable retainer assembly, such as nut assembly 322. Wheels 316 and 318 are separated by a fixed distance which, as shown in the figure in dotted lines, may be approximately between 0 and 2 wheel widths as shown in the figure, depending on the degree of liveliness desired in the skateboard action. It may be convenient to include a suitable spacing collar such as collar 324—which fits around wheel axis 320—between the open ends of fork assembly 314.

A suitable bearing assembly, such as top bearing 110 or other bearing described herein, may be used. It may be advantageous to use top bearing 110 with the above described integral hard stops which also makes the skateboard easier to learn and handle as well as improve certain skateboard tricks.

Figure 45:
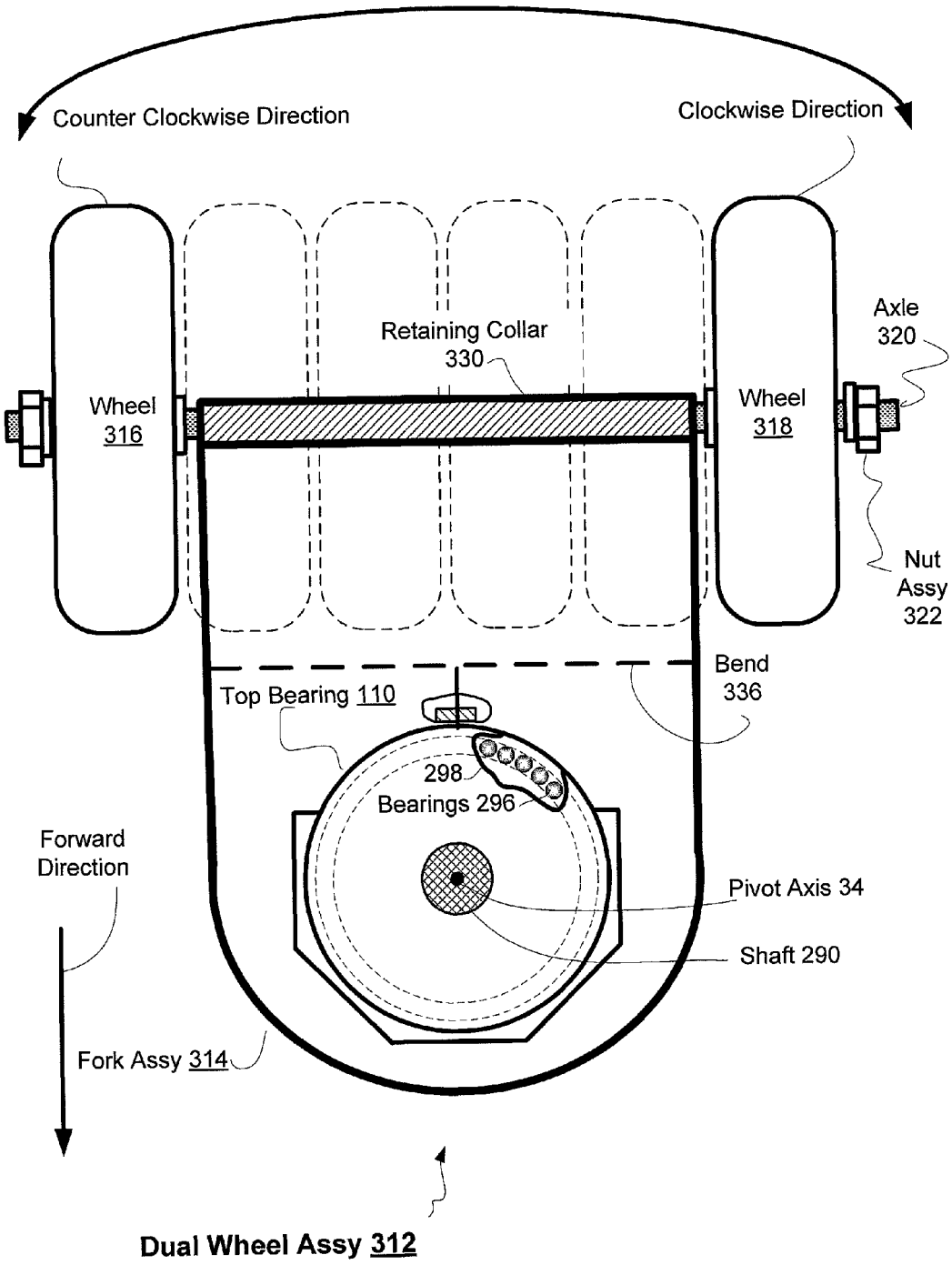
FIG. 45 is a top view of an alternate embodiment of the dual wheel assembly shown in FIG. 44.

Referring now to FIG. 45, an alternate embodiment of fork assembly 314 is shown as fork assembly 315 in which fork arms 326 and 328, as well as collar 324, may be replaced by forming one or more bends, such as bend 336 in the sheet metal of fork assembly 315 as well as round retaining collar 330 at one end of fork assembly 315 to mount axle 320 for rotation. One advantage of the use of bend 336 in fork assembly 315 is that flexure about bend 336 may serve as a simple shock absorber making landings easier after a jump.

Figure 46:
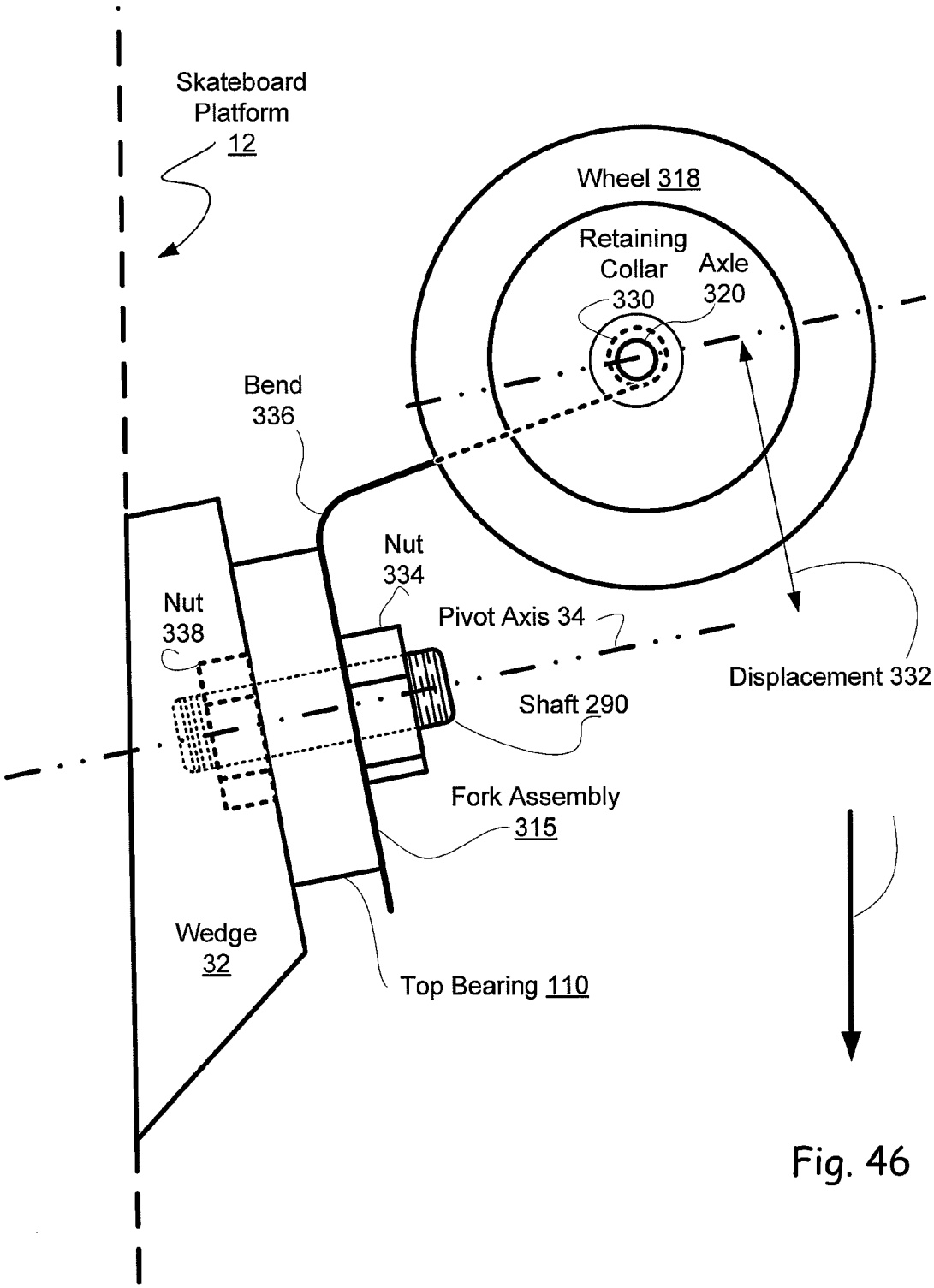
FIG. 46 is a side view of the dual wheel assembly shown in FIG. 45.

Referring now to FIG. 46, a side view of fork assembly 315 is shown in which one end of fork assembly 315 is mounted for rotation about pivot axis 34 and secured against top bearing assembly 110 by nut 334 threaded on shaft 290. The other end of shaft 290 is held captive by nut 338, shown in dotted lines, inside wedge 32 integral with or fastened to skateboard platform 12. The other end of fork assembly 315 is formed in rolled retaining collar 330 shown in dashed lines behind wheel 318. The nut normally threaded on axle 320 has been removed for clarity.

The invention claimed is:

1. A skateboard, comprising:

a one piece flexible skateboard platform having first and second foot support areas aligned along a longitudinal axis;

a pair of wheel assemblies, each including a bearing having inner and outer bearing races, a wheel housing supporting at least one wheel for rotation about a rotational axis, the wheel housing secured to the outer bearing race for steering rotation therewith respect to the inner bearing race about a pivot axis at the acute angle;

a pair of fixed stops securing the inner race of said at least one of the wheel housing to the platform at an acute angle, and at least one limit stop mounted for rotation with said at least one of the wheel housings for preventing steering rotation of that wheel housing beyond a present limit by interaction with one of the pair fixed stops;

wherein at least one of the pair of wheel assemblies include a pair of fixed stops securing the inner race of the bearing in that wheel assembly to the platform at an acute angle, wherein the central area further comprises:

a plurality of longitudinal elements generally aligned with the longitudinal axis mounted to both the first and second foot support areas so that the skateboard flexes as a single unit, wherein the central area flexes more than the first and second foot support areas when a user twists the foot support areas in opposition directions about the longitudinal axis, wherein the central area includes vertical support to resist bowing from supporting a rider, wherein twisting of the foot support areas in opposite directions by a user causes rotation of the wheels in the same direction to move the skateboard in that direction.

2. A skateboard, comprising:

a one piece flexible skateboard platform having first and second foot support areas aligned along a longitudinal axis;

a pair of wheel assemblies, each including a bearing having inner and outer bearing races, a wheel housing supporting at least one wheel for rotation about a rotational axis, the wheel housing secured to the outer bearing race for steering rotation therewith respect to the inner bearing race about a pivot axis at the acute angle;

a pair of fixed stops securing the inner race of said at least one of the wheel housing to the platform at an acute angle, and at least one limit stop mounted for rotation with said at least one of the wheel housings for preventing steering rotation of that wheel housing beyond a present limit by interaction with one of the pair fixed stops;

wherein at least one of the pair of wheel assemblies includes a pair of fixed stops securing the inner race of the bearing in that wheel assembly to the platform at an acute angle, wherein the central area further comprises:

a plurality of longitudinal elements generally aligned with the longitudinal axis mounted to both the first and second foot support areas so that the skateboard flexes as a single unit, wherein the central area flexes more than the first and second foot support areas when a user twists the foot support areas in opposition directions about the longitudinal axis, wherein twisting of the foot support areas in opposite directions by a user causes rotation of the wheels in the same direction to move the skateboard in that direction, wherein the central area includes vertical support to resist bowing from supporting a rider, wherein twisting of the foot support areas by the user causes rotation of the wheels in the same direction to move the skateboard from a standing start.

3. A skateboard, comprising:

a one piece flexible skateboard platform having front and rear foot support areas joined by a narrower central area, all aligned along a longitudinal axis, the narrower central area including vertical support extending below the platform and resisting bowing from supporting a rider;

a front wheel assembly supporting the front foot support area, the front wheel assembly having a single wheel mounted for pivotal rotation about a front axis at a first acute angle to the platform;

a rear wheel assembly supporting the rear foot support area, the rear wheel assembly having a single wheel mounted for pivotal rotation about a rear axis at a second acute angle to the platform;

wherein twisting rotation along the longitudinal axis of one of the foot support areas with respect to the other one of the foot support areas by the rider causes rotation of the wheels to propel the platform.

4. The invention of claim 3, wherein at least one of the front and rear wheel assemblies further comprises:

a bearing having inner and outer bearing races and a bearing cap, one of said inner and outer bearing races mounted to said at least one of the foot support areas and the other one of said inner and outer bearing races mounted to the wheel assembly supporting said at least one of the foot support areas;

a helical spring mounted coaxially with the pivotal axis of said wheel assembly urging said wheel assembly toward said longitudinal axis, said spring including a spring arm at each end thereof;

a first pair of fixed stops, fixed to said platform and a second pair of stops mounted for pivotal rotation with said wheel assembly supporting said at least one of the foot support areas;

wherein pivotal rotation of said wheel assembly in a first direction causes said helical spring arms to be compressed by one of said first pair of fixed stops and one of said second pair of stops to resist said pivotal rotation, and pivotal rotation of said wheel assembly in a second direction causes said helical spring arms to be compressed by the other one of said first pair of fixed stops and the other one of said second pair of stops to resist said pivotal rotation, so that said helical spring centers the wheel assembly along the longitudinal axis when the platform is airborne.

5. The invention of claim 4 wherein said at least one of said foot support areas is said front foot support area.

6. The invention of claim 4 wherein said at least one of said foot support areas is said rear foot support area.

7. The invention of claim 4 wherein said at least one of said foot support areas includes both the front and rear foot support area.

8. The invention of claim 4 further comprising a limit stop mounted for rotation with said wheel assembly; and a third pair of fixed stops fixed to said bearing cap, so that total pivotal rotation of said wheel assembly is limited in both the first and second directions.

* * * * *